United States Patent [19]

Daswick

[11] 4,137,333

[45] Jan. 30, 1979

[54] PACKAGED MEAT SANDWICH

[76] Inventor: Alexander C. Daswick, 647 Orange Grove, South Pasadena, Calif. 91103

[21] Appl. No.: 654,712

[22] Filed: Feb. 2, 1976

Related U.S. Application Data

[63] Continuation-in-part of Ser. No. 209,738, Dec. 20, 1971, abandoned.

[51] Int. Cl.[2] ..... B65B 25/22

[52] U.S. Cl. ..... 426/120; 220/20; 220/22; 220/DIG. 27; 220/367; 220/370; 220/372; 229/3.5 MF; 229/DIG. 13; 229/DIG. 14; 229/37 R; 229/40; 426/92; 426/113; 426/123; 426/124

[58] Field of Search ..... 229/3.5 MF, DIG. 14, 229/DIG. 13; 220/22, 20, 13, 361, 367, 368, 369, 370, 371, 372, 373, DIG. 27, DIG. 10; 30/323, 137, 150; 99/416, 417, 448; 426/106, 109, 110, 113, 114, 118, 119, 120, 122, 123, 124, 392, 393, 395, 396, 412, 401, 397, 523, 510, 511, 229, 37 R, 40

[56] References Cited

U.S. PATENT DOCUMENTS

| | | | |
|---|---|---|---|
| Re. 7,995 | 12/1877 | Poule | 30/137 |
| 1,938,185 | 12/1933 | Larsen | 126/377 |
| 2,600,566 | 6/1952 | Moffett, Jr. | 426/234 |
| 2,714,070 | 7/1955 | Welch | 426/234 |
| 2,777,769 | 1/1957 | Hodges | 426/113 |
| 2,878,128 | 3/1959 | Jorgenson | 426/114 |
| 2,939,793 | 6/1960 | Richman | 426/107 |
| 2,943,883 | 7/1960 | Hansen | 30/322 |
| 2,965,501 | 12/1960 | Harriss | 426/120 |
| 3,068,779 | 12/1962 | Eidlisz | 99/416 |
| 3,079,912 | 3/1963 | Griem | 126/390 |
| 3,185,372 | 5/1965 | Ferraro | 426/107 X |
| 3,201,258 | 8/1965 | Mastella | 426/123 |
| 3,219,460 | 11/1965 | Brown | 426/116 |
| 3,240,610 | 3/1966 | Cease | 426/113 |
| 3,271,169 | 9/1966 | Baker et al. | 426/114 X |
| 3,287,140 | 11/1966 | Brussell | 426/109 |
| 3,337,114 | 8/1967 | Lockwood | 229/37 R |
| 3,342,329 | 9/1967 | Knight | 229/37 R X |
| 3,410,697 | 11/1968 | Stephenson | 426/114 |
| 3,424,596 | 1/1969 | Sullivan | 426/113 |
| 3,432,087 | 3/1969 | Costello | 426/113 |
| 3,465,873 | 9/1969 | Munz | 426/114 |
| 3,608,770 | 9/1971 | Naimoli | 229/3.5 MF X |
| 3,641,992 | 2/1972 | Peysers | 126/378 |
| 3,659,584 | 5/1972 | Doyle | 220/13 X |
| 3,665,491 | 5/1972 | Cooper | 426/243 |
| 3,830,944 | 8/1974 | Dimitriadis et al. | 426/113 |
| 3,873,735 | 3/1975 | Chalin et al. | 426/114 X |
| 3,985,992 | 10/1976 | Goltsos | 426/243 |
| 4,015,085 | 3/1977 | Woods | 426/107 X |
| 4,051,266 | 9/1977 | Goltsos | 426/120 |

FOREIGN PATENT DOCUMENTS

| | | | |
|---|---|---|---|
| 562966 | 9/1958 | Canada | 426/124 |
| 1014313 | 4/1946 | France | 99/417 |
| 984525 | 2/1949 | France | 99/417 |

OTHER PUBLICATIONS

Food Packer, p. 40, 11/56.

*Primary Examiner*—Steven L. Weinstein
*Attorney, Agent, or Firm*—Gene W. Arant

[57] ABSTRACT

A prepared meat product is contained in a disposable package suitable for transporting, cooking, and serving. One specific form is a meat patty; a second specific form is a hamburger patty together with half a hamburger bun; a third specific form is a hamburger patty together with two half hamburger buns; and a fourth specific form is a wiener together with two half wiener buns.

The package of the present invention is disposable and is preferably made primarily of aluminum foil. Some specific features of different forms of the package are a built-in grease trap, filtered vent for cooking gases, removable protective cover for the vent, and removable holder for the meat product for removing the cooked meat product from the package when it is to be served.

The invention also makes provision for cooking the meat product faster than the bread when both are enclosed in the same package, and provision for using cooking gases from the meat to warm and moisten the bread.

8 Claims, 102 Drawing Figures

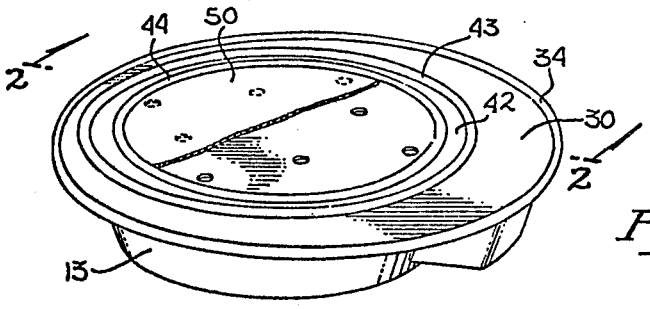
Fig. 1
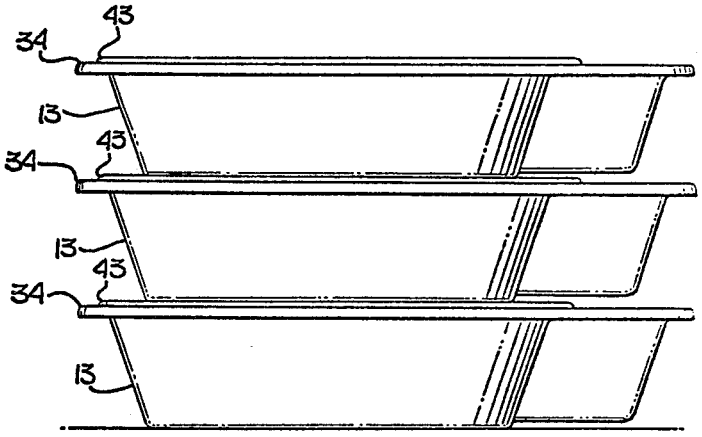
Fig. 2
Fig. 3
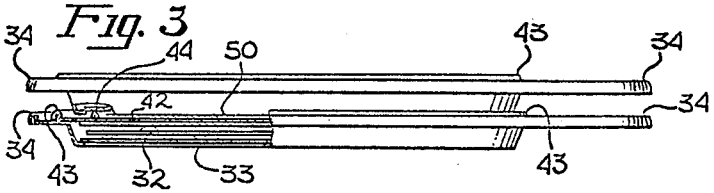
Fig. 4
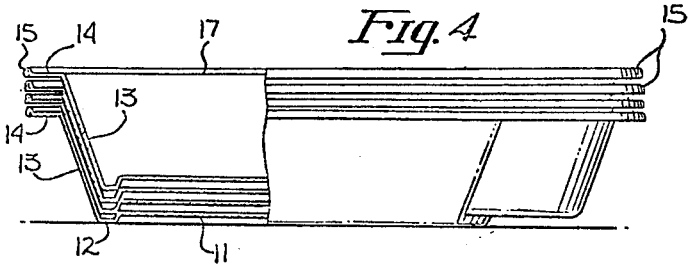

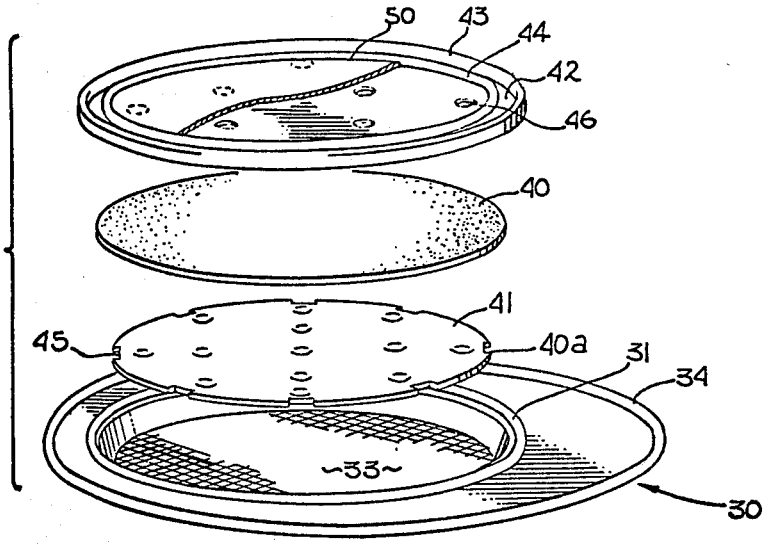
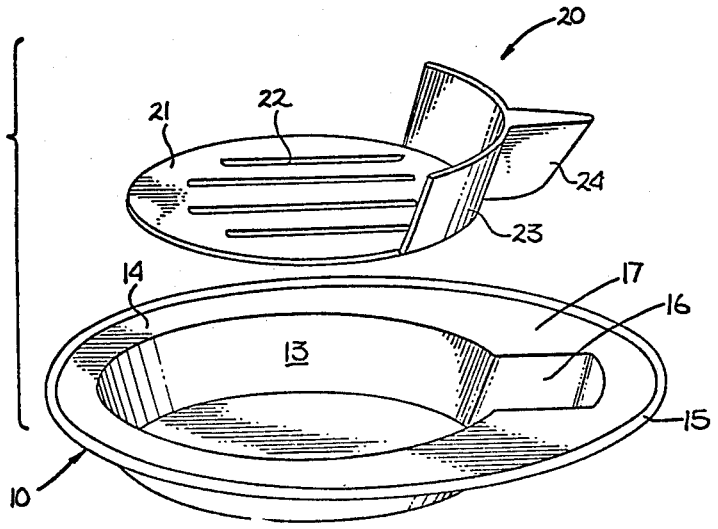
Fig 11

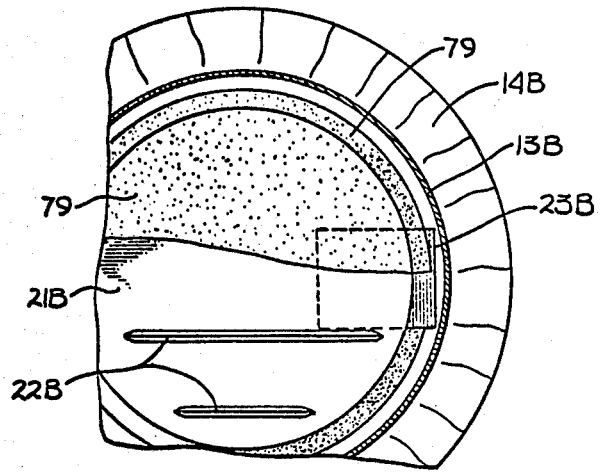
Fig. 15
Fig. 16
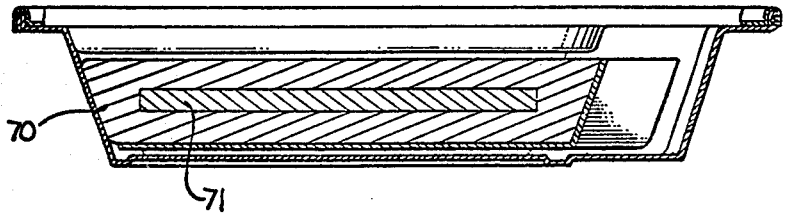
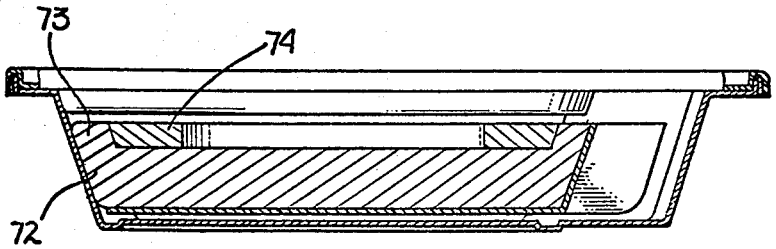
Fig. 17
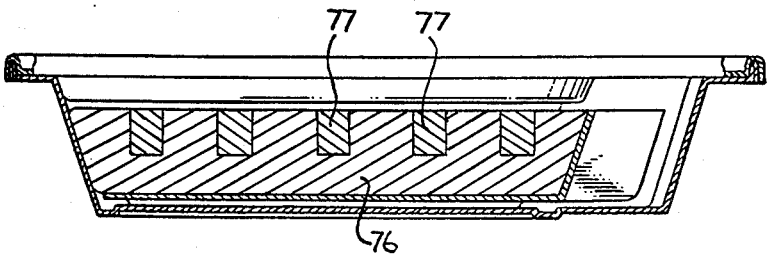
Fig. 18

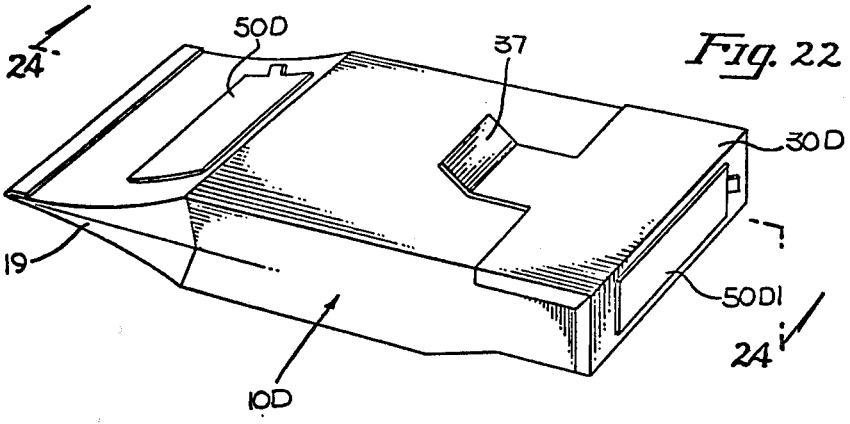
Fig. 22
Fig. 23
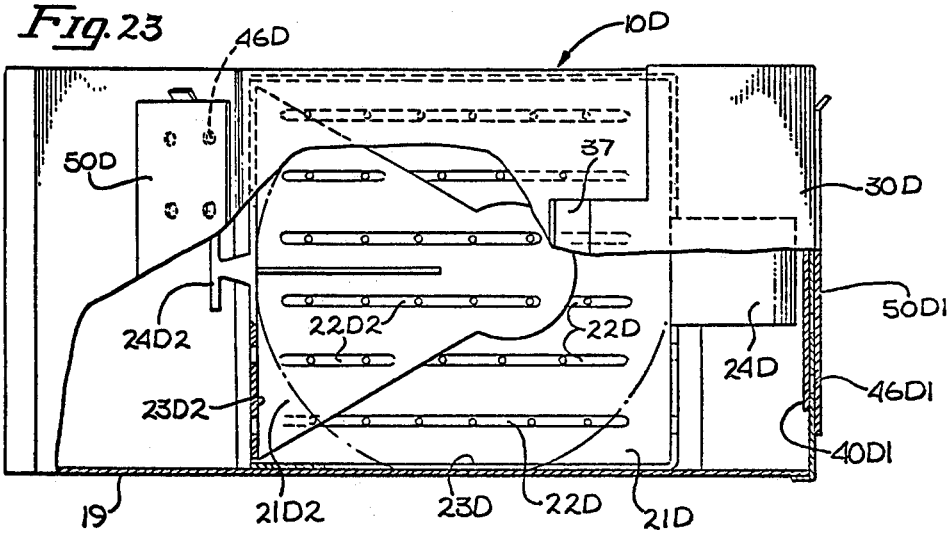
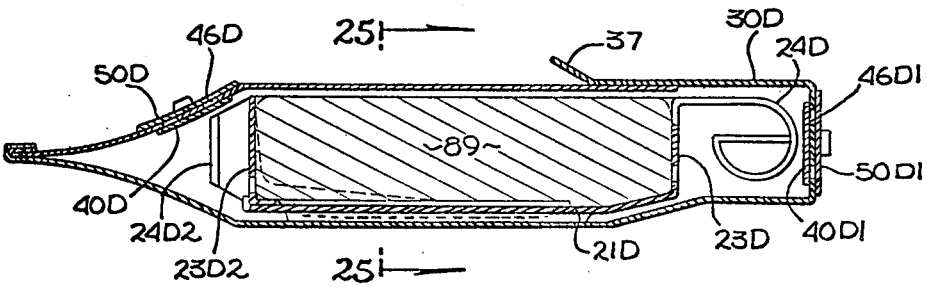
Fig. 24

Fig. 30
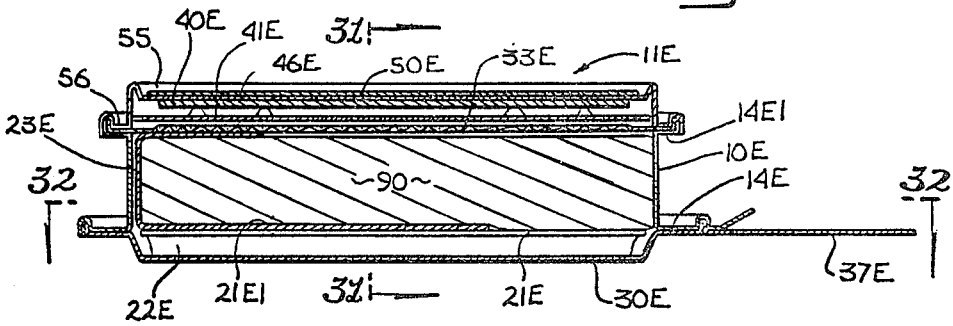
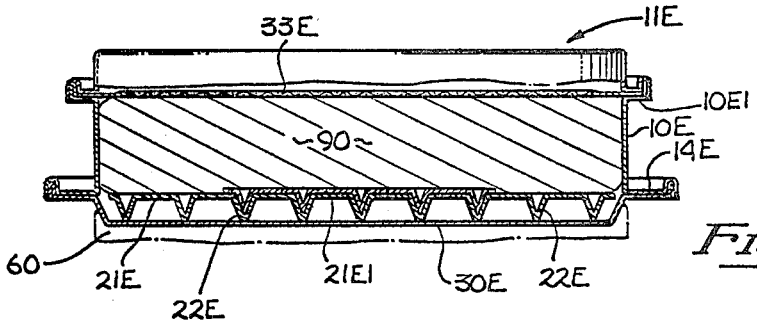
Fig. 31
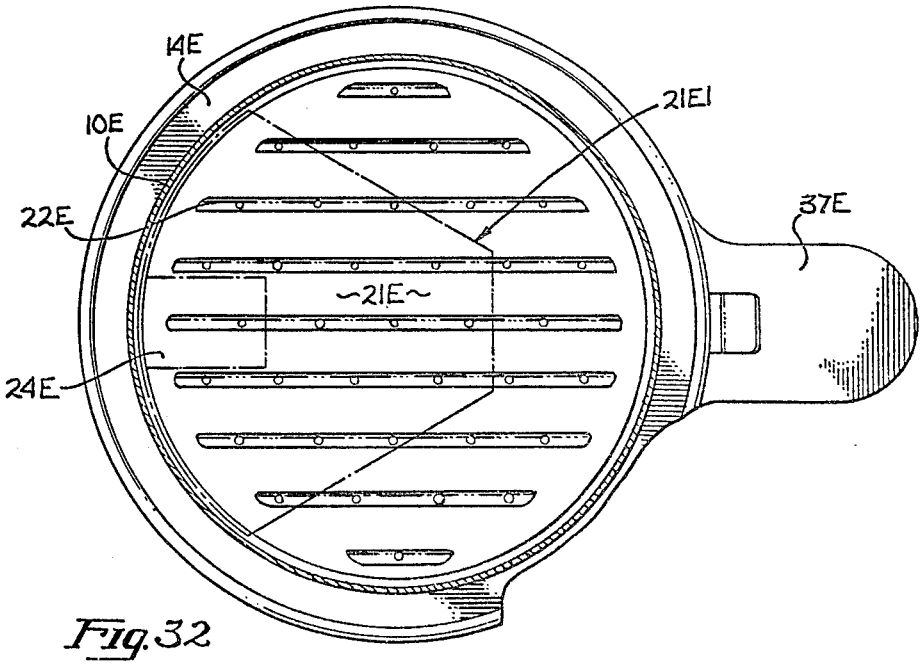
Fig. 32

Fig. 41
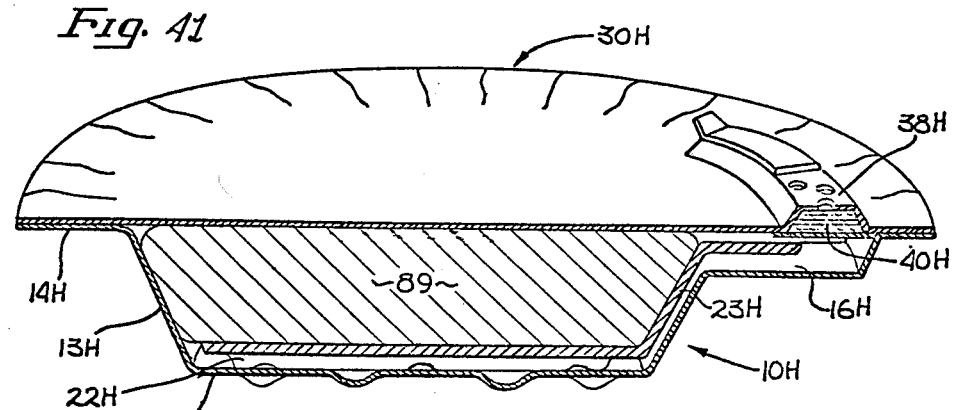
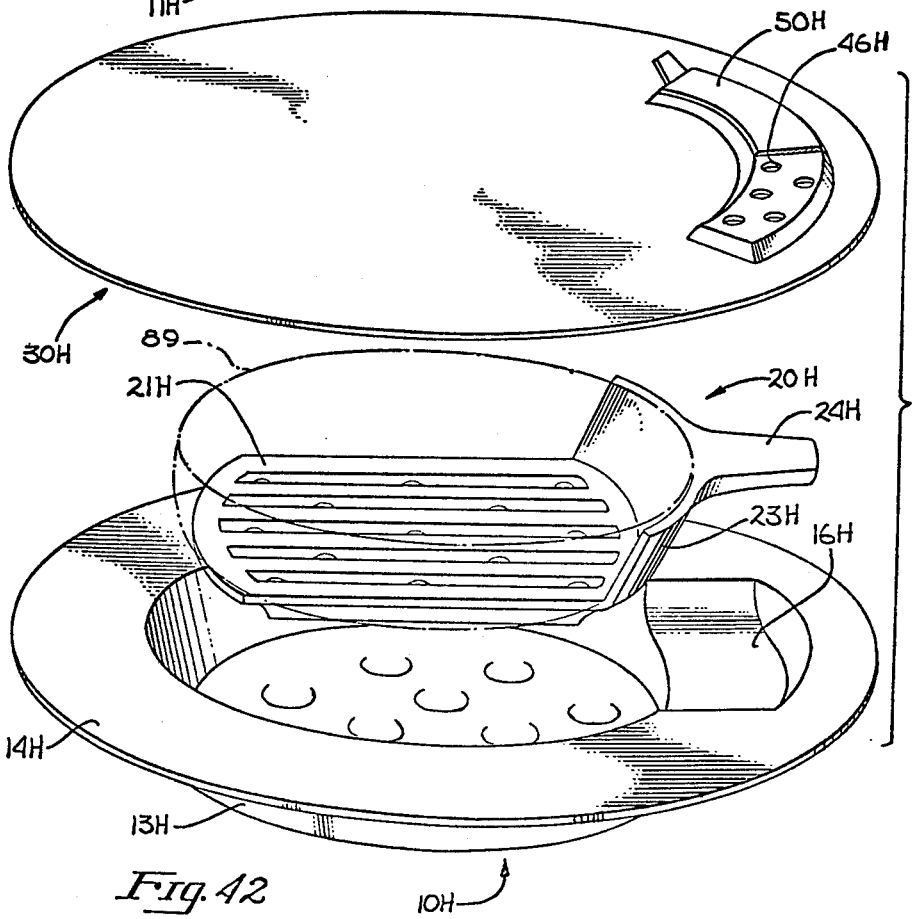
Fig. 42

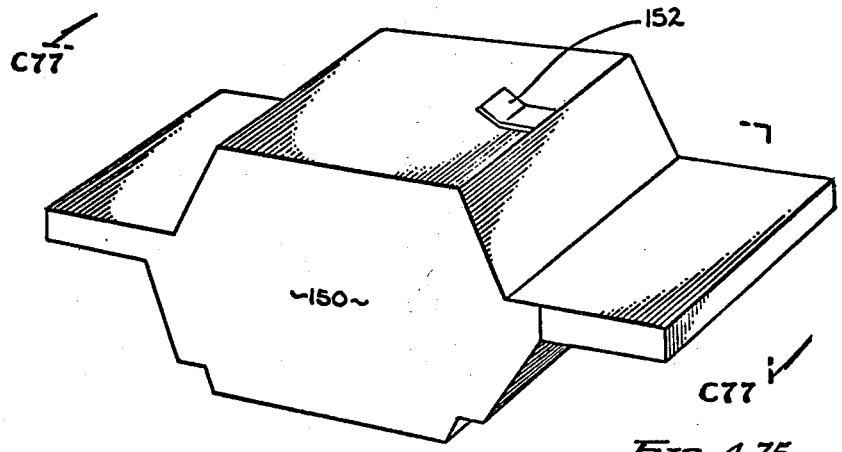
Fig. A 75
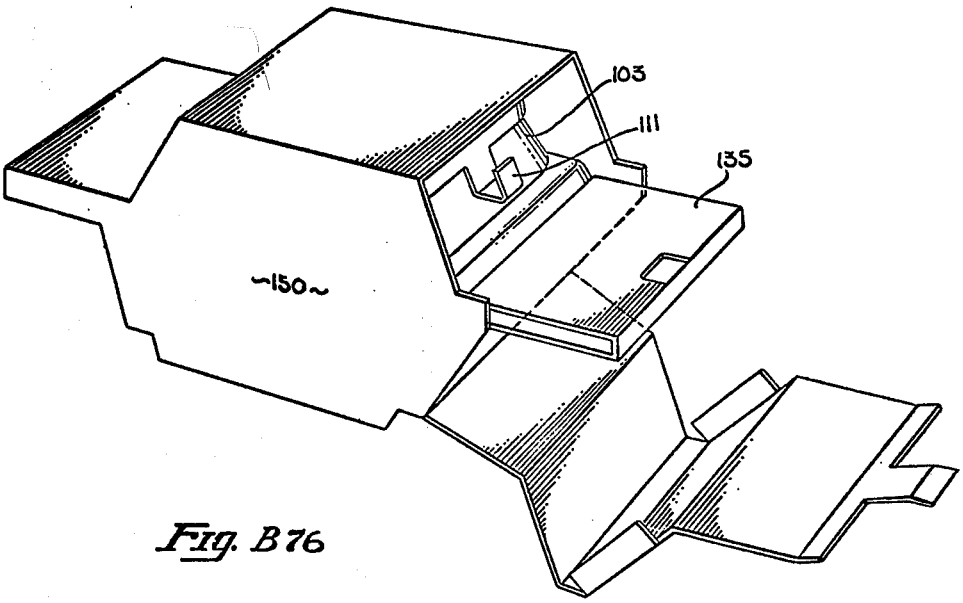
Fig. B 76

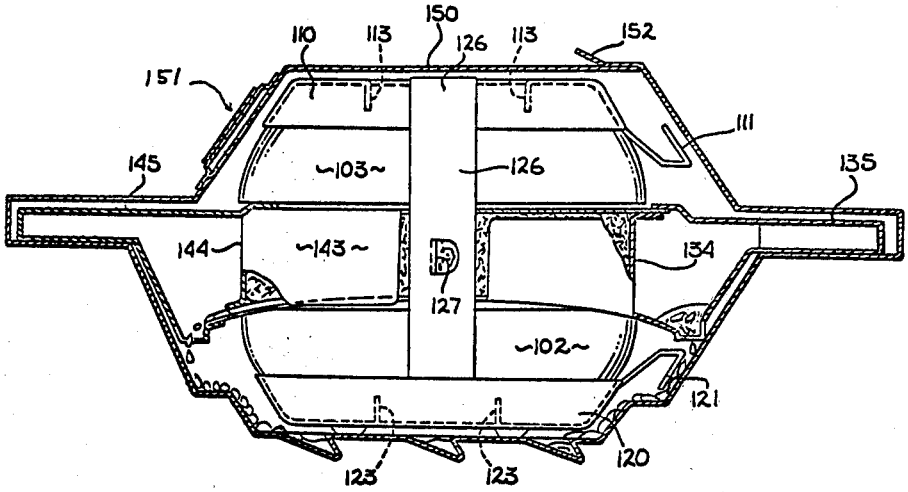
Fig. C 77
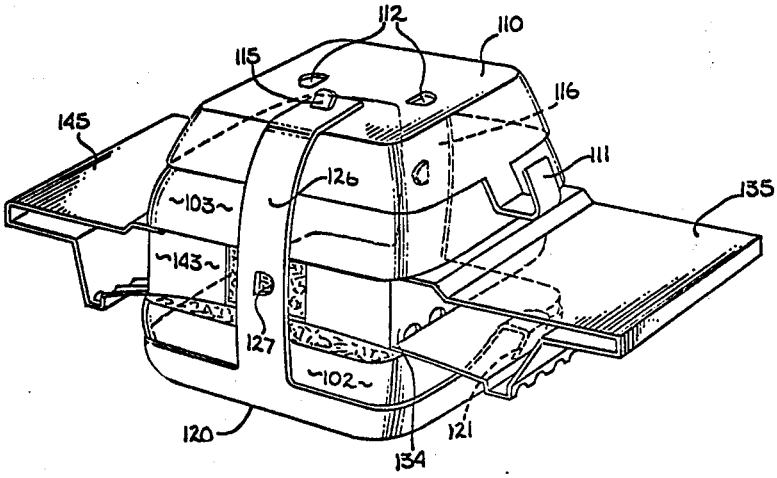
Fig. D 78

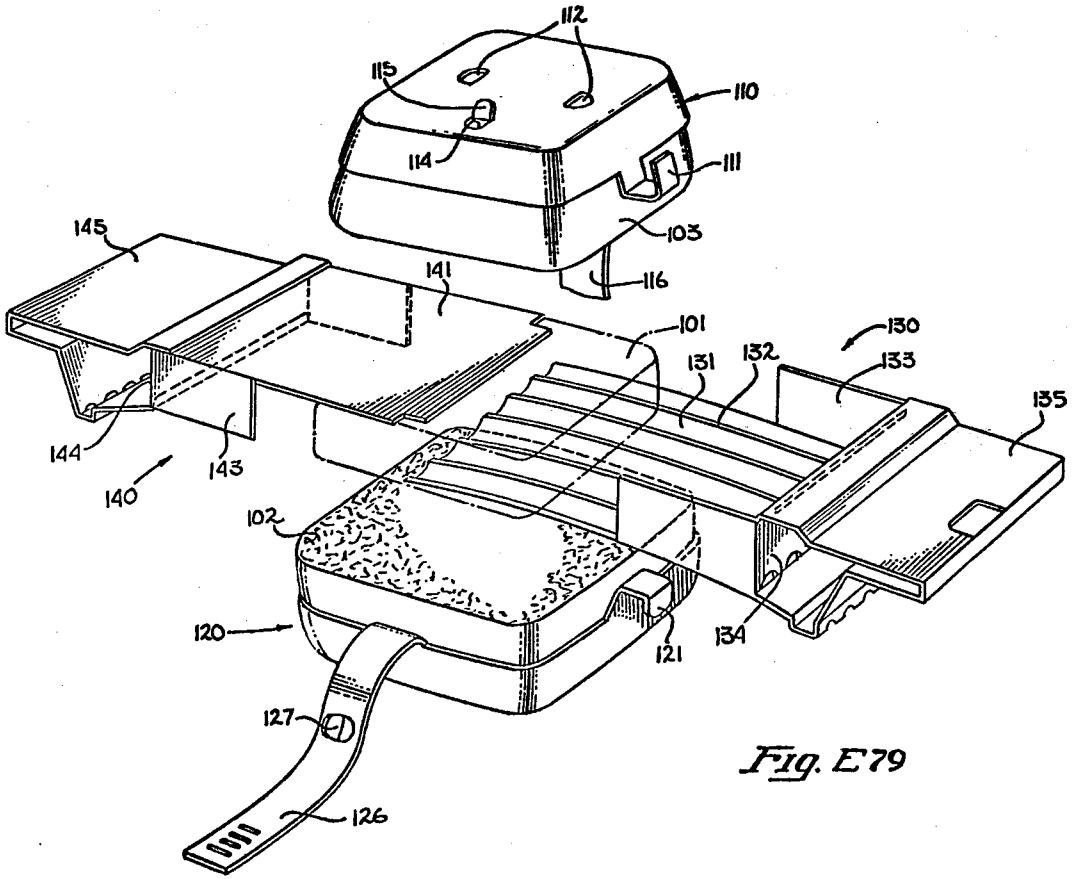
Fig. E79

FIG. 93.
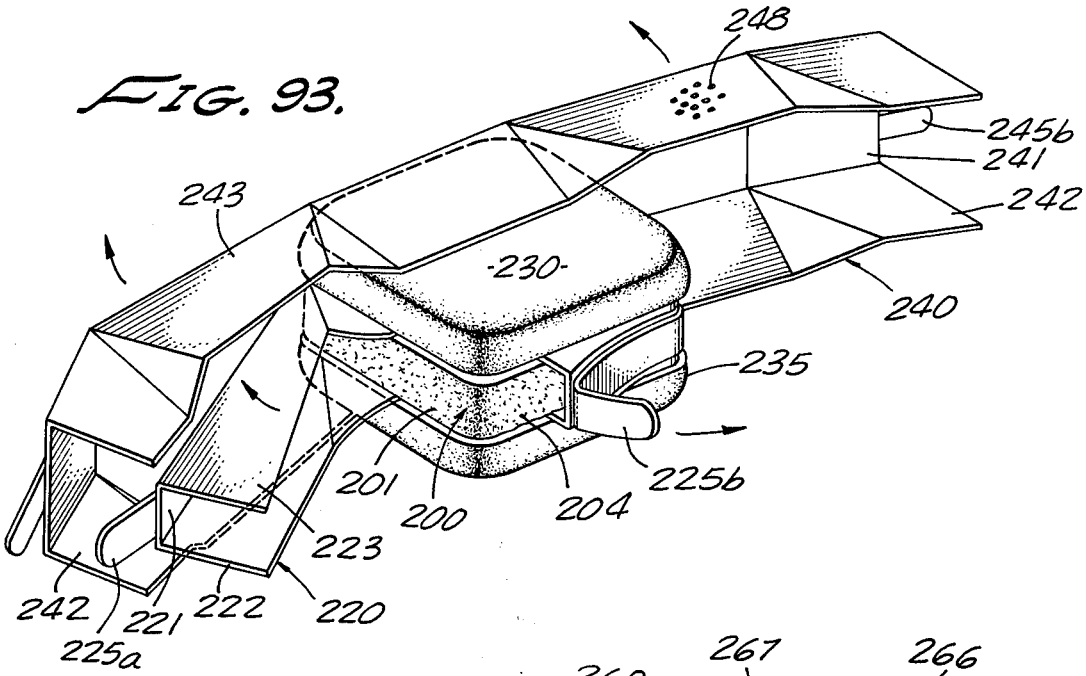
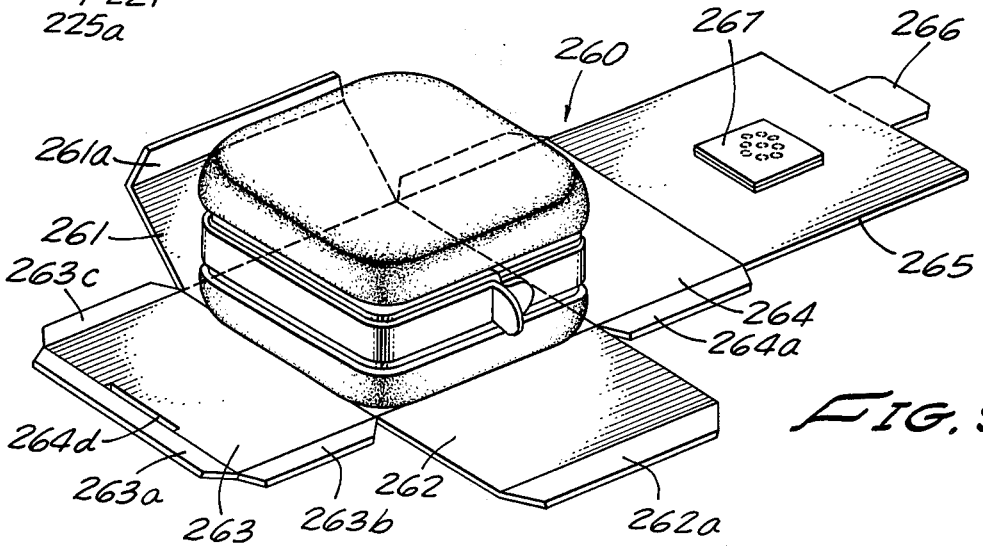
FIG. 94
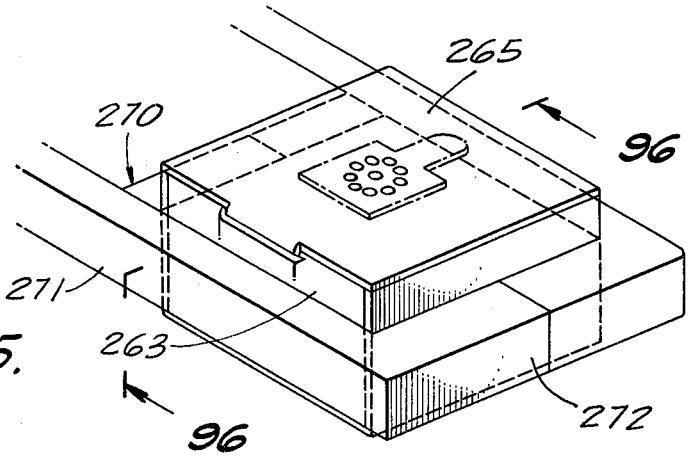
FIG. 95.

PACKAGED MEAT SANDWICH

RELATED APPLICATION

This application is a continuation-in-part of my prior copending application Ser. No. 209,738, filed Dec. 20, 1971, and subsequently abandoned.

BACKGROUND OF THE INVENTION

Health and sanitary regulations have heretofore made it necessary that hamburgers, hot dogs, and the like be cooked at a fixed and immobile establishment such as the traditional restaurant. Customers desiring only a hamburger sandwich for lunch, therefore, must travel to the restaurant in order to obtain it.

The object and purpose of the present invention is to provide food products of this kind which may be cooked and served much nearer to the point of consumption. More specifically, the object and purpose of the present invention is to provide hamburger sandwiches, hot dogs, and the like, which are so packaged that they can conveniently and legally be cooked in the package, at a highly portable facility, such as a catering truck, and then immediately served to the customer for the purpose of eating.

SUMMARY OF THE INVENTION

The present invention provides a prepared meat product which is prepared and packaged in such a manner that it may be shipped and cooked in the same package, and the cooking thereof is highly portable type of stove or oven will still comply with health and sanitary requirements. Further, according to the present invention the package is so arranged that the cooked food product may be quickly and conveniently removed from the package for purpose of serving the same.

According to one feature of the invention the package includes a filtered vent to permit the escape of cooking gases; the filtering of the gases in turn makes it possible to utilize a highly portable type of stove or oven, while still meeting the health and sanitary regulations.

According to another feature of the invention the package includes a meat product holder which is removable from the remainder of the package, so that a meat product may be cooked in the package and then by use of the holder may be quickly and easily removed for the purpose of serving.

According to still another feature of the invention the package is provided with a meat product compartment, and with separate compartments for one or more pieces of bread which are to be eaten with the meat product, the package being so arranged that heat may be applied at a faster rate to the meat product so that the meat product will cook more rapidly than the bread.

According to still a further feature of the invention, where a meat product and a piece of bread to be eaten with it are included in the same package, the interior of the package is so arranged that cooking gases generated from the meat product are utilized in part to moisten and warm the bread, prior to their escape through a vent means into the atmosphere.

According to another form of the invention a meat patty is placed within an inner wrapper which is then placed between two bun halves and covered by an outer wrapper, and energy for cooking the meat patty is then transmitted through both wrappers.

DRAWING SUMMARY

FIGS. 1 to 11, inclusive, comprising drawings sheets 1 to 4, inclusive, illustrate a first embodiment of the invention, namely, a disposable pan-and-lid type package, with vented lid, for transporting, cooking, and serving a meat patty;

FIGS. 12 to 15, inclusive, on drawing sheets 5 and 6, illustrate a second embodiment of the invention, having vent means in the circumferential connection between lid and pan;

FIGS. 16 to 19, inclusive, on drawing sheets 6 and 7, illustrate respectively different forms of meat patty which may be packaged in the package of FIGS. 1 to 11, inclusive, and supported upon the same type of meat holder;

FIGS. 20 and 21 on drawing sheet 7 illustrate a third embodiment of the invention, namely, a packaged meat product, where the lid has a ring which supports a flange on the meat patty;

FIGS. 22 to 27, inclusive, comprising drawing sheets 8 and 9, illustrate a fourth embodiment of the invention, namely, a disposable envelope type package for transporting, cooking, and serving a meat patty;

FIGS. 28 to 34, inclusive, comprising drawing sheets 10 to 12, inclusive, illustrate a fifth embodiment of the invention, namely, an inverted pan-and-lid type package for transporting, cooking, and serving a meat patty;

FIGS. 35, 36, and 37 comprising drawing sheet 13 illustrate a sixth embodiment of the invention, namely, a pan-and-lid type of package having a handle and vent means in the handle;

FIGS. 38, 39, and 40 comprising drawing sheet 14 illustrate a seventh embodiment of the invention;

FIGS. 41 and 42 comprising drawing sheet 15 illustrate an eighth embodiment of the invention;

FIGS. 43, 44, and 45 comprising drawing sheet 16 illustrate a ninth embodiment of the invention;

FIGS. 46, 47, and 48 comprising drawing sheet 17 illustrate a tenth embodiment of the invention;

FIGS. 49 and 50 comprising drawing sheet 18 illustrate an eleventh embodiment of the invention, including a two-part meat holder;

FIGS. 51 and 52 comprising drawing sheet 19 illustrate a twelfth embodiment of the invention;

FIGS. 53, 54, and 55 comprising drawing sheet 20 illustrate a thirteenth embodiment of the invention;

FIGS. 56 to 60, inclusive, comprising drawing sheets 21 and 22 illustrate a fourteenth embodiment of the invention;

FIGS. 61 and 62 comprising drawing sheet 23 illustrate a fifteenth embodiment of the invention;

FIGS. 63 and 64 comprising drawing sheet 24 illustrate a sixteenth embodiment of the invention in which a meat patty and half a bun are packaged together;

FIGS. 65 to 68, inclusive, comprising drawing sheets 25 and 26 illustrate a seventeenth embodiment of the invention, in which a meat patty and two half buns are packaged;

FIGS. 69 to 74, inclusive, comprising drawing sheets 27 and 28 illustrate an eighteenth embodiment of the invention, in which a weiner and two half weiner buns are packaged together;

FIGS. 75 to 79, inclusive, comprising drawing sheets 29 to 31, inclusive, illustrate a nineteeth embodiment of the invention, in which a meat patty and two half buns are packaged together in a sandwich configuration;

FIGS. 80 to 82, inclusive, on drawing sheet 32 illustrate a modified form of the invention in which the bottom wall of the pan forms a grease trap;

FIGS. 83 through 85 show alternate methods of fastening the lid and pan together;

FIGS. 86 through 93, inclusive, illustrate a twentieth embodiment of the invention in which the meat patty is placed within an inner wrapper, the wrapped meat patty is placed between a pair of bun halves which are then covered with an outer wrapper, and energy for cooking the meat patty is then transmitted through both the outer and inner wrappers;

FIGS. 94 through 96 show a modified form of the outer wrapper of the twentieth embodiment.

FIRST EMBODIMENT

(FIGS. 1-11 AND 16-19)

Figure 5:
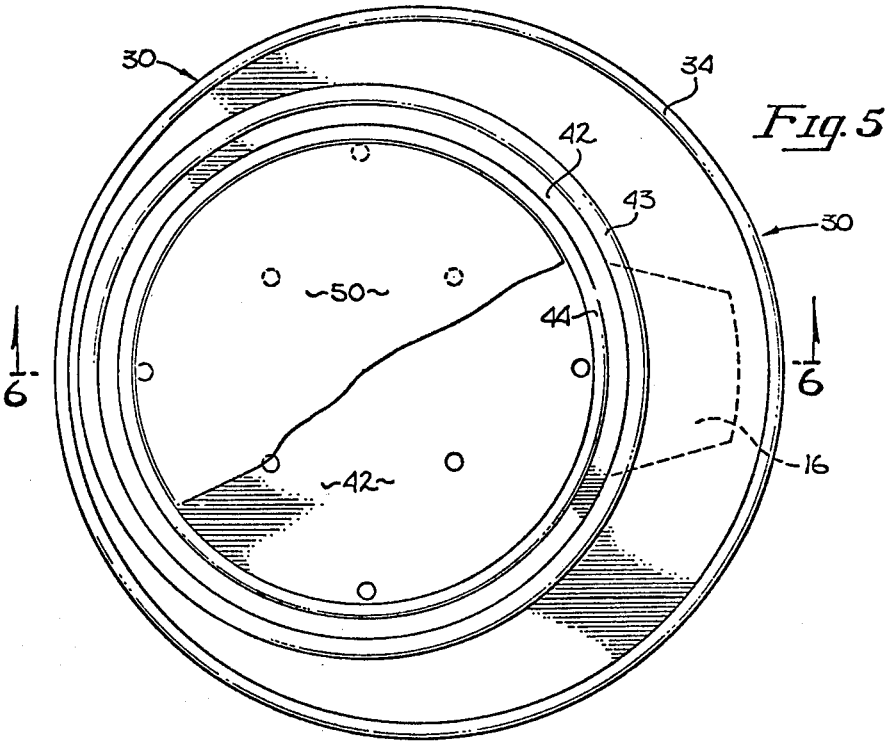
Figure 6:
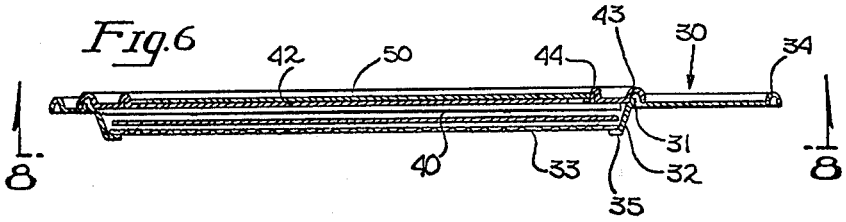
Figure 7:
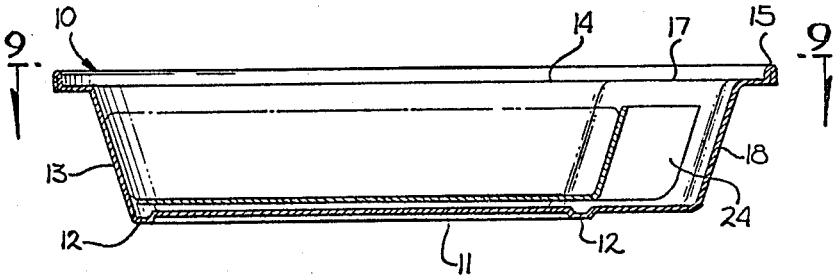
Figure 8:
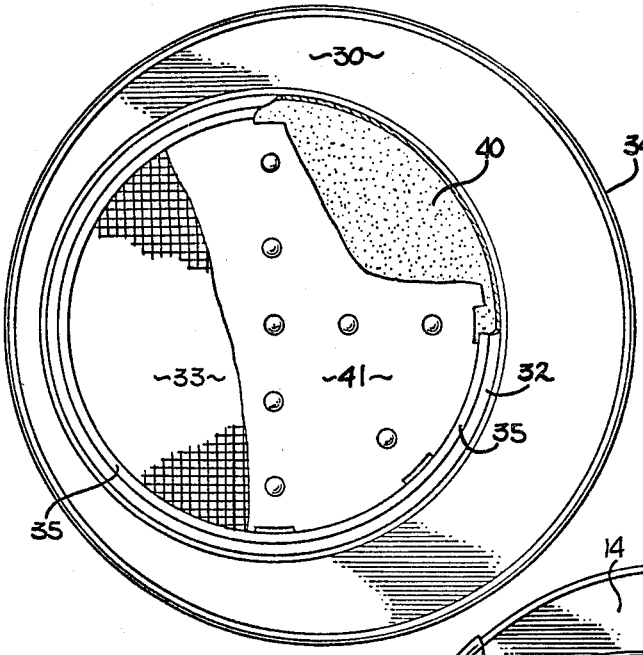
Figure 9:
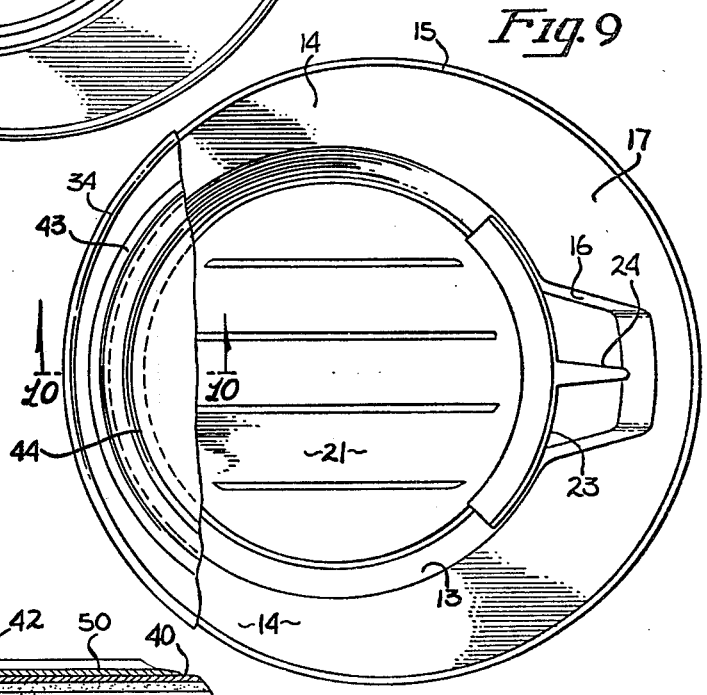
Figure 10:
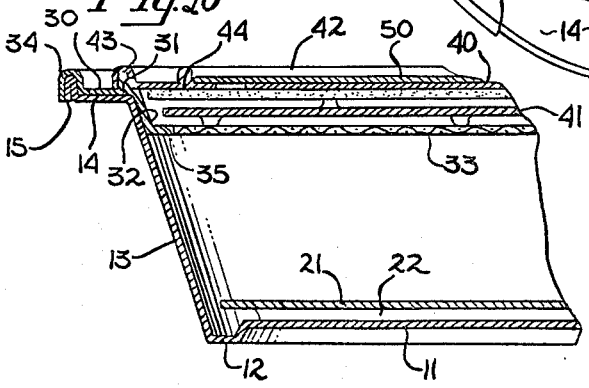

A brief summary of FIGS. 1-11, inclusive, is as follows:

FIG. 1 is a perspective view of a fully assembled package;

FIG. 2 is an elevation view showing three of the fully assembled packages when stacked together in a vertical stack;

FIG. 3 is an elevation view, partially in cross-section, showing two of the lid assemblies in a stacked and partially nesting relationship;

FIG. 4 is an elevation view, partially in cross-section, showing four of the empty containers nested together;

FIG. 5 is a top plan view of the container of FIG. 1;

FIG. 6 is a cross-sectional, elevational view of the lid assembly taken on the line 6—6 of FIG. 5;

FIG. 7 is a cross-sectional, elevational view of the container taken on the line 6—6 of FIG. 5;

FIG. 8 is a bottom plan view, partially cut away, of the lid assembly, taken on the line 8—8 of FIG. 6;

FIG. 9 is a top plan view, partially cut away, of the empty container, taken on the line 9—9 of FIG. 7;

FIG. 10 is a fragmentary cross-sectional, elevational view taken on the line 10—10 of FIG. 9; and FIG. 11 is an exploded perspective view of the entire package.

The package here illustrated is a pan-and-lid type of package, and its construction is most easily understood by reference to FIG. 11. As shown in FIG. 11 the package includes a container or pan 10 which is of a generally circular configuration, and is open at the top. A meat holder 20 is provided as a separate part, and is of such size and configuration as to fit down into the container or pan 10, but in rather loose relationship so that it can be removed. As later shown in FIGS. 16 to 19, inclusive, the hamburger patty or other meat product is positioned directly upon and supported by the meat holder 20. A lid 30 is also provided, which is of such size and configuration as to close the top of the container 10. Vent means, to permit the escape of cooking gases, are provided in the lid 30.

The construction of the vent is as follows. A central portion of the lid 30 is bounded by an upwardly disposed circular ridge 31. Within the ridge 31 the wall of the lid is sloped downwardly at 32 to form a short circumferential horizontal flange 35. A circular screen 33 is supported within the flange (see FIG. 6). A circular baffle plate 41 is supported upon the screen 33. A circular filter disc 40 is supported upon baffle plate 41. A circular cover plate 42 has a circumferential ridge which fits over and engages the ridge 31, so that in the assembled condition of the package the baffle plate 41 and filter disc 40 are held in place between the screen 33 and cover plate 42 (see FIG. 6). The outer ridge of cover plate 42 is designated as 43. A flexible cover sheet 50 covers the top surface of the cover plate 42.

More specifically, the screen 33 permits a free upward flow of cooking gases throughout its entire area (see FIG. 8). Baffle plate 41 is imperforate in its central portion, but has a number of dimples formed in its surface, some of which project downwardly and some of which project upwardly, these dimples serving to provide a vertical space or separation between the baffle plate 40 and the screen 33 as well as between the baffle plate 41 and the filter disc 40. Around its periphery the baffle plate 41 has a number of notches 45. The cooking gases cannot flow directly upward through the baffle plate, but must flow laterally outward around the peripheral edge of the baffle plate in order to reach the filter disc 40. Cover plate 42 has a number of openings 46 spaced about its surface. The cooking gases therefore flow radially inwardly from the peripheral edge of baffle plate 41, then up through the filter disc 40, and escape through the openings 46 of cover plate 42. With this venting arrangement not only is the entry of foreign materials into the interior of the package prevented, but much of the cooking gases and vaporized grease are trapped by the filter disc 40 and baffle plate 41, and thereby prevented from escaping into the surrounding atmosphere.

Health and sanitary regulations for restaurants have among their objects to prevent fire hazards and to prevent the undue accumulation of grease which can provide a place for bacteria to accumulate as well as constituting a fire hazard. In accordance with the object of the present invention the package for the meat product is constructed in such a way that cooking gases can be generated from the meat product and carried away, but their escape into the surrounding atmosphere will be controlled and minimized. Hence, the filter and baffle arrangement as illustrated in this first embodiment of the invention is significant as a means of drawing cooking gases and vaporized grease away from the meat product being cooked, but yet trapping them to a large extent so that they are not discharged into the surroundings.

The cover sheet 50 is flexible in nature and preferably provided with adhesive material on its under side. Cover sheet 50 remains in place while the package is being shipped, but when the meat product is to be cooked the cover sheet 50 is peeled off. Removal of cover sheet 50 exposes the openings 46 as previously described.

In the package as shwon in FIGS. 1 to 11, inclusive, the cover plate 42 in addition to the outer circumferential ridge 43 also has an inner circumferential ridge 44. All of the openings 46 are made within the confines of the inner ridge 44, and cover sheet 50 covers only the area within the ridge 44. It would be possible to use a different type of construction in which the inner ridge 44 is omitted and the flexible cover sheet 50 is extended all the way across within the outer ridge 43.

The container or pan 10 has a flat circular bottom wall 11, as best seen in FIGS. 7 and 10. At the periphery of bottom wall 11 is a downwardly depending ridge 12, flat on its under side so as to provide a solid base or footing for the container. Side wall 13 extends upward from the footing 12 and is flared outwardly at an angle of several degrees from the vertical. At the upper extremity of side wall 13 a horizontally outwardly extending flange 14 is formed, and on the peripheral edge of flange 14 is an upwardly extending circumferential ridge 15.

As best seen in FIG. 11 the side wall 13 forms essentially a complete circle but is of considerably smaller diameter than the circumferential ridge 15 and is eccentrically arranged relative thereto. The container 10 is elongated at one end where the horizontal flange 17 represents a widened portion of the flange 14. In that elongated end of the container a recess 16 is formed, which is an extension of the main compartment of the container. The purpose of recess 16 is to receive the handle portion of the meat holder 20. In recess 16 the container side wall is designated as 18.

As best seen in FIG. 11, meat holder 20 includes a flat, circular tray 21 having a plurality of parallel ridges 22 formed therein. Ridges 22 extend downwardly from the tray and effectively provide legs for holding the tray 21 some distance above the flat bottom wall 11 of the container (see FIGS. 7 and 10). The meat holder 20 also includes an arcuate backing member 23 to which is attached to the tray 21 along one portion of its circumferential edge. Backing member 23 rises somewhat vertically from the tray 21 but is also flared outwardly, at about the same angle as the side wall 13 of the container 10 is flared outwardly. At the longitudinal center of backing plate 23 (measured circumferentially of tray 21) a handle 24 is attached. Handle 24 projects outward radially, relative to the center of tray 21. Tray 21 is of such diameter as to be comfortably received within the confines of the lower portion of the side wall 13 of container 10. Handle 24 is of such size and configuration as to fit loosely within the recess 16. Therefore, when the meat product has been cooked, and the lid 30 has been removed, it is then possible to quickly and conveniently remove the cooked meat product from the container 10 simply by grasping handle 24 between thumb and finger and lifting the meat holder 20 vertically upward and hence out of the container 10. The width of recess 16 is much greater than the thickness of handle 24, hence some space is available for insertion of both a thumb and a finger into the upper portion of recess 16.

The lid 30 has an outer circumferential ridge 34 which projects upwardly, and the inner ridge 31 is eccentrically located relative to the outer ridge 34. Ridge 34 of cover plate 30 is of exactly the same diameter as ridge 15 of container 10. Therefore, when meat holder 20 has been placed inside container 10, and the meat product placed on the tray 21, the lid 30 may then be placed over container 10 and fastened by crimping the interengaging circumferential ridges 34 and 15 tightly together. The screen 33, baffle plate 41, filter disc 40, cover plate 42, and flexible cover sheet 50 would ordinarily be assembled to the lid 30 before the lid 30 is attached to container 10, however, the reverse procedure may be followed if desired.

Referring to FIG. 3, it will be seen that the lid assemblies may be stacked in a vertical stack, in an interengaging relationship which will provide stability for the stack. Specifically, the circumferential flange 35 formed on said wall 32 of the lid 30 fits between the outer ridge 43 and inner ridge 44 of the cover plate 42 of the next lower lid assembly.

Referring to FIG. 4, it will be seen that the empty containers 10 may be nested together in order to conserve storage space and at the same time provide a very secure and stable stacking relationship.

An advantage of utilizing the inner ridge 44 of the cover plate 42 may be ascertained from FIG. 10 of the drawing. It is there seen that ridge 44 is located slightly outside the exterior circumferential edge of the bottom footing 12 of the container 10. Therefore, when a number of fully assembled packages are stacked together, as shown in FIG. 2, the bottom footing of one package will fit within the ridge 44 of the next lower package, which will restrain its lateral movement, and in this manner create a stable stacking relationship.

FIGS. 16 to 19, inclusive, illustrate how a meat product may be packed inside the package of FIGS. 1 to 11, inclusive, and utilizing the same removable meat holder. As shown in FIG. 16 a meat patty 70 may be formed with a quantity of cooking sauce 71 embedded in the interior of the meat patty. This is preferably accomplished by forming the cooking sauce to a desired configuration, such as a flat, circular layer, and then freezing it, and subsequently forming the ground meat around it to complete the meat patty having a desired size and configuration.

As shown in FIG. 17 a meat patty 72 is made in essentially a flat circular configuration, but having an upstanding flange portion 73 extending all the way around its peripheral edge. Inside the flange portion 73 of the meat patty a ring of cheese 74 may be placed. When the meat product is cooked the cheese 74 will melt rather rapidly, flowing down to a level configuration in which it extends across the entire upper surface of the meat patty 72, within the confines of the peripheral flange 73. Because of the peripheral flange 73 the thickness of the meat patty 72 in the center of the package is diminished, and a complete and thorough cooking of the meat patty may therefore be achieved more effectively than otherwise.

FIG. 18 illustrates a meat patty 76 which is of flat circular configuration and an even thickness, but has a plurality of spaced recesses in its upper surface in which separate individual segments 77 of either cheese or cooking sauce are inserted. When the product is cooked the cheese or cooking sauce will melt rather readily, and because of its higher liquidity will transmit heat more effectively between the intervening portions of the meat patty than would otherwise be the case. Here again the cooking of the meat patty is accomplished more effectively that if it were of uniform thickness throughout, because if it were of uniform thickness throughout, the exact center of the meat patty would not become cooked as fully as might be desired, except perhaps by overcooking the peripheral portions of the meat patty.

Figure 19:
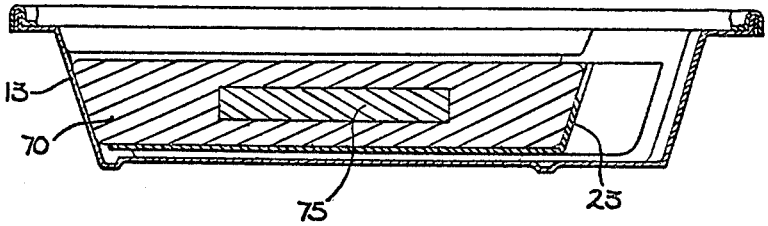

FIG. 19 illustrates a meat patty product which is very similar to that shown in FIG. 16, except that the sauce 75 as shown in FIG. 19 is confined much more nearly to the central portion of the meat patty than is the case in FIG. 16.

SECOND EMBODIMENT

(FIGS. 12 TO 15, INCLUSIVE)

Figure 12:
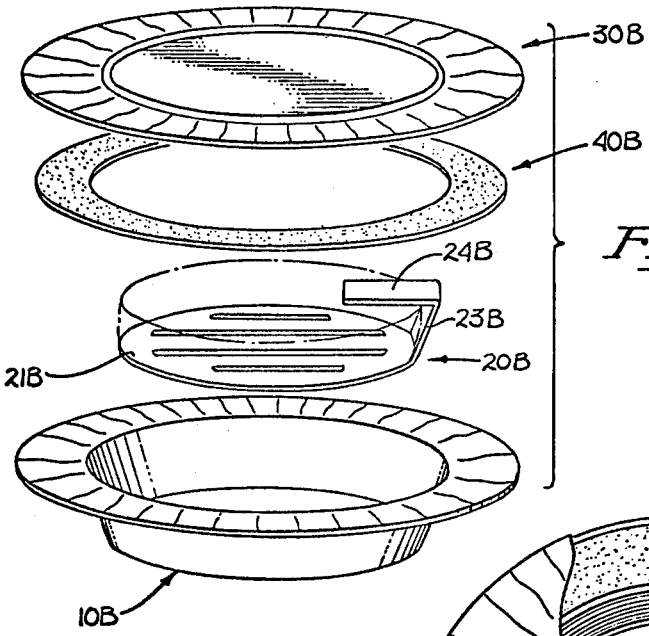
Figure 13:
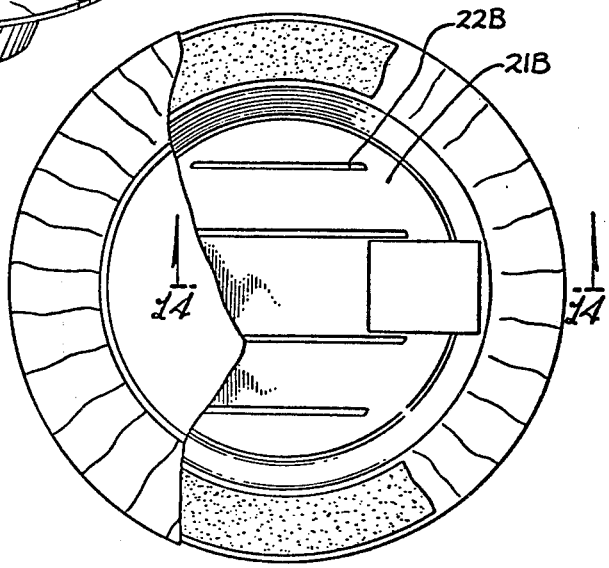
Figure 14:
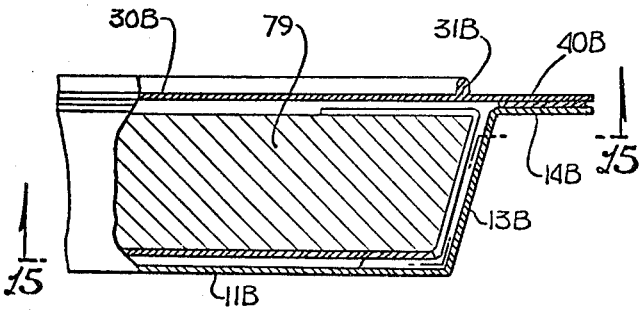

Reference is now made to FIGS. 12 to 15, inclusive, which illustrate a second embodiment of the invention. More specifically:

FIG. 12 is an exploded perspective view showing the four component parts of the package;

FIG. 13 is a top plan view, partially cut away, of the assembled package but without the lid;

FIG. 14 is a cross-sectional, elevational view of the assembled package, taken on the line 14—14 of FIG. 13, and showing a meat product contained therein;

FIG. 15 is a cross-sectional view of the package taken on the line 15—15 of FIG. 14.

Referring now to the drawings, and particularly to FIG. 12, it will be seen that the complete package includes an open-topped generally circular container 10B; a meat holder 20B adapted to be received within the container; a lid 30B adapted to close the container; and a filter ring 40B. The container 10B has a flat circular bottom wall 11B, and from the peripheral edge of the bottom wall there rises upwardly a side wall 13B, which is also flared somewhat outwardly. At the top of the side wall 13B there is a horizontally outwardly extending flange 14B. The lid 30B is essentially a flat circular member, but has formed therein a single circular ridge 31B which extends upwardly from the plane of the lid member. The outer circumferential edge of lid 30B is coextensive with the outer circumferential edge of flange 14B of the container (see FIG. 14). Filter ring 40B is of such a size as to fit between the continer flange 14B and the peripheral portion of the lid 30B (see FIG. 14) and acts as a spacer therebetween. The circumferential edges of the package are held together by any suitable means, such as for example, strips of adhesive tape, not specifically shown.

The radius of the ridge 31B is somewhat greater than the radius of the container bottom wall 11B, and somewhat smaller than the inner radius of the container flange 14B, as best seen in FIG. 14. It therefore follows that a number of the packages may be stacked together in a vertical stack, and the second and each higher package in the stack will have the lower portion of its side wall 13B receive within the ridge 31B of the next lower container, being thereby restrained against sidewise movement.

Meat holder 20B includes a flat circular tray 21B having a plurality of downwardly extending ridges 22B serving as its feet, and which may be identical to the tray 21 and ridges 22 of the first embodiment. A backing member 23B and handle member 24B are formed as a continuous L-shaped strap. The lower end of backing member 23B is attached to and continuous with a portion of the peripheral edge of circular tray 21B. Backing member 23B is inclined or flared outwardly at substantially the same angle as side wall 13B of the container (see FIG. 14). Handle 24B extends toward the center of the tray 21B and its plane is precisely parallel to the plane of the tray. The meat holder is therefore adapted to receive a circular meat patty 79 whose outer peripheral wall is flared outwardly at about the same angle as the container wall 13B (FIG. 14).

The meat patty is cooked by resting the bottom wall 11B of the package directly on a heating element, or otherwise directly exposing it to heat. As the meat patty cooks the grease runs over the peripheral edge of tray 21B and flows underneath the tray and occupies the spaces between the ridges or feet 22B. Cooking gases fill the relatively small space between the top of the meat patty and lid 30B, and move radially outwardly and pass in a horizontal direction through the filter ring 40B. Vaporized grease also precipitates to some extent upon the inner surface of the upper portion of container side wall 13B. When cooking is completed the lid 30B is removed. Handle 24B is then grasped and bent upward, and the opposite side of container 10B is then tilted up and the handle is pulled out in order to slide the meat holder 20B out of the container.

THIRD EMBODIMENT

(FIGS. 20 AND 21)

Figure 20:
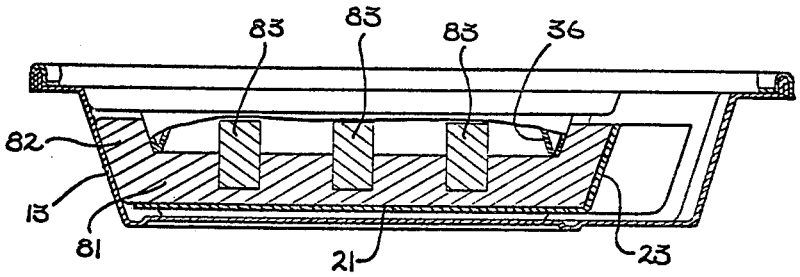
Figure 21:
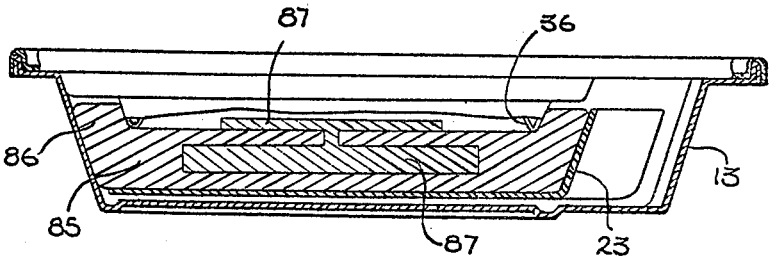

Reference is now made to FIGS. 20 and 21 illustrating a third embodiment of the invention.

Figures 61, 62:
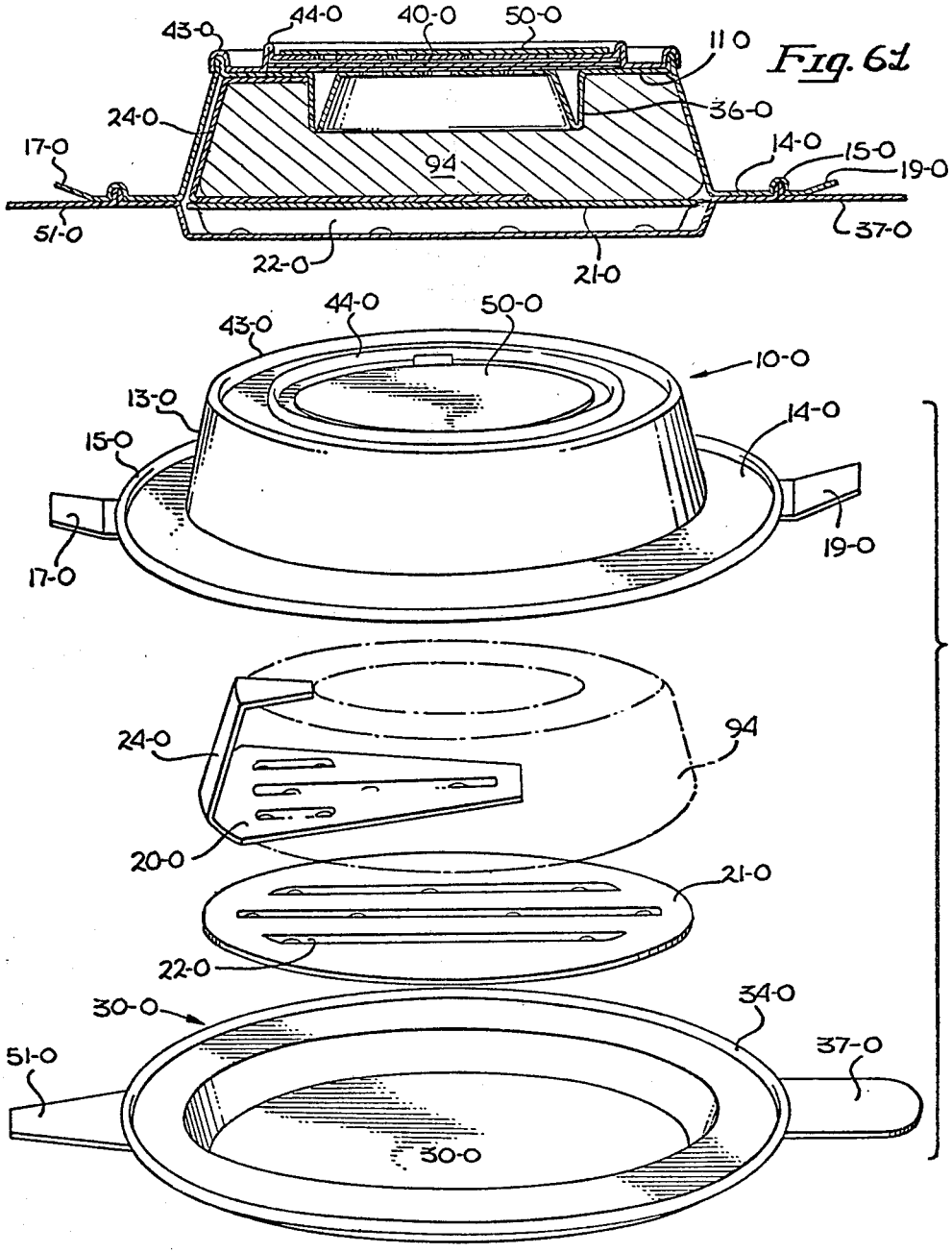

In FIGS. 20 and 21 the package construction is the same as has previously been illustrated in FIGS. 1 to 11, inclusive, but with one additional feature included. The lid flange 35 has greater radial width, and from its inner circumferential edge a ring 36 depends downwardly into the package. The material of the ring 36 is bent downwardly and folded back up so that it has a V-shaped configuration. (A generally similar ring is shown in FIG. 61, in the fifteenth embodiment of the invention).

In FIG. 20 a meat patty 81 has a flat circular configuration, but with a peripheral flange 82 rising up from its outer circumferential edge. Throughout most of its circumference the sloping outer edge of the meat patty rests upon the side wall 13 of the container, and in a small portion of its circumference as shown on the right hand side of FIG. 20 it rests upon the backing member 23 of meat holder 20. The bottom of the meat patty rests upon the circular tray 21 of the meat holder. The peripheral flange 82 of the meat patty is therefore held between container side wall 13 and the lid ring 36 throughout most of the package, and in one portion is held between the lid ring 36 and the backing member 23.

Meat patty 81 has a number of recesses formed at spaced locations in its upper surface, and solid blocks 83 of cooking sauce, cheese, or the like are inserted into those recesses. The cooking action is very similar to that previously described in conjunction with FIG. 17; that is, the material 83 liquifies rather soon after application of heat and forms a level mass on the interior of the meat patty. The interior recesses in the meat patty minimize the thickness of the meat in the locations where cooking is most difficult, and as previously described in conjunction with FIG. 18, this configuration of the meat patty expedites the cooking of all of the meat on an even and consistent basis.

The same package construction is utilized in FIG. 21. Meat patty 85 is made of reduced thickness in its central portion and has an upstanding peripheral flange 86 which is held between the side wall of the container and the lid ring 36. The meat patty 85 if formed around a solid mass 87 of cooking sauce, cheese, or the like, which is preferably frozen before the meat patty is formed around it. The material 87 is in the form of a flat, circular piece which is inside the meat patty, a smaller flat circular piece which rests on the upper surface of the meat patty, and a portion of material interconnecting the two flat, circular patties at their centers. The result of this arrangement is that in the center of the meat patty 85 the meat itself consists of one relatively thin layer on the bottom and one relatively thin layer on the top. Because of the high liquidity and greater heat conductivity of the material 87, this configuration of the meat patty 85 expedites the quick cooking on a uniform basis of all of the meat.

FOURTH EMBODIMENT

(FIGS. 22 TO 27, INCLUSIVE)

Figure 25:
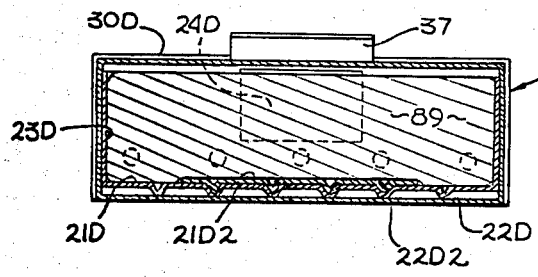
Figure 26:
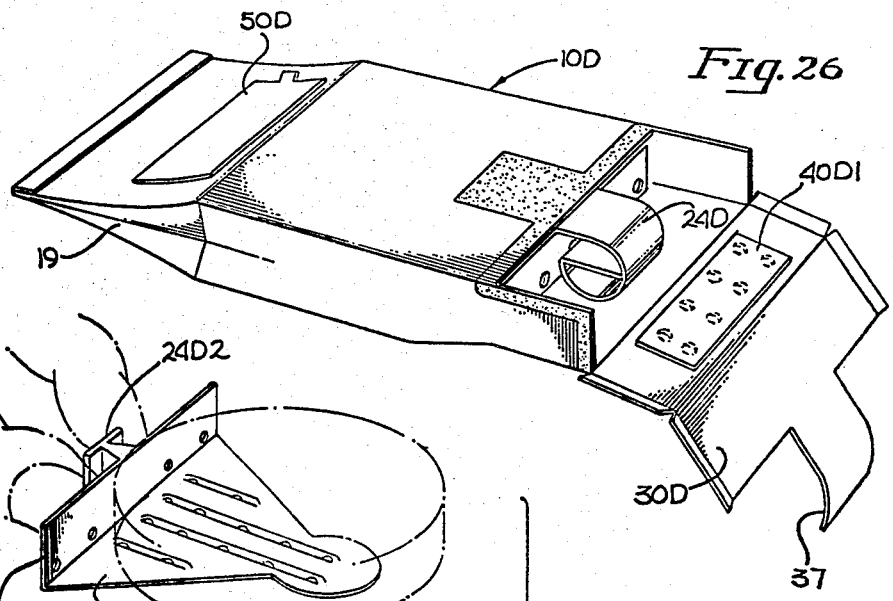
Figure 27:
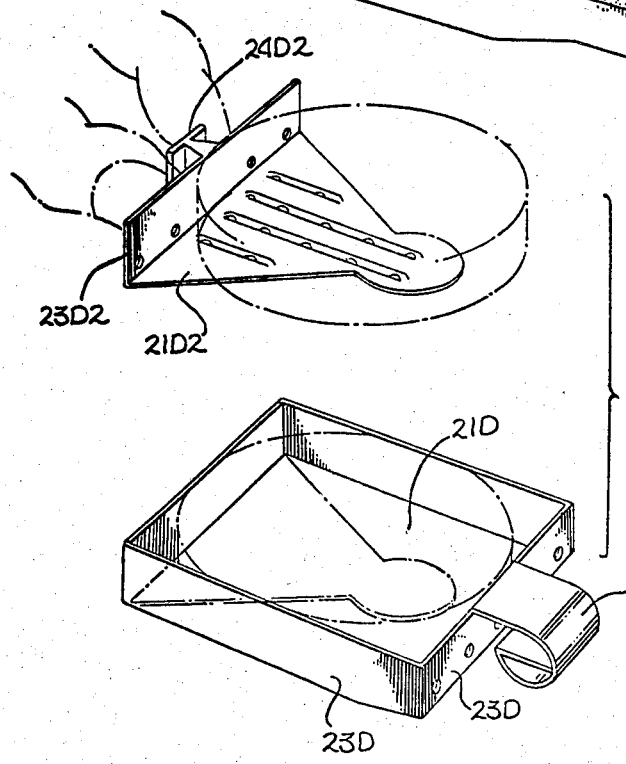

Reference is now made to FIGS. 22 to 27, inclusive, wherein more specifically:

FIG. 22 is a perspective view of an envelope type of package in accordance with the present invention;

FIG. 23 is a top plan view of the package of FIG. 22 with certain parts cut away;

FIG. 24 is a longitudinal cross-sectional view taken on the line 24—24 of FIG. 22;

FIG. 25 is a transverse cross-sectional view taken on the line 25—25 of FIG. 24;

FIG. 26 is a perspective view like FIG. 22, showing the lid end of the package after it has been opened; and FIG. 27 is an exploded perspective view of the two separate parts of the meat holder.

The envelope 10D is of generally rectangular configuration and has one end 19 where its walls are pinched together in order to provide a sealed end of the package. A folding lid 30D with pull tab closes the other end of the package.

On the envelope end 19 a plurality of vent holes 46D are provided, and are covered on the outside by means of a flexible removable cover sheet 50D. A filter strip 40D is attached to the inside surfaces of the vent holes 46D (FIG. 24).

Another similar vent is provided in the lid 30D. Vent holes 46D1 are provided in the lid (FIG. 24). A filter strip 40D1 covers the inside of these vent holes (FIGS. 24 and 26). A removable cover sheet 50D1 covers the outside of the vent holes (FIG. 24).

The meat holder includes both an upper part and a lower part (FIG. 27). The lower part of the holder has a generally rectangular tray 21D, and a backing member 23D which is attached to both sides and one end of the tray. A handle 24D is attached to the backing member at the end of the tray. Tray 21D has downwardly extending ridges 22D, serving as supporting feet.

The upper part of the meat holder includes a tray 21D2 which is generally triangular, and has a number of downwardly depending ridges 22D2 which correspond with and are adapted to engage into the ridges of the lower tray (see FIG. 25). The upper part of the holder also includes a backing member 23D2 and handle 24D2.

The operation is as follows: The two parts of the meat holder are put together to form a complete separate container into which the meat patty 89 is inserted. The meat holder and meat patty are placed inside the envelope which is then closed. Before cooking, cover sheets 50D and 50D1 are removed. After cooking the tab 37 is pulled to open the lid 30D. Handle 24D is then pulled to remove the entire meat holder in an endwise direction from the envelope. Handle 24D2 is then grasped in order to lift the meat patty and serve it from the upper part of the meat holder (as shown in FIG. 27).

FIFTH EMBODIMENT

(FIGS. 28 TO 34, INCLUSIVE)

Figure 28:
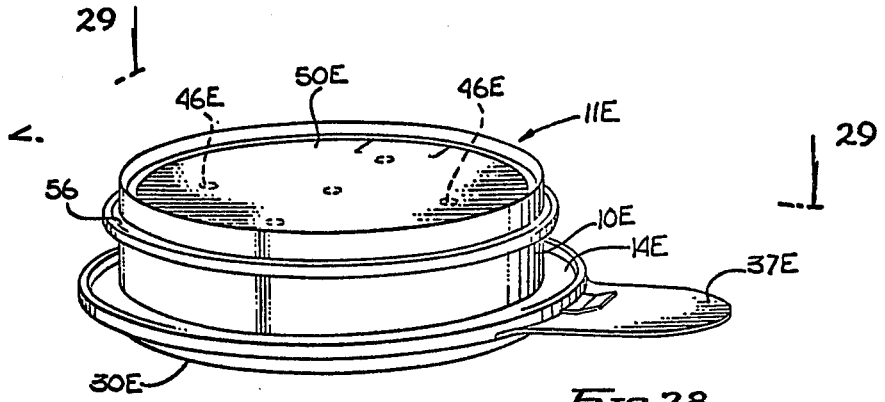
Figure 29:
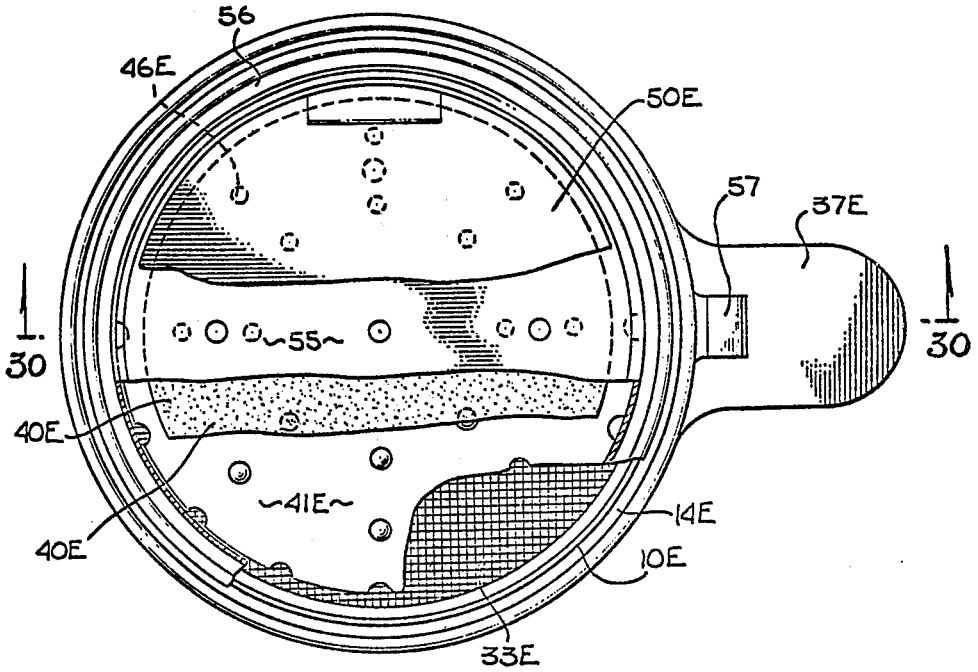
Figure 33:
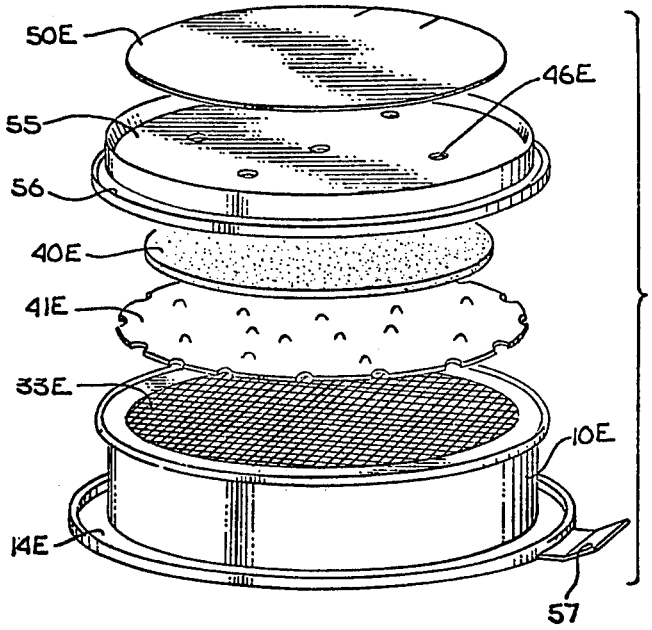
Figure 34:
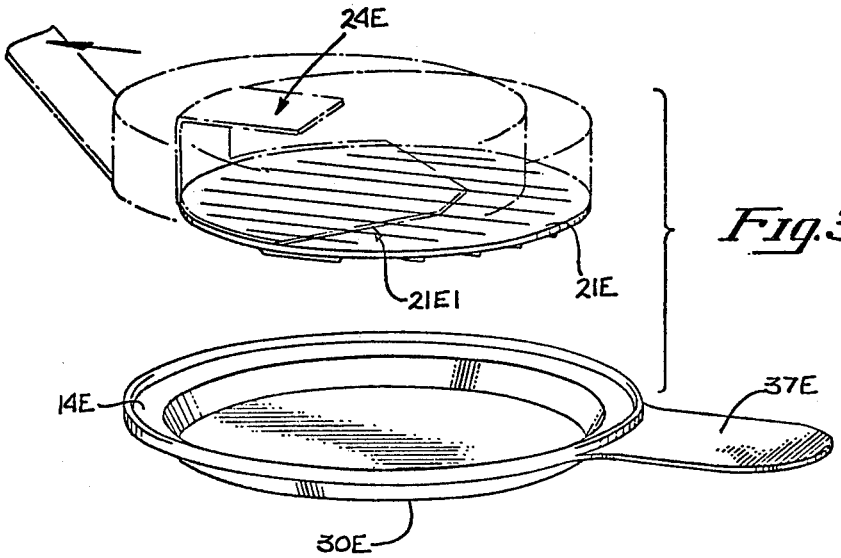

Reference is made to FIGS. 28 to 34, inclusive, wherein more specifically:

FIG. 28 is a perspective view of an inverted pan-and-lid type of package in accordance with the invention;

FIG. 29 is a top plan view of the package with portions cut away;

FIG. 30 is a cross-sectional elevational view taken on the line 30—30 of FIG. 29;

FIG. 31 is a transverse cross-sectional view taken on the line 31—31 of FIG. 30;

FIG. 32 is a horizontal cross-sectional view taken on the line 32—32 of FIG. 30;

FIG. 33 is an exploded perspective view of the upper parts of the package; and FIG. 34 is an exploded perspective view of the contents and bottom lid of the package.

Referring now to the drawings, container 10E is in the form of a hollow cylinder which is open at both ends, having a circumferential flange 14E at its lower end and a circumferential flange 14E1 at its upper end. A circular lid 30E is adapted to close the lower end of the container, and has a handle 37E.

A top assembly which is generally designated as 11E has numerous individual component parts, as best seen in FIG. 30. A top cap 55 is in the form of an inverted shallow cup, and has a horizontally projecting circumferential flange 56 which is crimped to the flange 14E1 of the container. A circular screen 33E has its peripheral edge grasped between the flanges 56, 14E1. A baffle plate 41E rests above the screen 33E. Vent holes 46E are formed in the top cap 55. A filter disc 40E is positioned below the vent holes 46E and supported by the upper set of dimples on the baffle plate. The vent holes 46E are covered by means of a removable cover sheet 50E.

The meat holder is formed in two parts (FIGS. 30, 31 and 34). The lower part of the meat holder is a circular tray 21E having downwardly depending ridges 22E which form feet. The upper part includes a tray 21E1 which has a truncated pie-shaped configuration (FIGS. 32 and 34). A backing member 23E extends upward from the curved edge of tray 21E1, and is bent over to provide a handle 24E which lies parallel to the two trays.

The meat patty 90 has a flat circular configuration. It rests upon the combination of the two trays 21E1, and handle 24E is folded over its upper surface. The meat patty and meat holder are placed in the bottom lid 30E and container 10E is placed over them and crimped to the bottom lid. Then the top cover assembly 11E is placed over the container and the flange edges 56 and 14E1 are crimped together with screen 33E sandwiched between them.

When the meat patty is to be cooked the cover sheet 50E is removed. During cooking the grease runs underneath the tray 21E while cooking gases are partially absorbed by the baffle arrangement in the lid assembly and partially escape through the vent holes 46E. When cooking is completed the tab 57 on the container 10E is raised in order to separate the container and the top cover assembly from the bottom lid 30E. Handle 24E is then bent over and pulled, and the meat patty is removed upon the upper tray 21E1.

The stacking arrangement of the packages is shown in FIG. 31 where an underneath package is represented by dotted lines 60.

Figure 35:
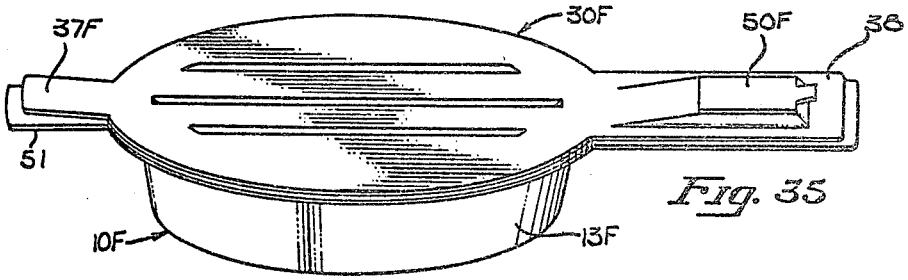
Figure 36:
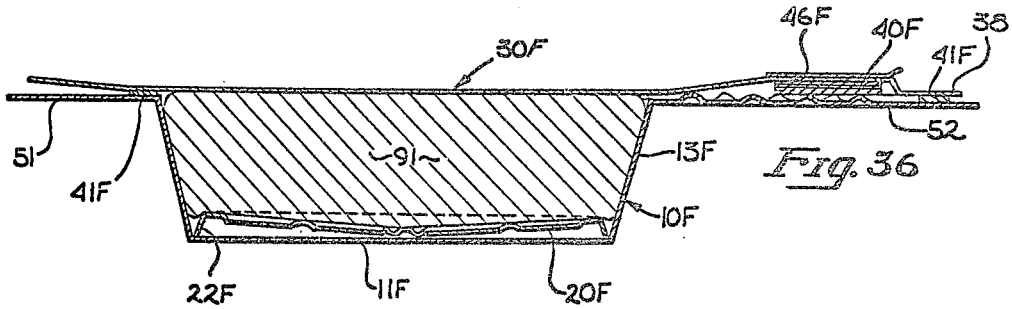
Figure 37:
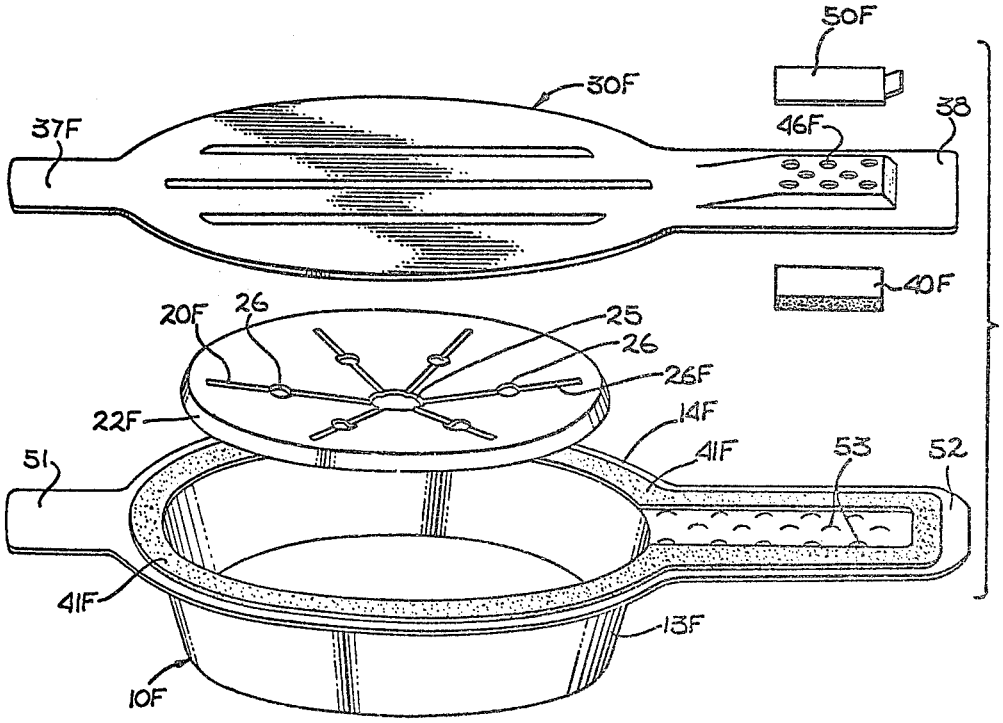

SIXTH EMBODIMENT (FIGS. 35 to 37, inclusive)

FIG. 35 is a perspective view of a pan-and-lid type of package having a handle, and vent means in the handle;

FIG. 36 is a longitudinal cross-sectional view of the package; and

FIG. 37 is an exploded perspective view of the package.

Referring now to the drawings, container 10F is a circular open-topped container having a flat circular bottom wall 11F and an outwardly flared side wall 13F. A circumferential flange 14F projects horizontally outwardly from the upper edge of side wall 13F. On one side of the container a short handle 51 projects outwardly from flange 14F, and on the other side a long handle 52 projects outwardly.

A meat holder 20F has the form of a circular plate whose outer circumferential edge is downwardly turned in a flange 22F. The center of the circular holder is depressed downwardly but by a less distance than the height of flange 22F, so that as clearly shown in FIG. 36 the center of the holder 20F is spaced some distance above bottom wall 11F of container 10F. The meat holder has a center hole 25 and a number of radially spaced holes 26 formed therein. Associated with each of these holes 26 there is a radially extending ridge 26F which projects downwardly from the meat holder, leaving a groove in the upper surface.

Meat holder 20F is disposed within the lower portion of container 10F where the flange 22F abuts against the lower extremity of side wall 13F, which prevents any further spreading of the flange and therefore holds the meat holder 20F in its raised position above the bottom wall 11F. Meat patty 91 (FIG. 36) is a flat circular meat patty which rests upon the meat holder 20F. During cooking of the meat patty, grease runs in a radial direction down the grooves 26F associated with holes 26. Grease flowing from the outer circumference of the meat patty is drained through the holes 26, while that flowing from the central part of the meat patty runs to the center of meat holder 20F and drains through the center hole 25. The grease drained from the meat during cooking is then retained in the space between bottom wall 11F and meat holder 20F.

A generally ring-shaped spacer 41F, best seen in FIG. 37, is placed upon the container 10F. Spacer 41F extends around the entire circumference of flange 14F, except that portion associated with handle 52. It also extends down both sides of handle 52 and across the remote end of the handle. A number of upwardly projecting dimples 53 are formed in the central portion of handle 52 (see FIG. 37).

A lid 30F has a flat circular configuration and is of sufficient diameter to extend over the pan flange 14F and cover the spacer member 41F. At one side the lid 30F also has a projecting tab 37F which projects above the short handle 51 of container 10F. On its other side the lid 30F has a vented handle 38. Handle 38 is essentially an elongated flat strip of material having a raised center portion, and has the same width as handle 52 of pan 10F but a slightly lesser length. In its raised central portion the handle 38 has vent holes 46F formed therein. In the assembled configuration of the package, a small rectangular filter pad 40F rests upon the dimples 53 of handle 52 and covers the under surfaces of the vent holes 46F in the lid handle 38. A small flexible cover sheet 50F, of rectangular configuration, is removably secured to the upper central surface of handle 38 for covering the upper side of the vent holes 46F. Before cooking the meat patty 91 the flexible cover sheet 50F is removed, exposing the vent holes 46F to atmosphere. As cooking proceeds the cooking gases generated from meat patty 91 flow radially outward through the hollow interior of the handle 52-38. More specifically, container handle 52 and lid handle 38 are spaced apart at the location of container flange 14F, because of the gap in the spacer member 41F as best seen in FIG. 37. Cooking gases therefore travel in a radially outward direction through the hollow interior of the handle. The cooking gases are partially retained by the filter pad 40F and partially escape to atmosphere through the vent holes 46F. When cooking is completed the tab 37F is used to pull the lid 30F away from the pan.

The holder 20F does not include a handle for use in removing the meat patty from the package. However, the meat patty may be removed by use of a fork or by use of tooth picks or simply by forcibly bending down one side of the pan and then sliding the meat patty out. It is advisable to maintain the gravitational orientation of pan 10F in order to retain the accumulated grease within the grease trap that is provided by bottom wall 11F and meat holder 20F.

Figure 38:
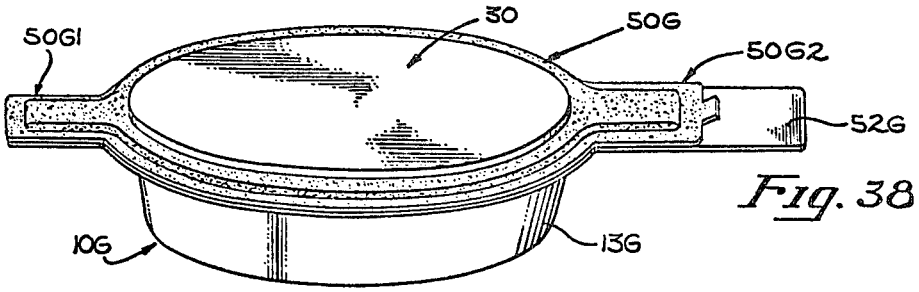
Figure 39:
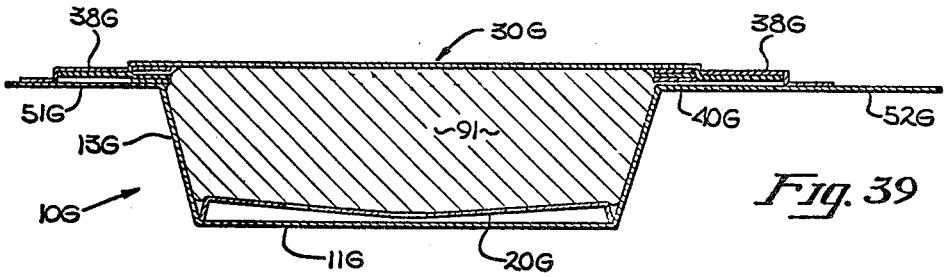
Figure 40:
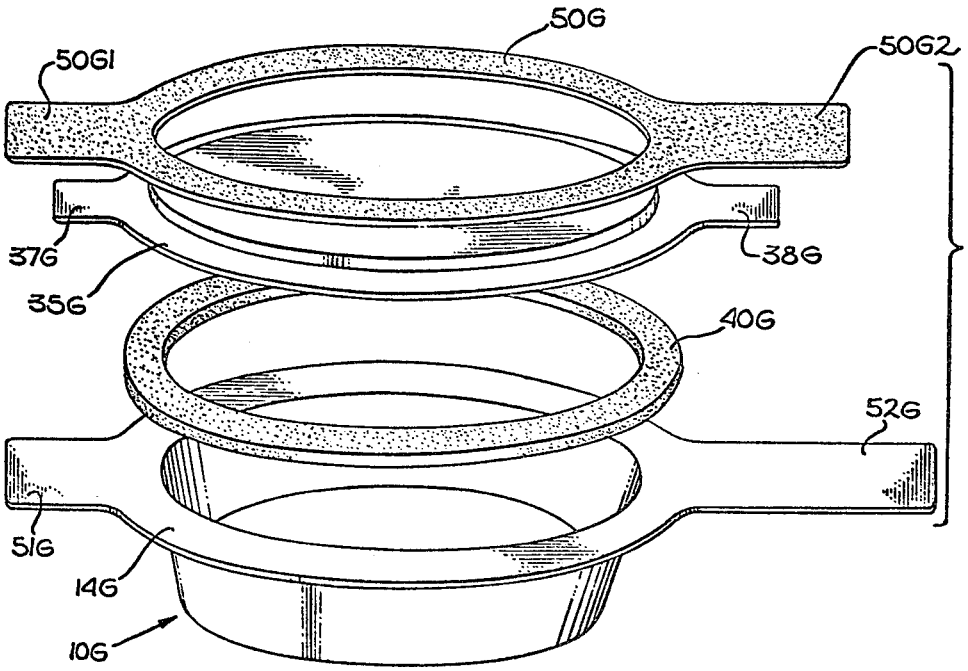

SEVENTH EMBODIMENT (FIGS. 38 to 40, inclusive)

FIG. 38 is a perspective view of a pan-and-lid type of package having vent means between the circumferential flanges of pan and lid;

FIG. 39 is a cross-sectional elevational view of the package of FIG. 38; and

FIG. 40 is an exploded perspective view of the package.

Referring now to the drawing, container 10G is identical to container 10F of the previous embodiment, except that handle 52G is perfectly flat and does not have the dimples contained in the handle 52 of the previous embodiment. Meat holder 20G has the same configuration as meat holder 20F and serves as a grease trap in precisely the same manner. Meat patty 91 (FIG. 39) has the same configuration as in the previous embodiment.

A filter ring 40G rests upon the pan flange 14G and extends around the entire circumference thereof. However, the radial width of the filter ring 40G is significantly less than the radial width of pan flange 14G, and the filter ring rests upon the inner circumferential portion of the flange.

Container lid 30G has a flat circular central section which extends over the otherwise open end of the pan 10G, and also extends over that portion of the pan flange 14G which is occupied by the filter ring 40G. Lid 30G then has an additional circumferential portion 35G which is stepped downward somewhat from the central portion of lid 30G, but it is stepped down only a distance equal to about half the thickness of filter ring 40G, with the result that an annular open space remains between the lid flange 35G and the pan flange 14G. The lid also has handle portions 37G and 38G which are both narrower and shorter than the corresponding handle portions 51G, 52G of the container 10G.

The outer diameter of lid flange 35G is somewhat less than the diameter of pan flange 14G, with the result that throughout its entire circumference the pan flange 14G projects horizontally outward beyond the lid flange 35G.

A flexible cover sheet 50G is in the form of a flat circular ring having oppositely projecting handle portions 50G1 and 50G2. The diameter of the central opening in ring 50G is equal to the outer diameter of the central or raised portion of lid 30G. Flexible cover sheet 50G may therefore be placed upon the lid flange 35G to cover its entire circumference. The radial width of cover ring 50G is sufficient to cover the lid flange 35G and to extend radially therebeyond and be stepped downward so as to also cover the remaining radial expanse of the pan flange 14G (see FIG. 38). The handle portions 50G1 and 50G2 of cover sheet 50G are large enough to cover the lid handle portions 37G and 38G and extend beyond them and cover the adjoining portions of the container handles 51G and 52G.

In the fully assembled condition of the package as shown in FIGS. 38 and 39 the annular open space between pan flange 14G and the lid flange 35G is completely sealed by the cover sheet 50G. Prior to cooking of the meat patty 91 the cover sheet 50G is removed. During the cooking operation the cooking gases generated from meat patty 91 move radially outward through the filter ring 40G, where they are partially absorbed, with the remaining part moving radially outward through the annular space between pan and lid and hence escaping to atmosphere.

When cooking is completed the lid 30G is removed, and the filter ring 40G is also removed. Meat patty 91 may then be lifted out by means of a fork or tooth picks, or a side portion of the container 10G may be bent downward in order to remove the meat patty in a horizontal direction.

EIGHTH EMBODIMENT

(FIGS. 41 and 42)

FIG. 41 is a perspective view, partially in cross-section, of an assembled package having partial circumferential edge venting means; and FIG. 42 is an exploded perspective view of the package.

Referring now to the drawings, container 10H is a generally circular pan having bottom wall 11H, side wall 13H and flange 14H. Bottom wall 11H has a number of downwardly depressed dimples to support it in spaced relationship above a flat surface. The pan is elongated at one end to provide a recess 16H for receiving the handle of the meat holder.

Meat holder 20H includes a somewhat circular tray 21H having downwardly depending ridges 22H which serve as feet. As shown in FIG. 42 the tray 21H is truncated on its two longitudinal side edges, although it could, if desired, be exactly circular. A backing member 23H rises up from one curved end of the tray 21H, being flared or inclined at about the same angle as the side wall 13H of the tray or pan. Handle 24H is attached to the upper central portion of backing member 23H. It is the handle 24H of meat holder 20H which is received in the recess 16H of the pan or container 10H.

The peripheral edge of pan 10H is preferably circular although the meat compartment therein is eccentrically located, as previously described in conjunction with the first embodiment of the invention. Lid 30H is circular and adapted to fit down upon the entire circumference of the pan flange 14H in order to close the top of the pan. Lid 30H has a raised portion 38H which is of such size and configuration as to lie above the pan recess 16H. The raised lid portion 38H has vent holes 46H formed therein. A flexible cover sheet 50H is placed over the upper surface of the vent holes. A filter pad 40H is placed within the raised portion 38H of the lid and covers the under surface of the vent holes 46H.

Prior to cooking of meat patty 89 (see FIG. 41) the flexible cover sheet 50H is removed. During cooking the grease from the meat patty flows around the edges of tray 21H and also flows through holes associated with the ridges or feet 22H, so as to occupy the space underneath the tray. The cooking gases generated from meat patty 89 flow both above and around the backing member 23H into the handle recess 16H, and hence upward through the filter pad 40H and the holes 46H into atmosphere.

When cooking is completed the lid 30H is removed together with the filter pad 40H. Handle 24H is used for lifting the meat holder and the meat out of the container.

NINTH EMBODIMENT

(FIGS. 43, 44, 45)

Figure 43:
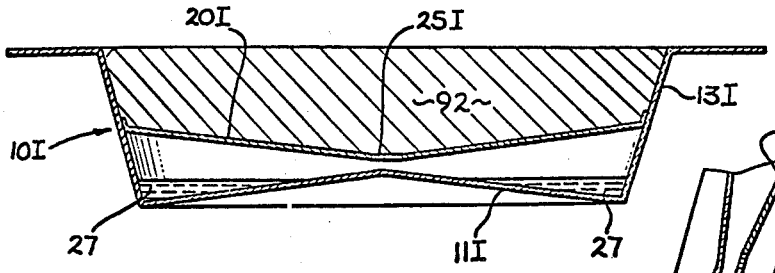
Figure 44:
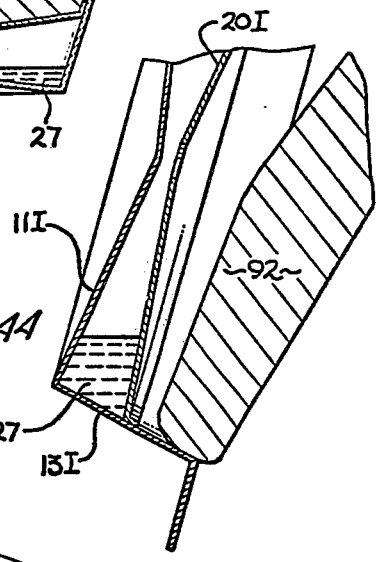

FIG. 43 is a cross-sectional elevational view of a container and grease trap in accordance with the invention;

FIG. 44 is a fragmentary view of the container in a tilted position; and

Figure 45:
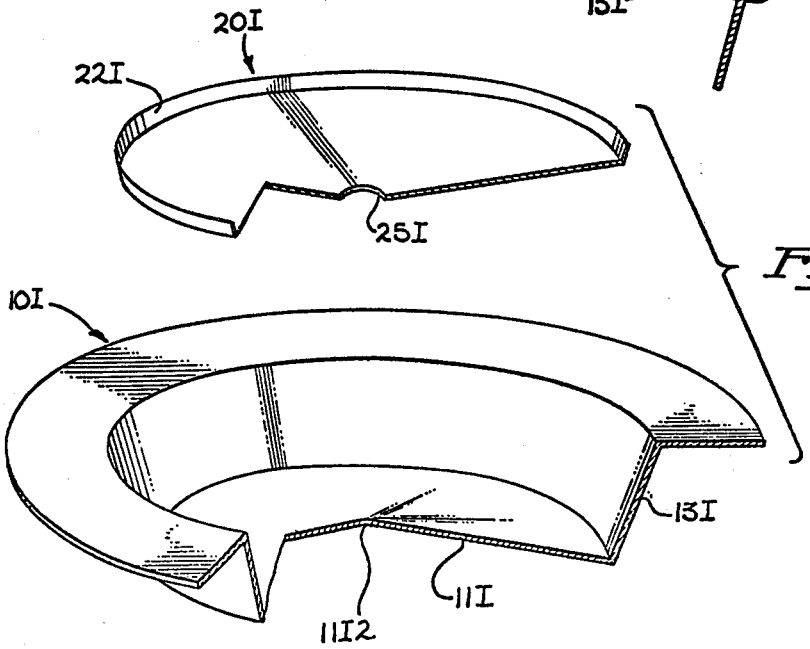

FIG. 45 is a perspective view, partially in cross-section, of the container and grease trap.

Container 10I is a circular pan having a bottom wall 11I and sloping circumferential side wall 13I. The bottom wall 11I is not flat but is raised toward a point 11I2 at its center, in a shallow conical configuration.

A false bottom 20I serves as both a meat holder and a grease trap. The false bottom 20I is a circular sheet member having an upwardly flanged circumferential edge 22I, and the diameter of the false bottom being such that its flanged edge engages and rests upon the sloping side wall 13I of container 10I at about mid-way of its height. The false bottom 20I is not flat but it slopes down toward its center in a shallow conical-configuration, and has a center hole 25I. The center hole 25I of false bottom 20I is spaced somewhat above the apex 11I2 of the container bottom wall 11I.

A circular meat patty 92 is positioned upon the false bottom 20I and has its bottom surface shaped in a shallow conical configuration to match that of the false bottom. The cooking of the meat patty causes grease to run down the upper surface of the false bottom 20I and through the center hole 25I and thence toward the outer periphery of the container bottom wall 11I. FIG. 43 shows the grease 27 collected at the outer edges of the container bottom wall.

When the meat patty 92 is to be served, the container 10I may be turned up on edge and somewhat beyond, as shown in FIG. 44. The cooked meat patty 92 is then dumped out of the container. Grease 27 at this time is securely retained within the container between the container bottom wall 11I, side wall 13I and false bottom 20I.

TENTH EMBODIMENT

(FIGS. 46, 47, 48)

Figure 46:
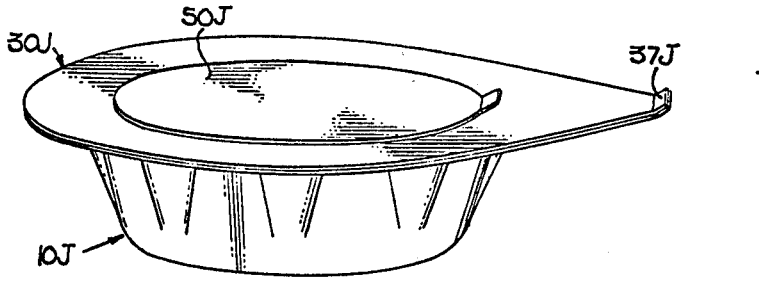
Figure 47:
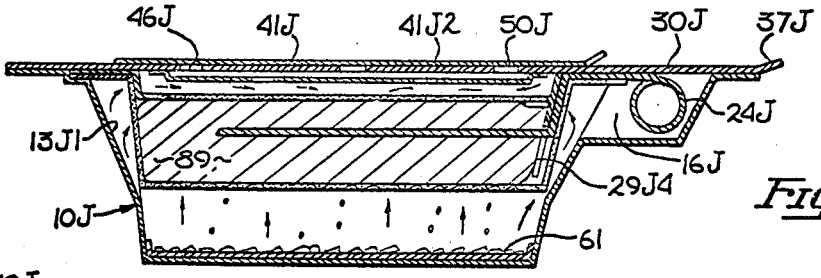
Figure 48:
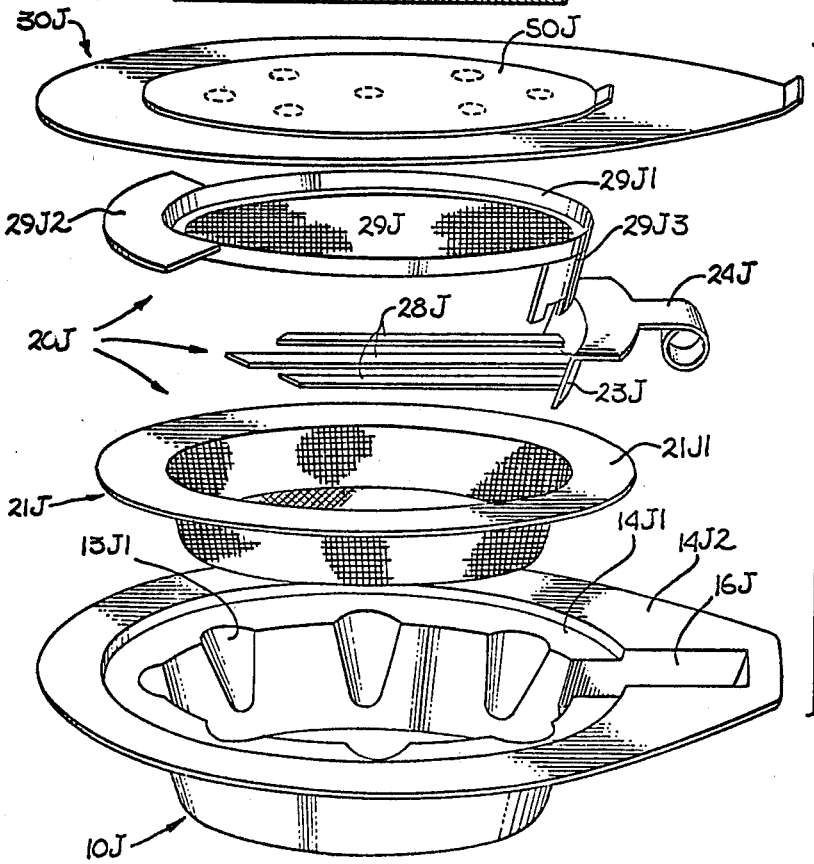

FIG. 46 is a perspective view of another assembled package in accordance with the invention, which is particularly adapted for barbecuing a meat product contained therein;

FIG. 47 is a cross-sectional elevational view of the package and meat product of FIG. 46; and FIG. 48 is an exploded perspective view of the package.

Meat holder 20J includes a wire mesh basket 21J, a fork 28J for insertion into the meat patty, and a top cover 29J for the basket. Basket 21J has a flat peripheral flange 21J1 which may be made of aluminum foil. The sloping side wall and flat bottom wall of the basket are made of wire mesh screen. Top cover 29J includes a flat circular wire mesh screen supported on a metal ring 29J1, the ring having on its left side, as shown in FIG. 48, a horizontal flange 29J2 which is adapted to rest upon the flange of the basket 21J. The cover 29J on its right side as shown in FIG. 48 has a downwardly depending curved backing member 29J3 which is adapted to fit within the sloping side wall of the basket 21J. Basket 21J and cover 29J together form a complete wire mesh screen enclosure for the meat patty 89.

The fork 28J includes three tines which extend horizontally in parallel relationship. All of the tines at one of their ends are attached to an arcuate backing member 23J, and a handle 24J is attached to the upper end of the backing member 23J. The backing member 29J3 of top cover 29J has notches 29J4 in its lower edge which receive the respective tines of the fork 28J (see FIGS. 47, 48).

Meat patty 89 (FIG. 47) is a flat circular meat patty which has been illustrated previously. The meat patty is first covered with top cover 29J, and then handle 24J is used to insert the tines of fork 28J horizontally through the notches 29J4 and thence through one side of the meat patty until the backing member 23J engages the backing member 29J3. This entire assembly is then dropped down within the wire mesh basket 21J.

The container 10J (bottom of FIG. 48) is a generally circular pan having a horizontal flange 14J1 at the upper edge of its side wall, the flange 14J1 in turn being surrounded by an additional flange 14J2 stepped out at a higher elevation. Flange 14J2 is widened on one side of the container in order to provide for a handle recess 16J. When the meat patty 89 and assembled meat holder 20J are dropped into the pan 10J, the horizontal flange 21J1 of basket 21J rests upon the flange 14J1 of the container, and handle 24J is received in recess 16J.

Container 10J is of significantly greater depth than the basket 21J with the result that the bottom of the basket is a considerable elevation above the container bottom. It is preferred to pack a number of small rocks 61 (FIG. 47) into the bottom portion of container 10J. The heating of the rocks by application of heat from underneath the container then provides a secondary means for heating the meat patty 89. During cooking a certain amount of grease inevitably drops from the meat patty 89 through the basket 21J and down onto the rocks 61.

A cover 30J is basically circular but elongated on one side to match the configuration of the flange 14J2 of the container 10J. Lid 30J has a number of vent holes 46J formed in its central portion. A baffle plate 41J is fastened to the underside of the lid in a spaced relationship thereto, the baffle plate also having vent holes 41J2 which are offset relative to the vent holes of the lid. A flexible cover sheet 50J covers the vent holes in the lid, and may be removed prior to cooking.

Container 10J has a number of notches or indentations 13J1 which are formed in the upper portion of its side wall. These notches extend below the bottom wall of basket 21J, and therefore permit the flow of hot air around the meat patty 89, as shown by arrows in FIG. 47.

During cooking the cooking gases escape above the surface of the meat patty through the vent holes 41J2 of baffle plate 41J and the vent holes 46J of lid 30J. The staggered position of vent holes in the baffle plate relative to those in the lid permits some of the vaporized grease to precipitate upon the upper surface of the baffle plate.

When the cooking is completed the lid 30J is removed by pulling the pull tab 37J. The meat patty 89 and the meat holder 20J, including basket 21J, top cover 29J, and fork 28J, are all removed as a unit from the container 10J. Handle 24J raising fork 28J is used to lift the meat patty out of the basket 21J. Then the handle 24J and the edge flange 29J2 of top cover 29J are pulled in horizontally opposite directions, in order to disengage the meat patty. This is preferably done while holding the meat patty above a piece of bread. As the tines of fork 28J are pulled through the notches 29J4 of cover 29J, they are withdrawn from the meat patty because the meat patty is held in place by the backing member 29J3.

Figure 49:
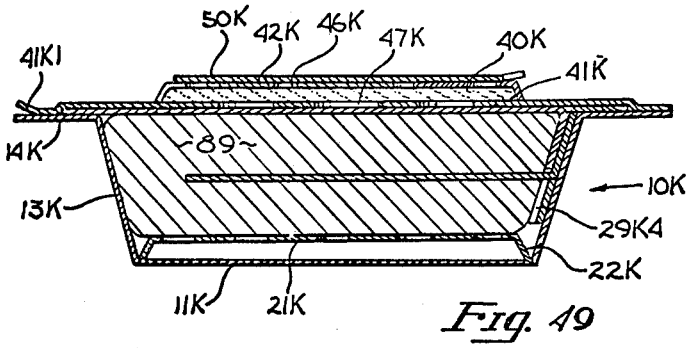
Figure 50:
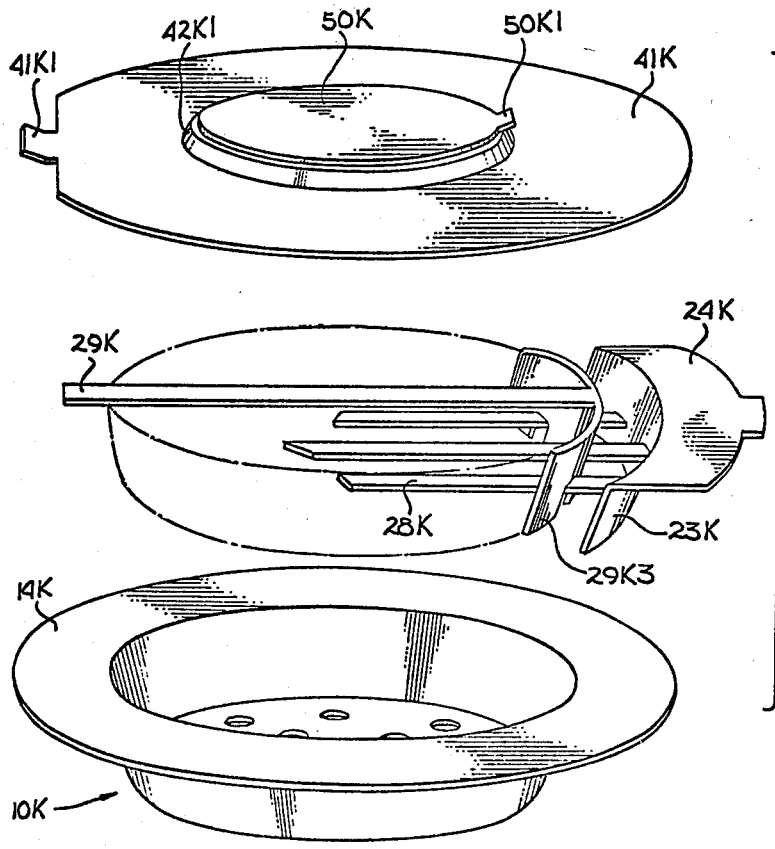

ELEVENTH EMBODIMENT (FIGS. 49 and 50)

FIG. 49 is a cross-sectional elevational view of a packaged meat product in accordance with the invention, including a two part meat holder; and FIG. 50 is an exploded perspective view of the package and meat holder.

In FIGS. 49 and 50 the pan 10K is circular in configuration having a flat bottom wall 11K, a sloping side wall 13K, and a horizontal peripheral flange 14K. The flat circular tray 21K is perforated with a number of holes for draining grease from the meat patty 89, and has a downwardly depending peripheral flange 22K forming a foot for the tray 21K and which flange or foot fits within the lower periphery of side wall 13K so that the meat patty 89 is suspended some distance above the bottom wall 11K of the pan.

The top lid or closure of FIGS. 49 and 50 is somewhat different than those shown in the previous embodiments. A lower lid 41K is circular and has the same diameter as the pan flange 14K, being cut away at one point to provide the gripping tab 41K1. In its central portion the lower lid 41K has a number of holes 47K. A circular filter pad 40K rests upon the central portion of lower lid 41K and covers all of the holes 47K. An upper lid 42K has a size and configuration very similar to that of the circular tray 21K. The upper lid 42K is a flat circular member having a number of spaced holes 46K formed therein, but with its peripheral edge turned down at an angle to form a flange or foot which rests upon the lower lid 41K so as to support the upper lid in spaced relationship thereto. Filter pad 40K is of such a size and shape as to fit precisely within the space provided between the two lids. The holes 47K of the lower lid and the holes 46K of the upper lid are staggered horizontally relative to each other so that cooking gases rising upward through the holes 47K must travel horizontally within the filter pad 40K before escaping from one of the holes 46K. A flexible cover sheet 50K having a pull tab 50K1 is provided to seal the upper surface of the upper lid 42K, and is removed prior to the cooking operation.

In FIGS. 49 and 50 the two-part meat holder includes a three-tined fork 28K attached to a backing member 23K having a handle 24K, the fork being closely similar to that shown in FIG. 48. The upper part of the meat holder includes a single horizontal strap 29K attached to an arcuate backing member 29K3 having notches 29K4 on its lower edge which receives the fork tines 28K.

During the assembly or manufacturing operation the meat patty 89 is formed and the strap 29K is placed over the top of the meat patty with the backing member 29K3 engaging one portion of its side wall. Then the fork tines 28K are inserted horizontally through the notches 29K4 and into the central portion of the meat patty. FIG. 49 shows the location of the fork tines at about the vertical center of the meat patty. The meat patty and meat holder are then lowered into the pan 10K, and handle 24K rests upon the pan flange 14K at one side of the pan while the extreme end of the strap 29K rests upon flange 14K on the other side of the pan. The lid assembly is then placed over the pan, and the circumferential edge of lower lid 41K (except for the pull tab 41K1) is crimped down upon the pan flange 14K. This crimping action captures the handle 24K and the tip end of the strap 29K in their respective positions, as shown.

For cooking, the flexible cover sheet 50K is removed. The pan is preferably heated through its side walls.

When the meat patty has been cooked the entire lid assembly is removed by grasping the tab 41K1. Handle 24K is used to lift the meat patty out of the pan. The extreme end of strap 29K is then grasped as a handle, and held in place while the handle 24K is pulled horizontally away from the meat patty. This operation is preferably performed over a piece of bread so that the meat patty is supported from its under side by the bread.

TWELFTH EMBODIMENT

Figure 51:
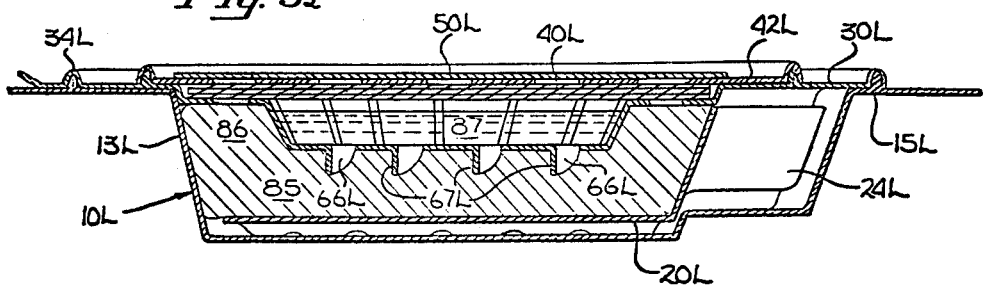
Figure 52:
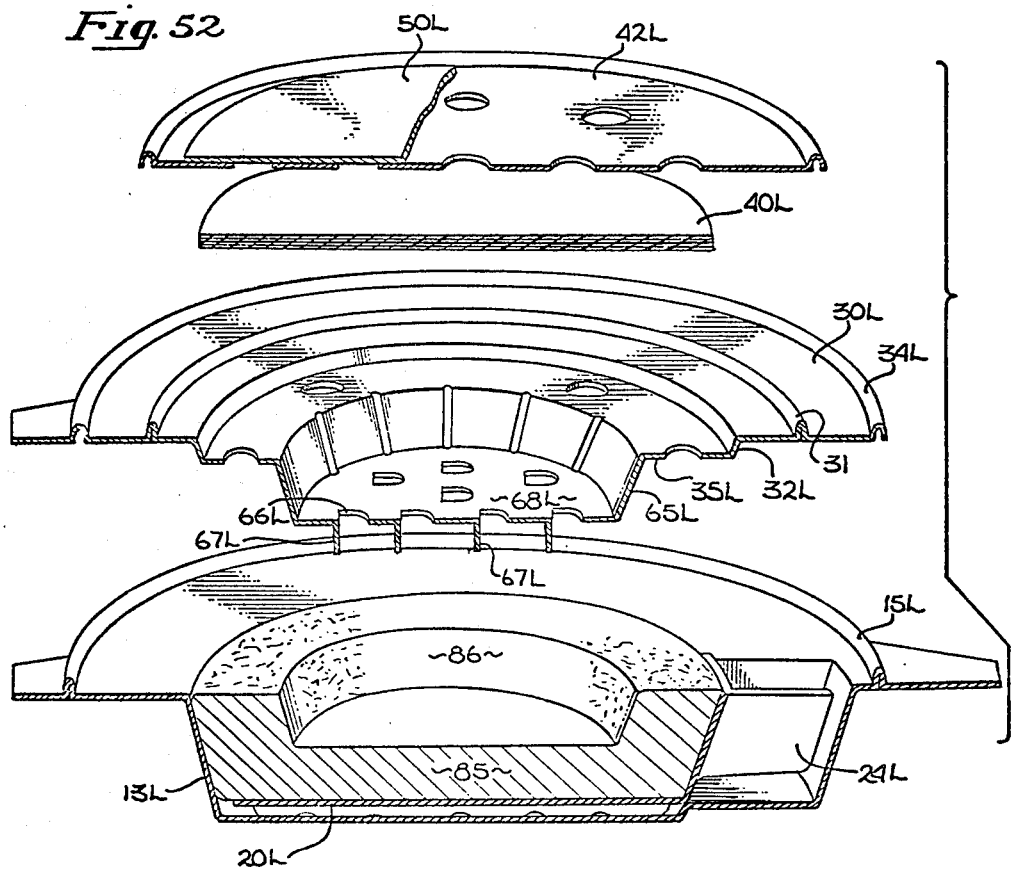

(FIGS. 51 and 52)

FIG. 51 is a cross-sectional view of a packaged meat product representing a twelfth embodiment of the invention, characterized by a novel sauce compartment in the container lid; and FIG. 52 is an exploded perspective view, in cross-section, of the container and meat product.

The container of FIGS. 51 and 52 is generally the same as that shown in FIGS. 1 to 11, inclusive. A circular tray or meat holder 20L has a handle 24L and is substantially identical to the meat holder 20 shown in FIG. 11. Pan 10L has a central aperture for receiving the meat holder and an elongated opening on one side for receiving the handle 24L, and the pan 10L is generally the same as pan 10 of FIG. 11 except that the pan flange is concentric to the meat holding receptacle.

In the embodiment shown in FIGS. 51 and 52 the dual lid structure is also generally similar to that shown in FIGS. 1 to 11, inclusive. A lower lid 30L is attached to the pan flange at its outer periphery while an upper lid 42L is of smaller diameter and is crimped upon the lower lid at a point above the pan flange. The upper lid 42L has perforations or holes which are covered by a flexible sheet 50L that is removed prior to the cooking operation. The lower lid 30L is stepped downward to provide an annular shoulder 32L within the side wall 13L of the pan or container. The lower lid 30L then extends inwardly at this lower level in a portion designated 35L. A circular filter pad 40L is supported on the circumferential flange 35L of the lower lid and engages the under surface of the upper lid 42L.

However, the embodiment shown in FIGS. 51 and 52 is differentiated from the embodiment of FIGS. 1 to 11, inclusive, in that it is specifically adapted to receive a circular meat patty 85 having an upstanding circumferential flange portion 86. At the inner circumference of the horizontal portion 35L the lower lid 30L is again stepped downwardly by means of a sloping side wall portion 65L which engages the inner wall of the meat patty flange 86. At the bottom of sloping wall 65L a flat circular wall 68L engages the upper surface of the central portion of meat patty 85. The flat wall 68L has a number of openings 66L formed therein, each opening being formed from the aluminum sheet material by cutting out a small flap which is turned downwardly with the upper end of the flap still attached to the horizontal wall 68L.

In the assembly or manufacturing process the meat holder 20L is placed inside the pan or container 10L and then the meat patty 85 is placed on the holder. Lower lid 30L is then placed over the container and the outer circumferential ridge 34L of the lower lid is crimped to the outer circumferential ridge 15L of the container. At this time the prongs or forks 67L of the lower lid are inserted into the meat patty 85. A quantity of cooking sauce 87 which may be in a liquid or solid form is now inserted into the chamber formed by the sloping side walls 65L and flat bottom wall 68L. Filter pad 40L is placed over the meat sauce chamber, and then the upper lid 42L is attached and is crimped upon the lower lid.

The advantage of this embodiment of the invention is that, as in the embodiments of FIGS. 17 and 20, the cooking sauce, by virtue of its greater liquidity, provides improved heat conduction across the upper area of the meat patty. Furthermore, the lower lid 30L being made of aluminum sheet material provides a heat flow path into the central portion of the meat patty which greatly facilitates the cooking process.

THIRTEENTH EMBODIMENT

(FIGS. 53, 54, 55)

Figure 53:
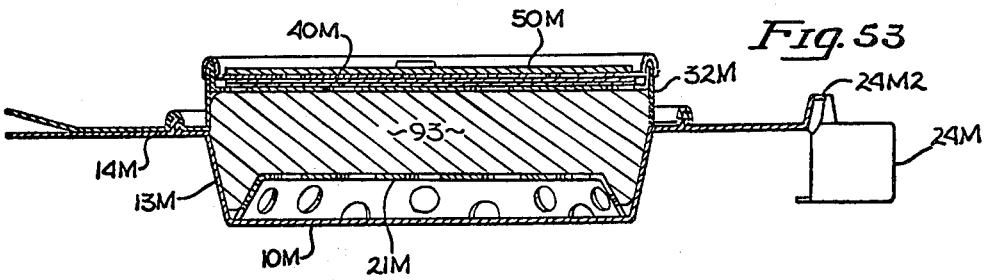
Figure 54:
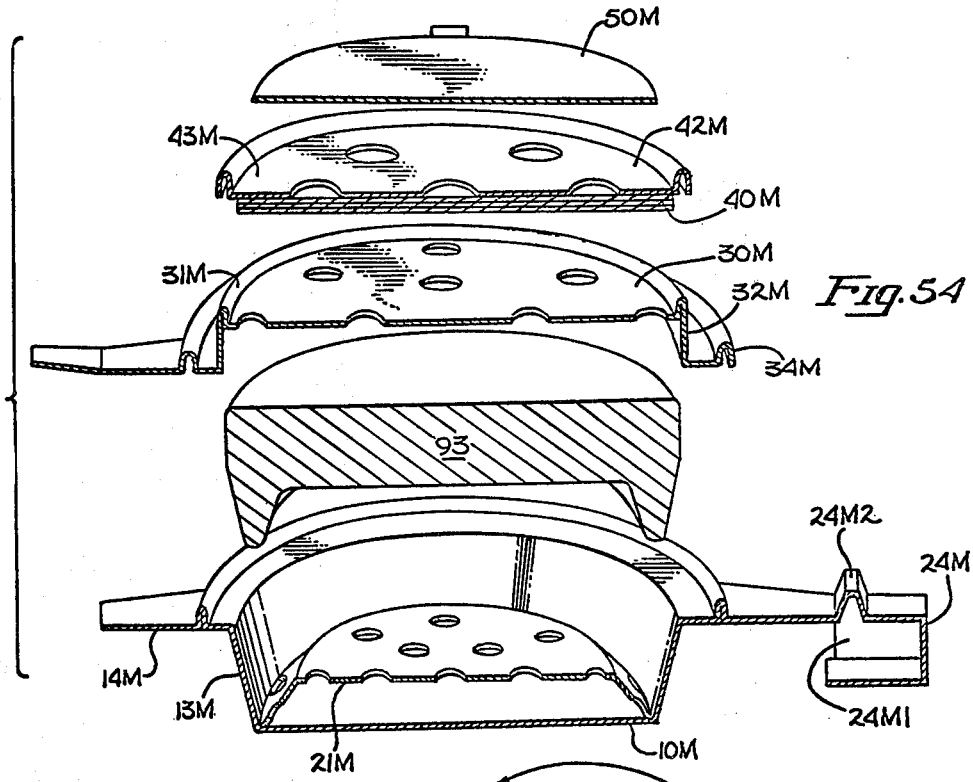
Figure 55:
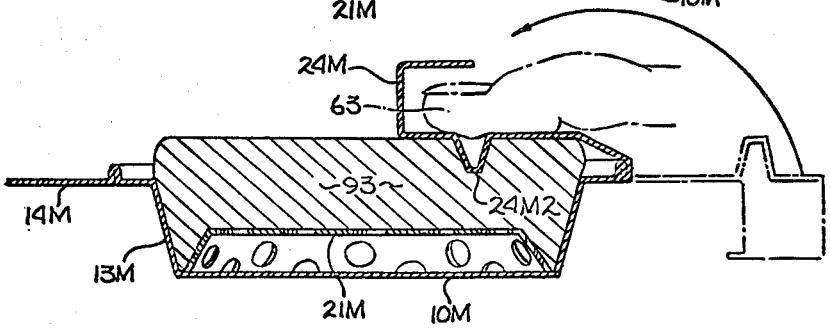

FIG. 53 is a cross-sectional elevational view of a packaged meat product representing a thirteenth embodiment of the present invention;

FIG. 54 is an exploded perspective cross-sectional view of the package of FIG. 53; and FIG. 55 is a fragmentary cross-sectional view illustrating the mode of usage of the device.

The container 10M has a flat bottom wall, sloping circular side wall 13M, and peripheral flange 14M. A handle 24M extends from the flange 14M at one point on its circumference, appearing on the right-hand side of the drawing figures. Circular tray 21M is similar to the tray 21K illustrated in FIG. 49.

Meat patty 93 is circular in form and has a peripheral flange on its lower side which engages the sloping peripheral wall of tray 21M. A lid member 30M fits over the top of meat patty 93 and has holes or perforations in its horizontal wall to permit the escape of cooking gases. Meat patty 93 is higher than the side wall 13M of container 10M, and lid 30M has a downwardly depending side wall 32M which encloses the upper portion of the meat patty. Lid member 30M has a circumferential ridge 34M which is crimped to a corresponding ridge of the pan flange, as in previous embodiments.

A filter pad 40M rests upon the central portion of lid member 30M. A cover plate 42M extends over the filter pad. Cover plate 42M has a peripheral ridge 43M which is crimped down upon the inner ridge 31M of the lid member. Cover plate 42M also has holes or perforations formed therein, which are staggered relative to the holes or perforations of the lid member. A flexible cover sheet 50M is placed over the cover plate 42M and kept in position until cooking of the meat patty.

When cooking of the meat patty is completed the entire lid assembly including lid member 30M, filter pad 40M, and cover plate 42M is separated from the container 10M and is lifted away from the meat patty. At this time the handle 24M of pan 10M forms a portion of the apparatus for holding the meat.

As shown in FIGS. 53 and 54 the handle 24M has a hollow end 24M1 forming a finger or thumb recess. Handle 24M has basically a strap-like configuration, and the finger or thumb recess is beneath the outer end of the strap. At the front of the recess and on the upper side of the strap is a protrusion 24M2. Handle 24M is used by bending it forward until the protrusion 24M2 bites into the upper surface of meat patty 93. At that time the finger or thumb recess is in a proper position to receive the thumb 63 (see FIG. 55) of the person who is preparing to serve the meat patty. The opposite side wall of container 10M may then be bent back out of the way and the meat patty 93 is ready to be placed upon a piece of bread or the like.

FOURTEENTH EMBODIMENT (FIGS. 56 to 60, inclusive)

Figure 56:
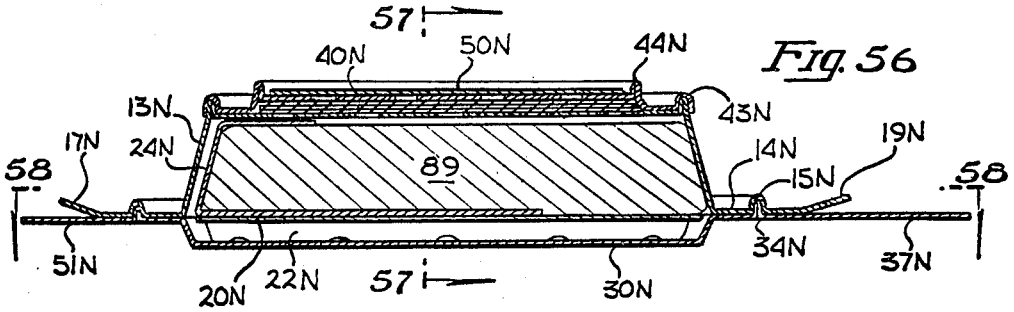
Figure 57:
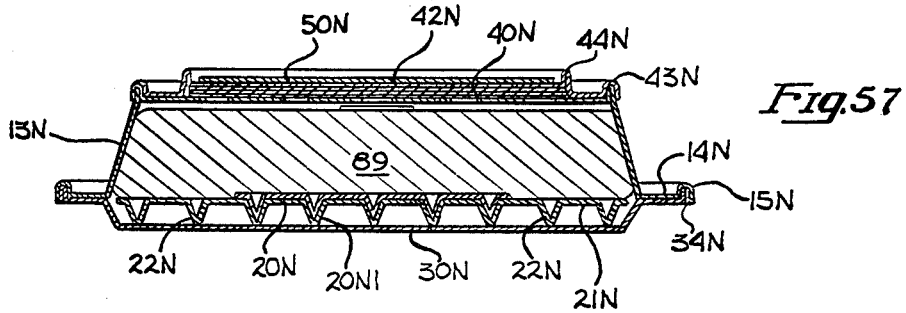
Figure 58:
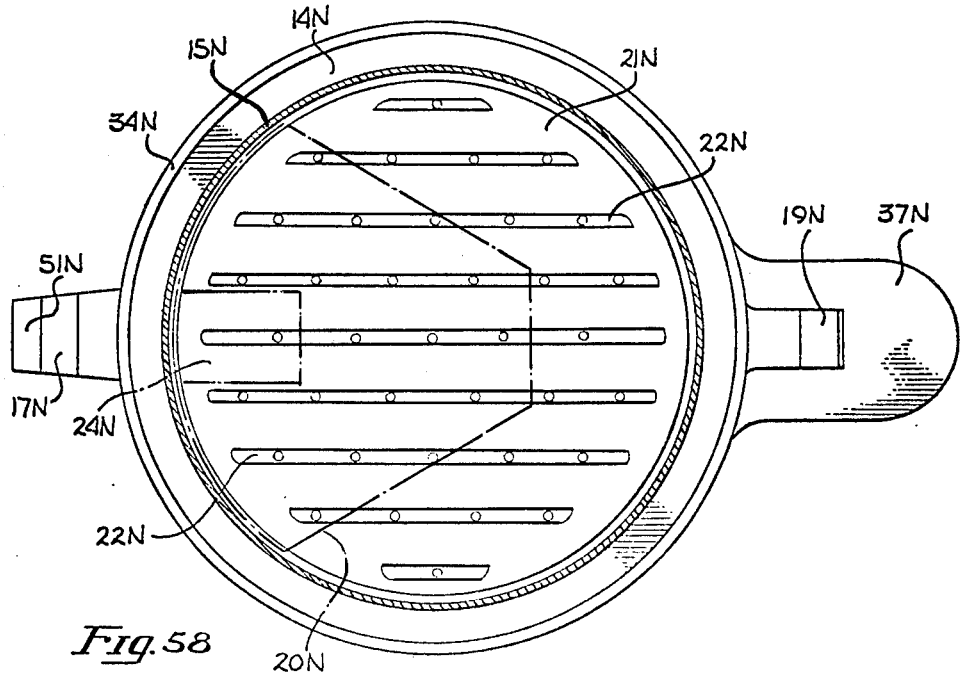
Figure 59:
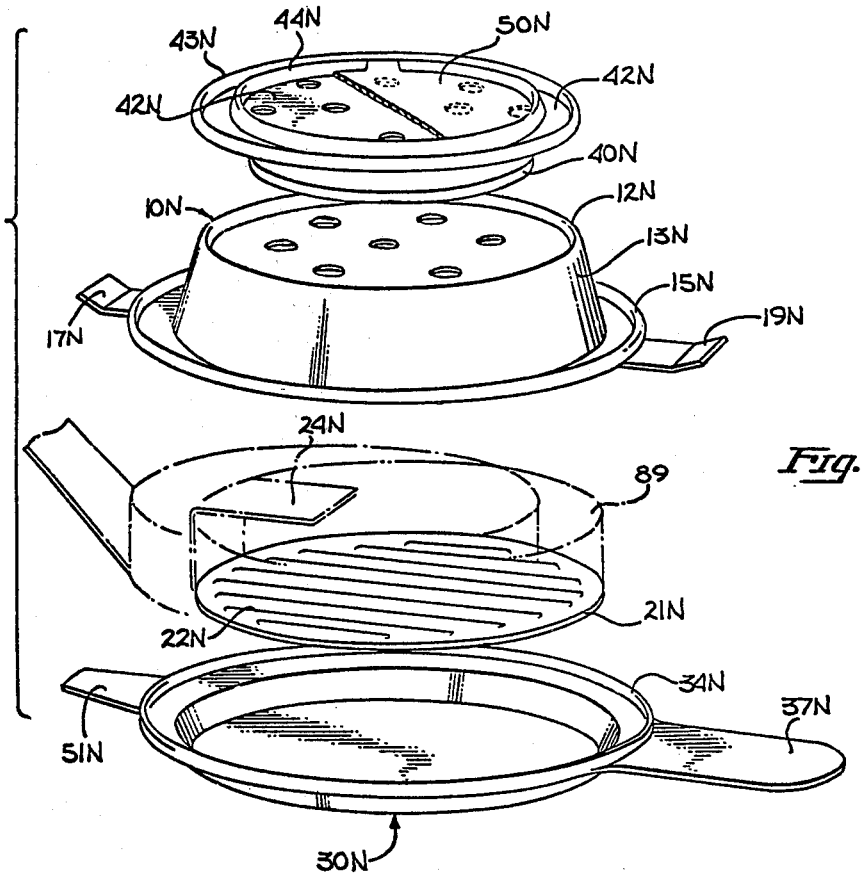

FIG. 56 is a cross-sectional, elevational view of a packaged meat product in accordance with the present invention;

FIG. 57 is a transverse cross-sectional view taken on the line 57—57 of FIG. 56;

FIG. 58 is a horizontal cross-sectional view taken on the line 58—58 of FIG. 56;

FIG. 59 is an exploded perspective view of the package of FIG. 56; and

Figure 60:
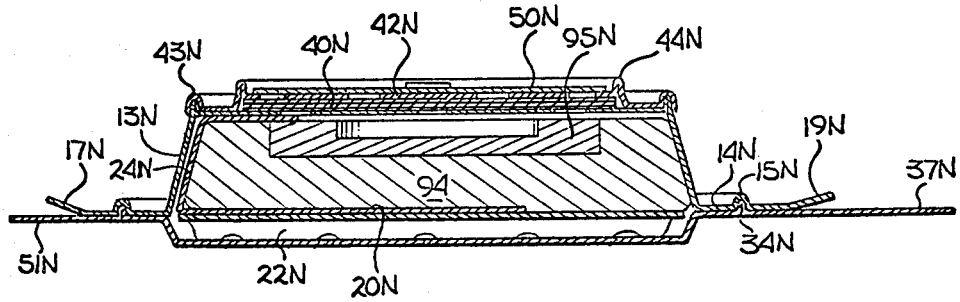

FIG. 60 is a view like FIG. 56 but showing a modified form of the meat product.

Referring now to FIGS. 56 through 59, inclusive, a lid member 30N is on the bottom of the container and has a shallow pan-shaped configuration. A circular tray 21N has a plurality of parallel, downwardly extending ridges 22N which form feet for the tray. Tray 21N rests within the lid member 30N and has about the same vertical height as the lid member.

A circular meat patty 89, inverted relative to the position it occupies in previous embodiments, rests upon the tray 21N. A container wall 13N is flared outwardly and downwardly to confine the outer circumferential wall of the meat patty. At the lower end of wall 13N a horizontal peripheral flange 14N is formed having an outer ridge 15N, and the ridge 15N is crimped upon a corresponding ridge 34N of the lid member 30N.

As best seen in FIG. 59 the pan or container 10N is arranged upside down. It is closed at its upper end by horizontal bottom wall 11N having holes or perforations formed therein. A flat circular filter pad 40N covers the holes or perforations in the bottom wall 11N. A cover plate 42N rests above the filter pad 40N, the cover plate also having holes or perforations which are staggered horizontally relative to the holes or preforations in bottom wall 11N. A flexible cover sheet 50N covers the holes in the plate 42N prior to the time when cooking is to be commenced. Cover plate 42N has an inner ridge 44N, and then is stepped down to a horizontally flanged portion terminating in an outer ridge 43N, the ridge 43N being crimped upon a ridge 12N of the container 10N.

Lid member 30N has projecting from one side a short handle 51N and from the other side a long handle 37N. The pan 10N has pull tabs 17N and 19N on its lower edges which correspond to the tabs 51N and 37N, respectively. After the meat patty 89 has been cooked the tabs 17N and 51N are separated, and the tabs 37N and 19N are separated, in order to disengage the ridges 15N and 34N from each other and thereby lift the pan 10N together with filter pad 40N and cover plate 42N away from the meat patty.

Also included in the package of FIG. 56 is a meat holder 20N which, as shown by dotted lines in FIG. 58, has a truncated pie-shaped configuration. As best seen in FIG. 57, the meat holder 20N has a plurality of longitudinally extending ridges 20N1 which depend downwardly and engage within corresponding ridges or feet 22N of the circular tray 21N. From the center of the arcuate end of meat holder 20N a strap 24N extends upwardly. The upper end of strap 24N is bent over at a right angle so that it lies parallel to meat holder 20N and tray 21N. This relationship is best seen in FIG. 56.

After cooking is completed and the pan 10N has been removed, the meat patty then rests upon the tray 21N and meat holder 20N with the handle 24N being bent over one edge portion of its upper surface. This relationship is best seen in FIG. 59. The handle 24N may then be bent upwardly and outwardly and pulled away from the tray 21N in order to place the meat patty on a piece of bread or other desired location.

FIG. 60 shows the same package, but in modified form, of the meat product. Meat patty 94 has its upper central portion cut away so that there is a circumferential flange which stands up above the rest of the meat patty. A ring of cooking sauce 95 is disposed within the otherwise open portion of the meat patty. As explained in connection with earlier embodiments, cooking causes the sauce 95 to liquify, thus improving the transmission of heat into the central portion of the meat patty, and insuring a faster and more uniform cooking of the meat.

FIFTEENTH EMBODIMENT (FIGS. 61 and 62)

FIG. 61 is a cross-sectional elevational view of a packaged meat product in accordance with the present invention; and FIG. 62 is an exploded perspective view of the package of FIG. 61.

The package of FIGS. 61 and 62 is generally identical to the package shown in FIGS. 56 to 60, inclusive, and the corresponding parts are designated with the suffix letter "O" in place of the suffix letter "N".

There is, however, one difference in the construction of the package. This is the ring 36-O. The pan or container 10-O has a bottom wall 11-O which is upwardly disposed, and has holes or openings in its central portion. Surrounding the central portion of the bottom wall 11-O is the ridge 36-O which extends downwardly a considerable distance and forms a ring around the central portion of the bottom wall.

Meat patty 94 (like meat patty 94 of FIG. 60) has an open portion in its upper center. The upstanding circumferential flange portion of the meat patty is supported on its outer surface by the pan wall 13-O and is supported on its inner wall surface by the ring 36-O.

As shown in FIG. 62 the meat holder 20-O and handle 24-O are cut somewhat more narrowly than their counterparts of the previous embodiment.

SIXTEENTH EMBODIMENT

Figure 63:
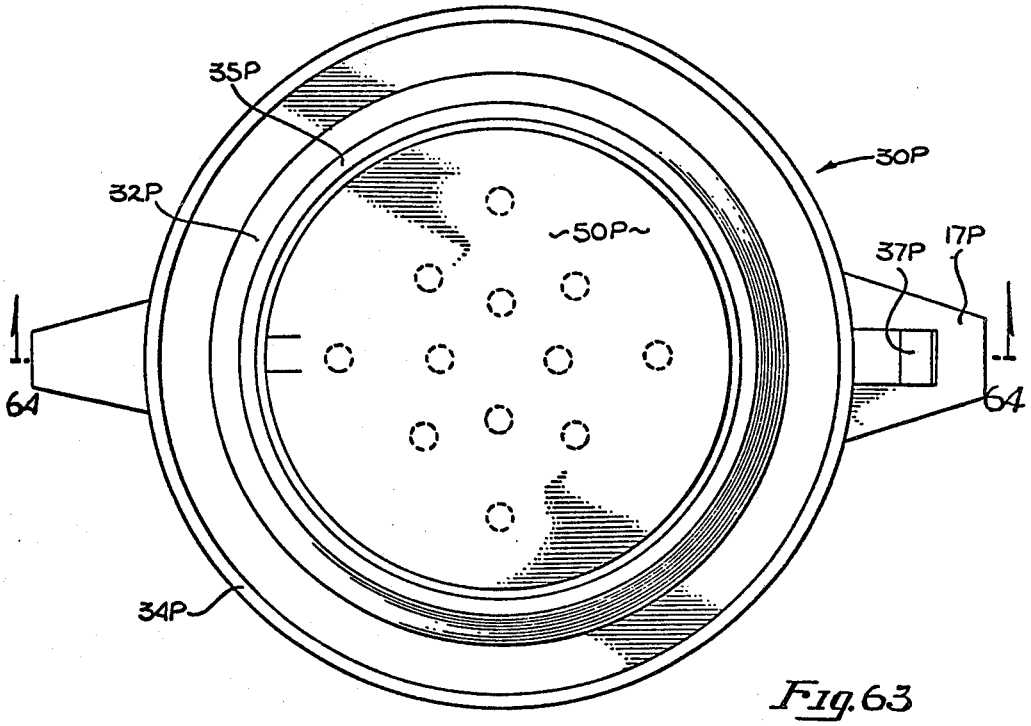
Figure 64:
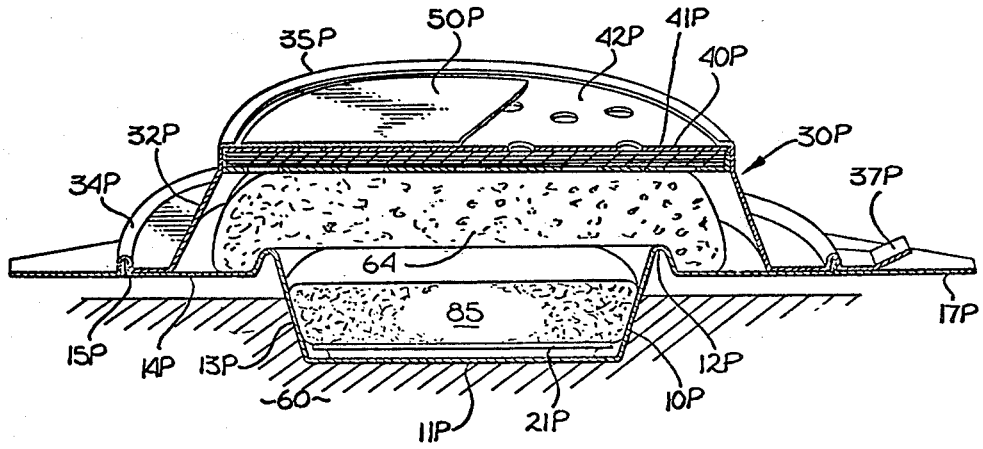

(FIGS. 63 and 64)

FIG. 63 is a top plan view of a sixteenth embodiment of the invention; and

FIG. 64 is a vertical cross-sectional view of the packaged meat product of FIG. 63.

As best seen in FIG. 64 a pan 10P has a flat circular bottom wall 11P and a sloping side wall 13P. A circular tray 21P has downwardly disposed and longitudinally extending ridges which form feet for supporting it in spaced relationship above the bottom wall 11P. A meat patty 85 rests upon the tray 21, and the outer circumferential wall of meat patty 85 is flared outwardly so as to be restrained by the sloping side wall 13P of the pan or container.

Container side wall 13P extends some distance above the meat patty 85, forming a circumferential ridge 12P, and is then turned downward so as to form a circumferential, horizontally extending flange 14P which is at about the same elevation as the upper surface of the meat patty. Flange 14P has an outer circumferential ridge 15P formed thereon.

A half hamburger bun 64 is turned upside down and rests upon the circumferential ridge 12P of container 10P, the outer circumferential edge of the hamburger bun being turned down to engage the inner portion of the pan flange 14P.

A lid member 30P is generally in the form of an inverted pan, having a horizontal flange with an outer circumferential ridge 34P which is crimped onto the ridge 15P of pan 10P. The lid member 30P also has a sloping circumferential side wall 32P which is spaced somewhat outwardly from the circumferential edge of the bun 64. At its upper end (corresponding to the bottom of an inverted pan) the lid member 30P has a short inwarding extending circumferential flange 35P.

A filter assembly disposed above the bun 64 includes a plate or baffle 41P which is of a circular configuration and has holes or apertures formed therein. Above the plate 41P is a flat circular filter pad 40P. A cover plate 42P rests on top of the filter pad 40P and has holes or apertures which are staggered horizontally relative to the holes or apertures of the lower plate 41P. The filter package consisting of the plate 41P, filter pad 40P, and plate 42P, is retained within the upper end of the lid member 30P and beneath the flange 35P. A flexible cover sheet 50P which closes the openings in cover plate 42P is removed prior to cooking.

For cooking the meat patty 85 it is preferred to utilize a stove 60 having a solid metallic top with a circular opening whose side wall is flared at precisely the same angle as the side wall 13P of pan 10P so that when the pan is fitted into the stove opening both the flat bottom wall 11P and the sloping side wall 13P will be in heat-conductive engagement with the stove top. See FIG. 64. During cooking the gases generated from meat patty 85 must necessarily pass through the bun 64 prior to reaching the filter assembly located above the bun.

Thus in utilizing the invention as shown in FIGS. 63 and 64, the meat patty 85 is subjected to the rather direct application of heat through a highly heat-conductive medium, while the bun 64 is generally protected from the direct application of heat. Bun 64 is used in part to filter the cooking gases, so that only a portion of the cooking gases escape into the surrounding atmosphere, and at the same time the cooking gases generated from the meat patty 85 provide a means for heating of the bun. The result is that when meat patty 85 is fully cooked, the bun 64 has become heated and moistened by the cooking gases.

SEVENTEENTH EMBODIMENT

(FIGS. 65, 66, 67, 68)

Figure 65:
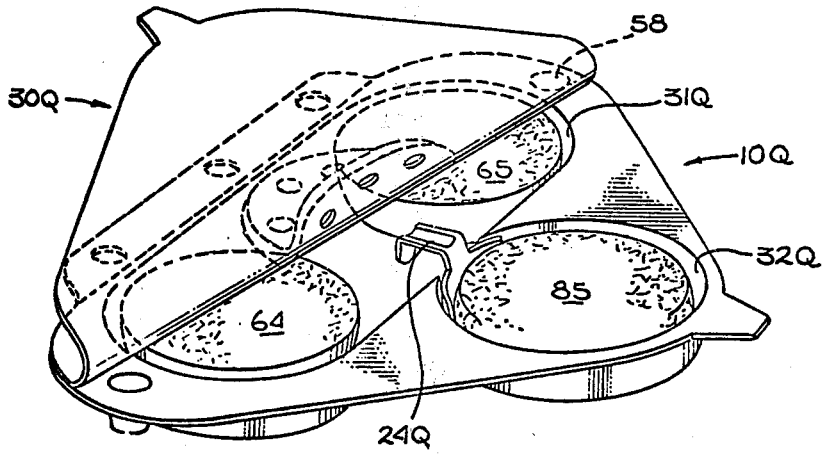
Figure 66:
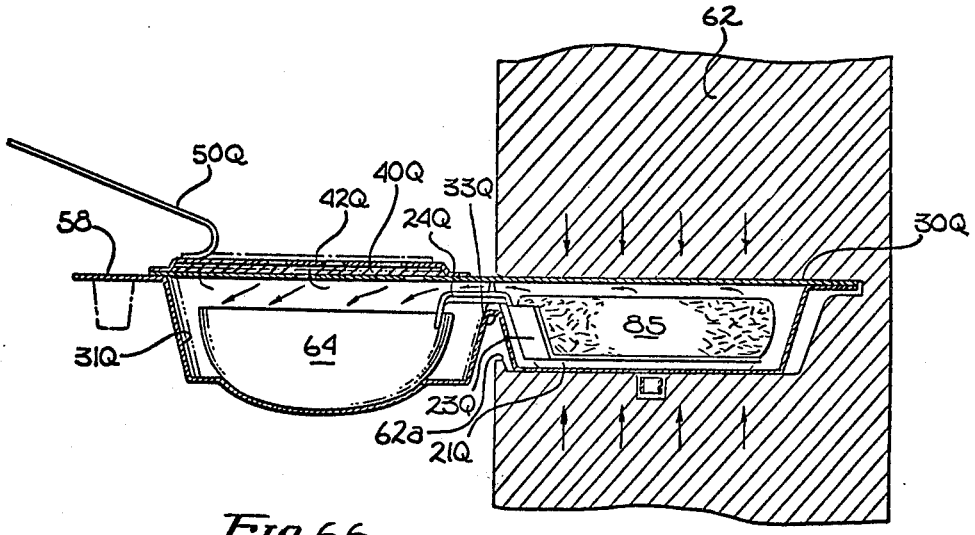
Figure 67:
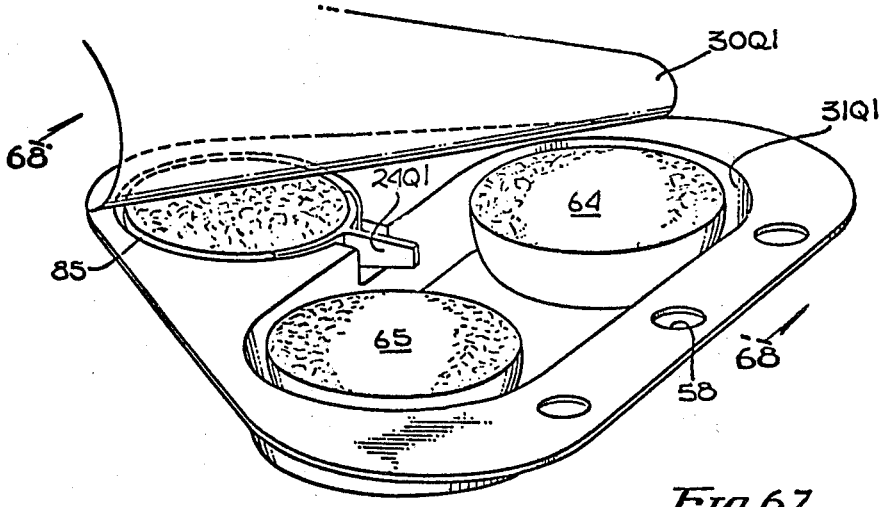
Figure 68:
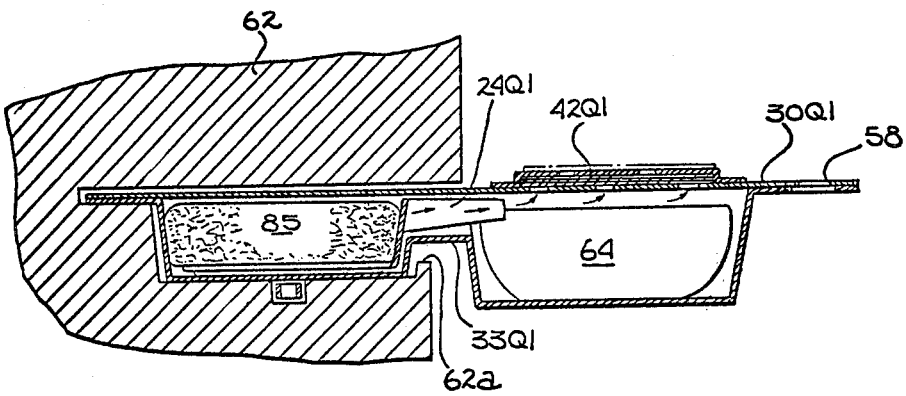

FIG. 65 is a perspective view of a packaged meat product in accordance with a seventeenth embodiment of the invention;

FIG. 66 is a cross-sectional elevational view of the packaged meat product of FIG. 65 inserted in cooking position into a cooking stove;

FIG. 67 is a perspective view of a slightly different form of the invention; and FIG. 68 is a cross-sectional elevational view showing the packaged meat product of FIG. 67 in cooking position in a stove.

Referring first to FIGS. 65 and 66, a pan member 10Q has a generally flat triangular configuration, but with recesses formed therein to receive a meat patty 85 and two half hamburger buns 64, 65, respectively. More specifically, along one of its sides the pan member 10Q has an elongated depression 31Q which is of such size and configuration as to receive the bun half 64 in one end thereof and the bun half 65 in the other end thereof, with a considerable vacant space between the two bun halves. The one remaining corner of pan member 10Q has a single depression 32Q formed therein which is of a generally cup-shaped configuration for receiving the meat patty 85.

As best seen in FIG. 66 the meat patty 85 rests upon a circular tray 21Q, which is supported in raised position above the bottom wall of its pan compartment by means of feet or legs in the manner illustrated in connection with the earlier embodiments of the invention. An arcuate backing member 23Q is attached to one portion of the circumference of tray 21Q, and slopes upward and outward at an angle of a few degrees. A handle 24Q is attached to the upper and central part of backing member 23Q and projects outwardly therefrom in a horizontal direction away from the tray 21Q and meat patty 85.

In the pan or container 10Q the recess 32Q has a partial intersection with the recess 31Q at one point, and this partial intersection provides a lowered wall portion 33Q as best seen in FIG. 66. Handle 24Q projects over the lowered wall 33Q but does not nearly occupy all of the space above the wall, with the result that there is ample room for cooking gases generated from meat patty 85 in compartment 32Q to flow horizontally around the handle 24Q and into the bun compartment. This action is indicated by horizontal arrows in FIG. 66.

Intermediate to the two bun locations there is a filter arrangement which is similar to those previously described. A triangular lid member 30Q made of aluminum foil normally covers the pan member 10Q and closes the compartments 32Q and 31Q. Lid member 30Q has holes or perforations formed therein at the location intermediate to the two bun halves 64, 65. These holes or perforations are covered by a flat circular filter pad 40Q which is in turn covered by a cover plate 42Q, cover plate 42Q also having holes or perforations but which are staggered horizontally relative to the holes or perforations in the lid member 30Q. A flexible cover sheet 50Q normally covers the cover plate 42Q, but is removed prior to cooking.

The packaged meat product of FIGS. 65 and 66 is preferably cooked by inserting the meat patty portion of the package into the opening of a specially made stove, as shown in FIG. 66. The stove element is designated as 62 and has a side opening which is of such size and shape as to receive the meat patty compartment 32Q in a relatively tight-fitting relationship. Heat is applied to the meat patty 85 through the bottom wall of its compartment, and also through lid member 30Q representing the top wall of the compartment. Cooking gases generated from the meat patty flow horizontally over the wall section 33Q, into the bun compartment, and a portion of the cooking gases escape through the filter assembly which lies intermediate to the two bun halves. Other portions of the cooking gases, however, pass into and around the bun halves, serving to warm them up and to moisten them.

When cooking of the meat patty 85 is completed the package may be removed from the stove 62, and the lid member 30Q is then torn away from the pan member 10Q and a hamburger sandwich is assembled by placing the meat patty 85 between the two bun halves 64, 65.

At various points around its periphery the pan member 10Q has circular openings 58 formed therein, for the purpose of receiving and supporting small cup-shaped containers of selected condiments or seasonings.

In constructing the stove 62 it is preferred to constructed the opening as an elongated tunnel or passageway which is adapted to have a series of packages inserted therein, so that the different members of the series can be advanced through the tunnel or passageway as the cooking action progresses. Toward this end the lower and outer edge of the stove opening is preferably formed with an upwardly extending ledge 62A (FIG. 66) which underlies the wall portion 33Q of the hamburger package. The ledge **62*a* prevents the meat patty portion of the package from sliding out in a sidewise direction, and permits the operator to advance each package through the stove in a direction parallel to the common horizontal axis that would pass through the two bun halves 64 and 65**.

The packaged meat product shown in FIGS. 67 and 68 is nearly identical to that shown in FIGS. 65 and 66, but the views there shown are taken from opposite sides of the package. One specific structural difference is that the reduced wall portion 33Q1 of FIG. 68 is somewhat lower than the corresponding reduced wall portion 33Q of FIG. 66, and has its top more squarely cut. The larger space above the reduced wall portion 33Q1 permits the use of a handle 24Q1 which is in the form of a vertically disposed blade, whereas the handle 24Q shown in FIGS. 65 and 66 is essentially a horizontally disposed blade or strap. The manner of use and the manner of operation of the hamburger package of FIGS. 67 and 68 are, however, the same as for FIGS. 65 and 66.

EIGHTEENTH EMBODIMENT (FIGS. 69 to 74, inclusive)

Figure 69:
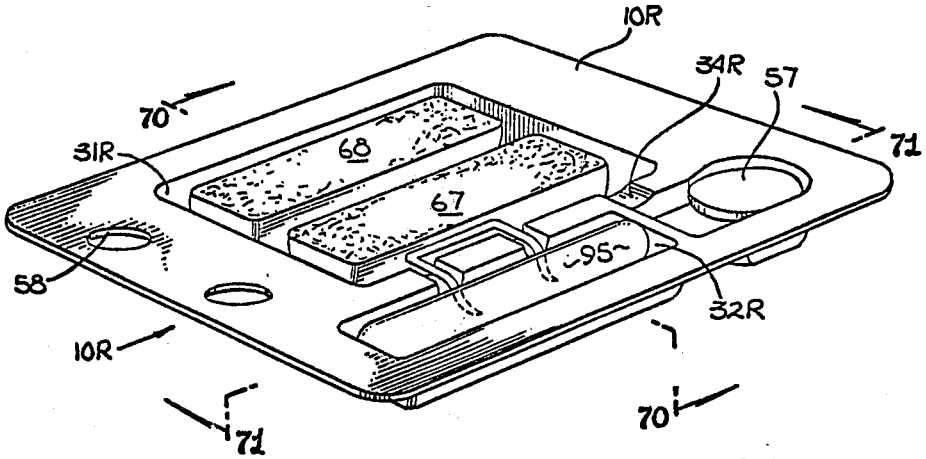
Figure 70:
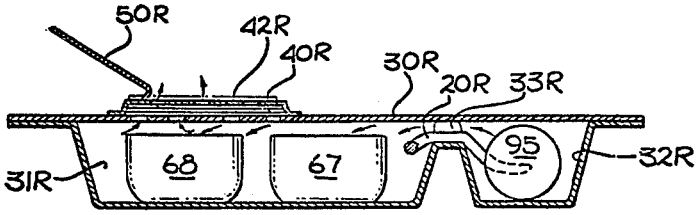
Figure 71:
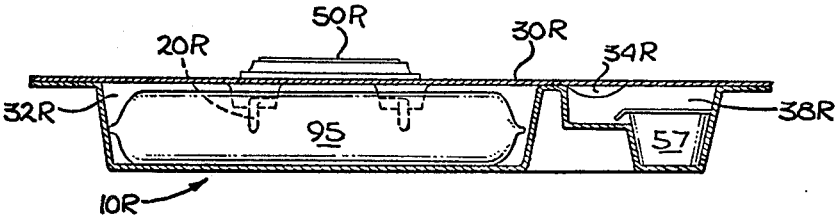
Figure 72:
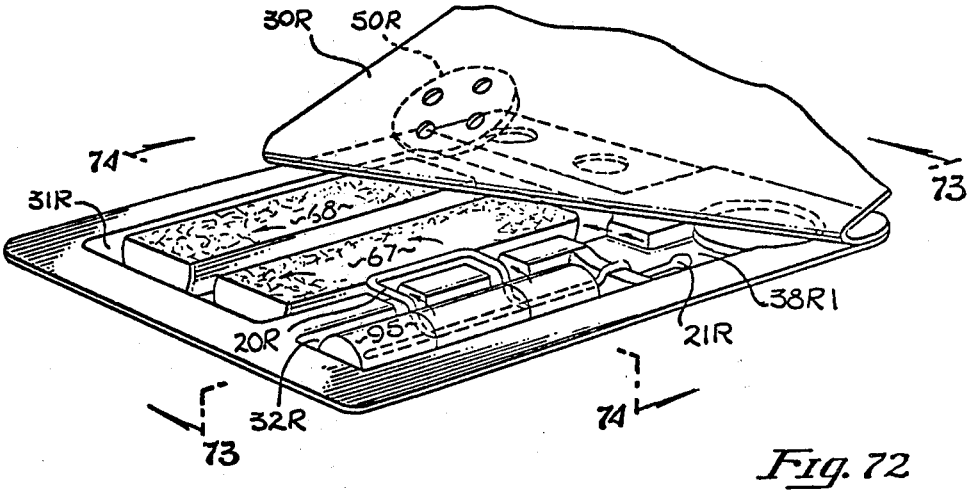
Figure 73:
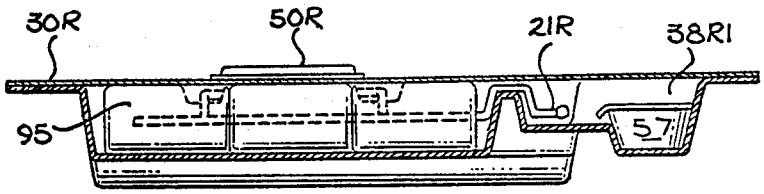
Figure 74:
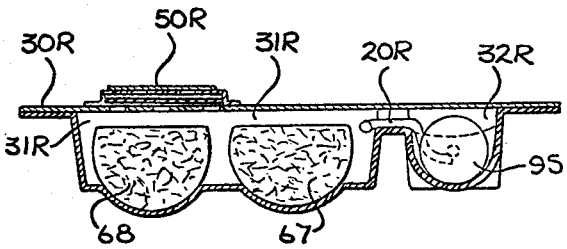

FIG. 69 is a perspective view of a packaged meat product, without the cover sheet, in accordance with an eighteenth embodiment of the invention;

FIG. 70 is a cross-sectional elevational view taken on the line 70—70 of FIG. 69;

FIG. 71 is a cross-sectional elevational view taken on the line 71—71 of FIG. 69;

FIG. 72 is a perspective view of a form of the invention which differs only slightly from that shown in FIG. 69;

FIG. 73 is a cross-sectional elevational view taken on the line 73—73 of FIG. 72; and FIG. 74 is a cross-sectional elevational view taken on the line 74—74 of FIG. 72.

Reference is now made to FIGS. 69 to 71, inclusive.

A pan member 10R has a generally flat, rectangular configuration, and it also has formed therein a relatively large rectangular recess 31R for receiving two half weiner buns 67, 68. Another elongated, rectangular recess 32R receives a weiner 95. The bun halves 67, 68 lie parallel to each other with their cut halves exposed upwardly, and the weiner 95 extends parallel and adjacent to the bun half 67.

A meat holder 20R is provided in the form of an essentially U-shaped fork having two tines which are stuck horizontally into the weiner 95 from one side thereof. Between compartment 31R and compartment 32R there are two reduced wall sections 33R, and one leg of the meat holder 20R passes over each reduced wall section but leaving adequate space for the passage of cooking gases therethrough. The flow of cooking gases is shown by the arrows in FIG. 70.

A lid member 30R (FIGS. 70 and 71) has a generally rectangular configuration and covers the entire upper surface of the pan member 10R. At a location over the bun half 68 there is a filter assembly, which is provided in part by holes or apertures formed in the lid member 3OR, and in addition there is a filter pad 40R which covers those holes or apertures and a cover plate 42R which lies above the filter pad 40R. Cover plate 42R has holes or apertures which are staggered horizontally with respect to the holes or apertures in lid member 3OR. A flexible cover sheet 50R normally is secured to the upper surface of cover plate 42R, but is removed prior to cooking.

Thus the operation is generally the same as that described for the preceding (seventeenth) embodiment of the invention. Cooking heat is preferably applied directly to compartment 32R in which the weiner 95 is contained, but not directly to the bun compartment. There is no space above the weiner compartment for escape of cooking gases, so they pass horizontally over the reduced wall portions 33R into the bun compartment 31R, and a portion of the cooking gases then escape through the filter assembly into the surrounding atmosphere, but a remaining portion of the cooking gases are effective for heating as well as moistening the bun halves. The base or handle portion of the meat holder 20R extends into the edge of compartment 31R adjacent the bun half 67. When cooking of the weiner is completed, the lid member 30R is removed from the package, and the meat holder 20R is used to position the weiner between the two bun halves before the meat holder is pulled out of the weiner.

Edge portions of the pan member 10R are preferably provided with circular holes 58 to receive cup-shaped containers of condiments or seasonings.

The package of FIGS. 69 to 71, inclusive, also includes a compartment 38R which is located at one end of the weiner compartment 32R. A reduced wall portion 34R provides a passageway for cooking gases from the bun compartment 31R into the compartment 38R. A small container 57 is located in compartment 38R (see FIG. 71). The container 57 may be utilized to contain mustard or relish or other condiment or seasoning material, which will then become warmed up during the process of cooking the weiner 95. Alternatively, the compartment 38R may be used to contain a small quantity of charcoal, or other absorptive material, for the purpose of completely absorbing some portion of the cooking gases generated during the cooking of the weiner.

Reference is now made to FIGS. 72 to 74, inclusive. While the package there shown is arranged somewhat differently than the package of FIGS. 69 to 71, inclusive, the operation is nevertheless the same. In addition to the meat holder 20R another meat holder 21R is also used. The meat holder 21R is in the form of an elongated pin which is inserted into the weiner 95 from one end thereof. The head end of pin 21R projects over an adjacent wall into the nearby compartment 38R1.

NINETEENTH EMBODIMENT (FIGS. 75 to 79, inclusive)

FIG. 75 is a perspective view of a nineteenth embodiment of the invention;

FIG. 76 is a perspective view showing the package of FIG. 75 when partially open;

FIG. 77 is a cross-sectional elevational view of the packaged meat product taken on the line 77—77 of FIG. 75;

FIG. 78 is a perspective view of the packaged meat product in its inner package, after the outer package has been removed; and FIG. 79 is an exploded perspective view of the meat product and inner package.

A meat patty of generally square configuration is designated as 101, and there are two half hamburger buns to be used with the meat patty to make a hamburger, the lower half bun being designated as 102 and the upper half bun as 103.

Before describing the outer package it will be convenient to first describe the inner package, particularly as shown in FIG. 79 but also as shown in FIGS. 77 and 78.

The inner package includes a top cap 110 which is a shallow pan of generally square configuration, and is inverted to fit over the uncut side of the upper bun 103. A handle or hook 111 protrudes downward from one side of the top cap 110. In the top wall of the top cap 110 a pair of breather openings 112 are formed, and each of these openings is formed by depressing a portion of the metal foil to form a hook which then protrudes downward into the upper surface of the bun. These hooks 113 are best seen in FIG. 77. The top wall of top cap 110 also includes a third breather opening 114, formed by raising a section of the metal foil to produce an upwardly turned hook 115. The hook 115 is located near one of the side edges of the top cap 110. From the opposite side edge a strap 116 depends downwardly. It will be noted that the handle or hook 111 is attached to what may be considered an end edge, located 90 degrees away from the hook 115 as well as 90 degrees away from the strap 116.

The bottom cap 120 is similarly constructed and holds the lower bun 102. The corresponding pair of breather openings 122 have hooks 123 which project upward into the bun (FIG. 77) and the third breather opening 124 has a downwardly depending hook 125 associated with it (not specifically shown in the drawings). A handle 121 is attached to one end of the bottom cap 120.

The relative positions of the top cap 110 and the bottom cap 120 are such that the strap 126 of bottom 120 will wrap around the meat patty 101 with the upper end of the strap 126 being engaged upon the hook 115. See FIG. 78. Midway of its length the strap 126 has an inwardly extending hook 127 formed thereon, which presses into one side wall of the meat patty 101 for holding it in its relative position. In similar fashion the strap 116 of top cap 110 extends downwardly, having a hook 117 which engages an opposite side of the meat patty 101, and with the lower end of the strap 116 engaging the hook 125 of bottom cap 120. Handle 121 is on the same end of the package as handle 111, so that both can be grasped at the same time.

Again referring particularly to FIG. 79, a meat holder includes a right half 130 and a left half 140. The right half 130 includes a tray 131 of elongated, rectangular configuration and having longitudinal ridges 132 formed thereon. A vertical backing member 134 is attached to the outer end of tray 131, and stub side walls 133 are attached to respective sides of the tray as well as to the associated ends of the backing member. Extending outward from backing member 134, in the direction away from tray 131, is a hollow handle 135.

As best seen in FIG. 77 the tray 131 has a longitudinal curve being bowed upward at its longitudinal center and being bowed downwardly at both of its ends. Since meat patty 101 rests squarely upon the tray 131, during cooking of the meat patty the grease and cooking juices will tend to run toward both ends of the tray 131. As best seen in FIG. 79 the backing member 134 is provided with small openings or ports at its lower edge to permit the grease to run through, and handle 135 at its lower extremity also has holes or apertures to permit the grease to drip through. FIG. 77 illustrates the path of flow of the grease during cooking of the meat patty.

The left half 140 of the meat holder is constructed similarly to the right half, having a top or cover member 141 in lieu of a tray. The backing member 144 is attached to the outer end of top member 141, and stub side walls 143 are attached both to the backing member and to the top member. A hollow handle 145 projects outward from the backing member 144, in a direction away from the top member 141. A lower portion of backing member 144 is removed (see dotted lines in FIG. 79) to permit insertion therein of the forward extremity of tray 131. Grease dripping from the forward end of the tray 131 flows into the holow handle 145 and down through apertures in the lower extremity of the handle, as best seen in FIG. 77.

When the inner package is fully assembled as shown in FIGS. 77 and 78 the top member 141 of the meat holder lies over the upper surface of meat patty 101 while tray 131 supports the meat patty from its under side. Strap 146 engaging hook 115, and strap 116 engaging hook 125, hold the package together, with assistance from the hooks 117, 127 which engage the meat patty as previously described.

The outer package 150 shown in FIGS. 75, 76 and 77 is made of such size and configuration as to fully enclose the inner package including top cap 110, bottom cap 120, handle 135 and handle 145. A filter assembly 151 is provided near the top of the package, to permit escape of cooking gases, and is constructed in a manner similar to the filter assemblies shown in previous embodiments of the invention. A pull tab 152 is provided for opening the package when cooking is completed.

During cooking the grease from meat patty 101 flows lengthwise on tray 131 into the hollow handle and then down into the outer package, as shown in FIG. 77. The bottom wall of the outer package is preferably provided with recesses for receiving and retaining the grease. When cooking is completed the tab 152 is pulled for opening one end of the outer package 150. The configuration of the package is then as shown in FIG. 76.

The next step is to grasp handle 135 and pull the inner package in a horizontal direction until it is entirely free of the housing or outer package 150. The inner package assembly then appears as shown in FIG. 78.

The next step is to disengage both parts of the meat holder from the meat patty 101. This is done by manipulating the handles 135 and 145 relative to each other and relative to the top cap 110 and bottom cap 120. Then the handles 135 and 145 are pulled laterally apart, and the two halves of the meat holder are removed from the inner package, leaving meat patty 101 grasped between the buns 102, 103. If there is any difficulty in sliding tray 131 from underneath the meat patty, the person preparing the hamburger may grasp the handles 111, 121 between thumb and forefinger of the left hand and hold them pressed together while pulling on handle 135 with the right hand. In this manner the meat patty 101 is held in place while the tray is disengaged and removed.

Thereafter, the straps 116, 126 are detached from their respective hooks, and the top cap 110 and bottom cap 120 are removed. A complete hamburger has now been prepared, consisting of meat patty 101 and the bun halves 102, 103.

An operational advantage of the embodiment shown in FIGS. 75 to 79, inclusive, is that during the cooking process heat is transmitted more effectively to the meat than to the bread. Specifically, the meat patty 101 is grasped between the tray 131 and top cover 141, which receive heat flow directly from their respective handles 135, 145. Rapid cooking of the meat patty is therefore assured.

OTHER MODIFICATIONS

Figures 80, 81, 82, 83, 84, 85:
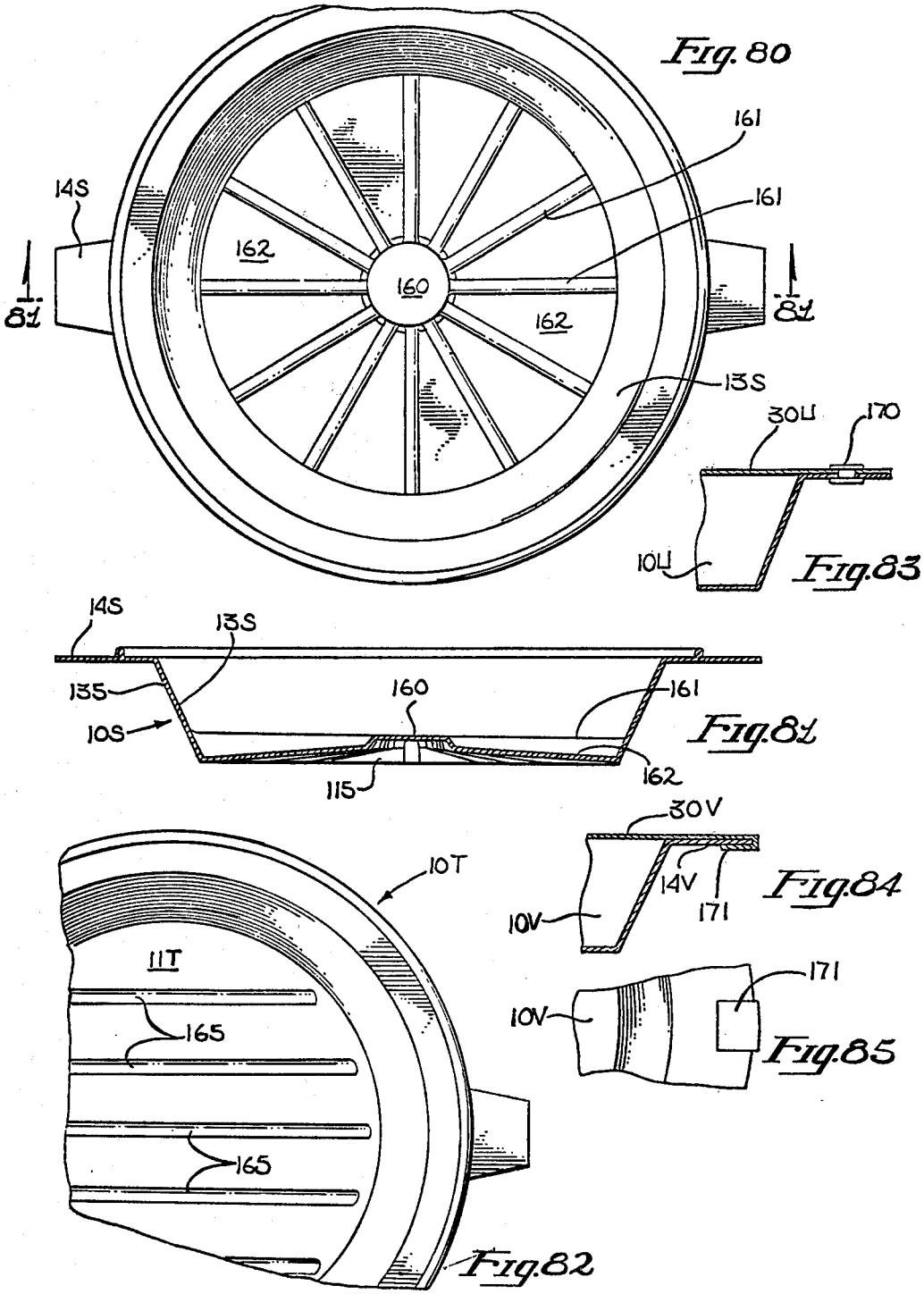
Figure 86:
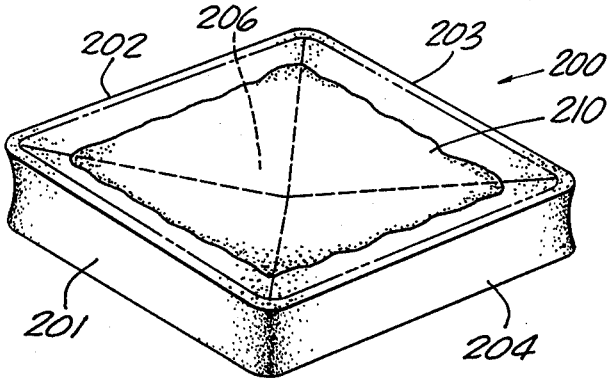
Figure 87:
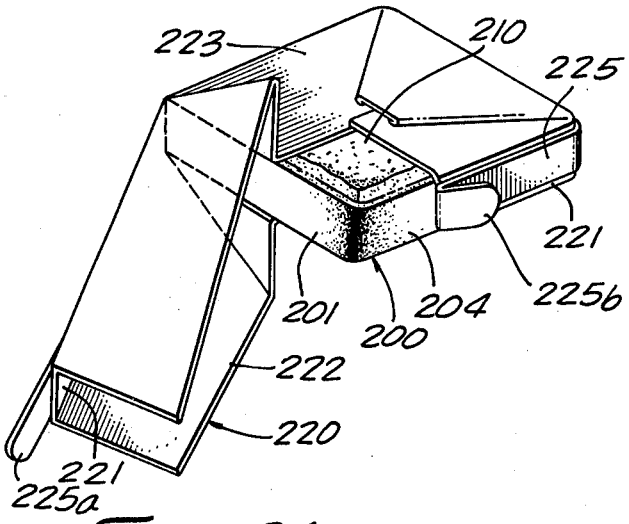

FIGS. 80 to 82, inclusive, show alternate methods of pan construction in accordance with the invention; and FIGS. 83 to 85, inclusive, show alternate fastening means for fastening the lid and pan together.

FIG. 80 is a top plan view of a modified form of pan construction 10S, and FIG. 81 is a cross-sectional view of the pan taken on the line 81—81 of FIG. 80. Pan 10S in its bottom wall 11S has a raised central portion 160 which is flat. Radially disposed ridges 161 are formed at the same elevation as the raised central portion 160, and extend from the center portion 160 to the circumferential side wall 13S. Between each two adjoining ones of the raised ridges 161 there is a pie-shaped groove 162. Groove 162 is rather shallow on its inner end adjacent the center part 160, but is deeper on its outer and wider end, being there connected to the lower extremity of side wall 13S.

It will be seen that the raised center portion 160 in conjunction with radial ribs 161 forms a flat table for supporting either a circular meat patty, or else a tray or holder upon which the meat patty in turn will rest. Grooves 162 form a grease trap for grease that is cooked out of the meat.

Referring to FIG. 82, another modified form of pan 10T has a flat bottom wall 11T in which a number of parallel raised ridges 165 are formed. The surfaces of ridges 165 form a supporting base for a meat patty during cooking, or for a tray or holder upon which the meat patty rests. The spaces between ridges 165 serve as a grease trap.

FIG. 83 is a fragmentary cross-sectional view of a container in accordance with the invention, in which pan 10U and a lid member 30U have their circumferential edge portions abutting together and joined by means of a rivet 170.

FIG. 84 is a fragmentary cross-sectional view showing a pan 10V and lid member 30V having their circumferential edge portions in abutting relationship, the lid member having a protruding finger 171 which has been turned over and underneath the flange 14V of the pan. FIG. 85 is an underneath view of the pan of FIG. 84 showing the finger 171.

It will be evident that in accordance with the invention wherever reference has been made to "crimping" the edges of the lid and pan together, other equivalent fastening means may be used if desired, such as, for example, the rivet shown in FIG. 83 or the bent-over finger shown in FIGS. 84 and 85.

TWENTIETH EMBODIMENT

(FIGS. 86–93)

Reference is now made to FIGS. 86 to 93, inclusive, of the drawings illustrating a twentieth embodiment of the invention.

A meat patty 200 has a flat generally rectangular configuration, being preferably square with outer walls 201, 202, 203, 204. The underside of the meat patty is somewhat concave forming a depression 205, and the upper side is even more concave forming a depression 206. Depression 206 has a shallow conical configuration. The thickness of the meat patty in its center portion 207 (see FIG. 92) is only about one-half its thickness near the outside walls 201, 202, 203, 204.

The upper depression 206 is filled with a gelatinized cooking sauce or other filler material 210.

Figure 88:
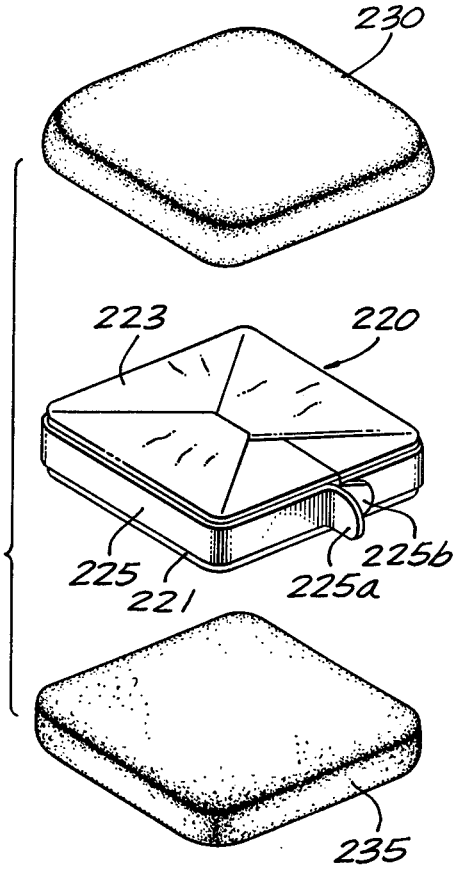
Figure 89:
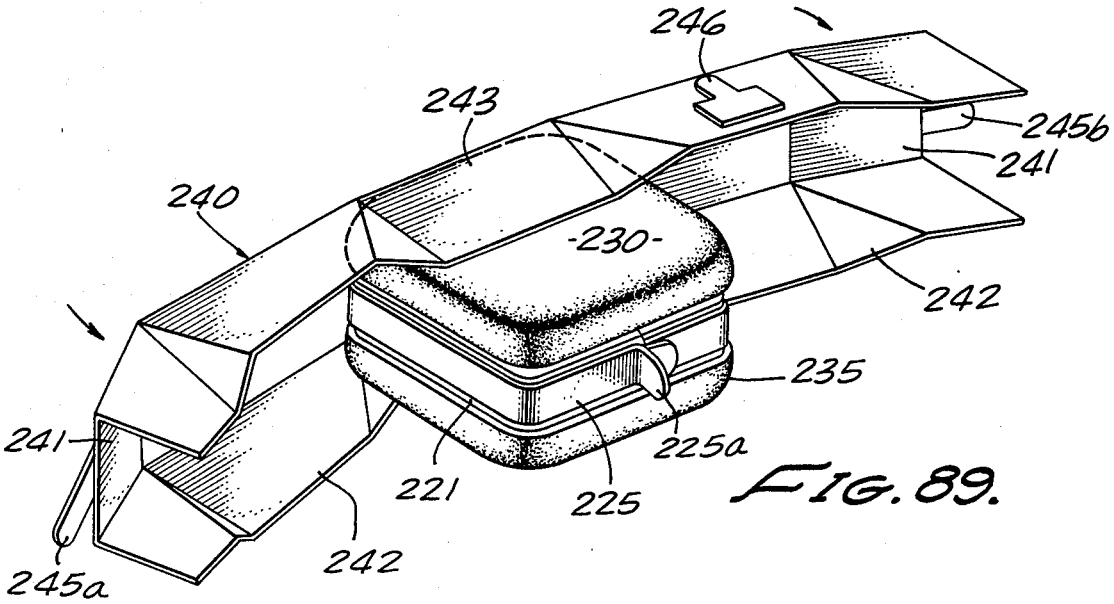

An inner wrapper 220 is made of aluminum foil. In its expanded position (partially shown in FIGS. 87 and 93) it has a generally trough-shaped configuration, lying on its side so that the bottom of the trough is a vertical wall 221, the lower side of the trough becomes a bottom wall 222, and the upper side of the trough becomes a top wall 223. The total length of vertical wall 221 of the wrapper 220 is about equal to the total circumference of the meet patty 200. Therefore, the inner wrapper can be wound about the outer walls 201, 202, 203, 204 of the meat patty, with the wrapper walls 222, 223 being folded over upon themselves at each corner of the meat patty. There is also a strap 225 which is somewhat longer than the wrapper 220, which is attached to the outer surface of the wrapper wall 221 and projects therebeyond on each end thereof. The strap 225 is bonded in a suitable manner to the wrapper, throughout the length of the wrapper. In the fully folded form of the wrapper as shown in FIG. 88 the ends of strap 225 become perpendicular flaps 225*a*, 225*b* which project outwardly from the longitudinal center of one wall 204 of the meat patty. These flaps can then be used as finger tabs for pulling the inner wrapper open, so that it may then be removed entirely from the meat patty.

After the meat patty 200 has been placed within the inner wrapper 220, the next step is to place the wrapped patty between the bun halves 230, 235. The entire sandwich is then wrapped in an outer aluminum foil wrapper 240. Outer wrapper 240 is shown in an open condition in FIGS. 89 and 93. It is also essentially trough-shaped but its vertical wall 241 is of sufficient height to accommodate the entire thickness of the sandwich including bun halves 230, 235 and the wrapped meat patty 200, whereas the vertical wall 221 of the inner wrapper has sufficient height to accommodate only the meat patty itself.

Thus the outer wrapper 240 has the vertical wall 241, a bottom wall 242, and a top wall 243. A portion of top wall 243 is vented with a plurality of vent holes 248, and the vent holes are normally covered with a removable cover 246. A strap 245 has a length greater than the length of the wrapper 240, and is attached to the outer surface of vertical wall 241 but extends beyond on both ends. When the outer wrapper is wrapped around the sandwich, the projecting strap ends 245*a*, 245*b* then provide finger tabs for opening up and removing the wrapper.

Figure 90:
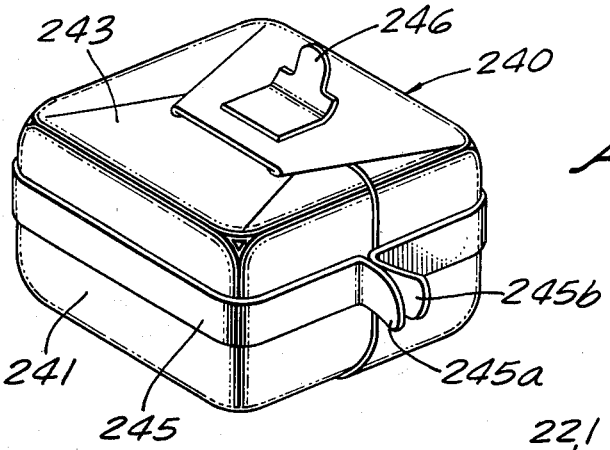

The fully assembled condition of the sandwich is shown in FIG. 90. The packaged sandwich may then be stored in a freezer or refrigerator or other desired place of storage.

When the sandwich is to be cooked, the cover 246 is removed from the vent holes 248. The packaged hamburger is then placed in a special oven as shown in FIGS. 91 and 92.

The purpose of the special oven is to apply heat energy directly to the inner wrapper 220 and hence to the meat patty 200, while at the same time applying heat only indirectly to the bun halves 230, 235. Toward that end the oven 250 is provided with metal jaws 251, 252, 253 which lie in a common plane and are arranged in a U-shaped configuration. The sandwich is inserted within the jaws with the meat patty 200 occupying the same plane as the jaws. As shown in FIG. 92, the jaws are in direct engagement with the metal foil strap 245 which extends around the outer wrapper, and the heat energy therefore flows from the jaws through the strap 245, vertical wall 241 of the outer wrapper, strap 225 associated with the inner wrapper, and side wall 221 of the inner wrapper. The heat energy is therefore applied directly to the peripheral walls 201, 202, 203, of the meat patty 200.

Figure 91:
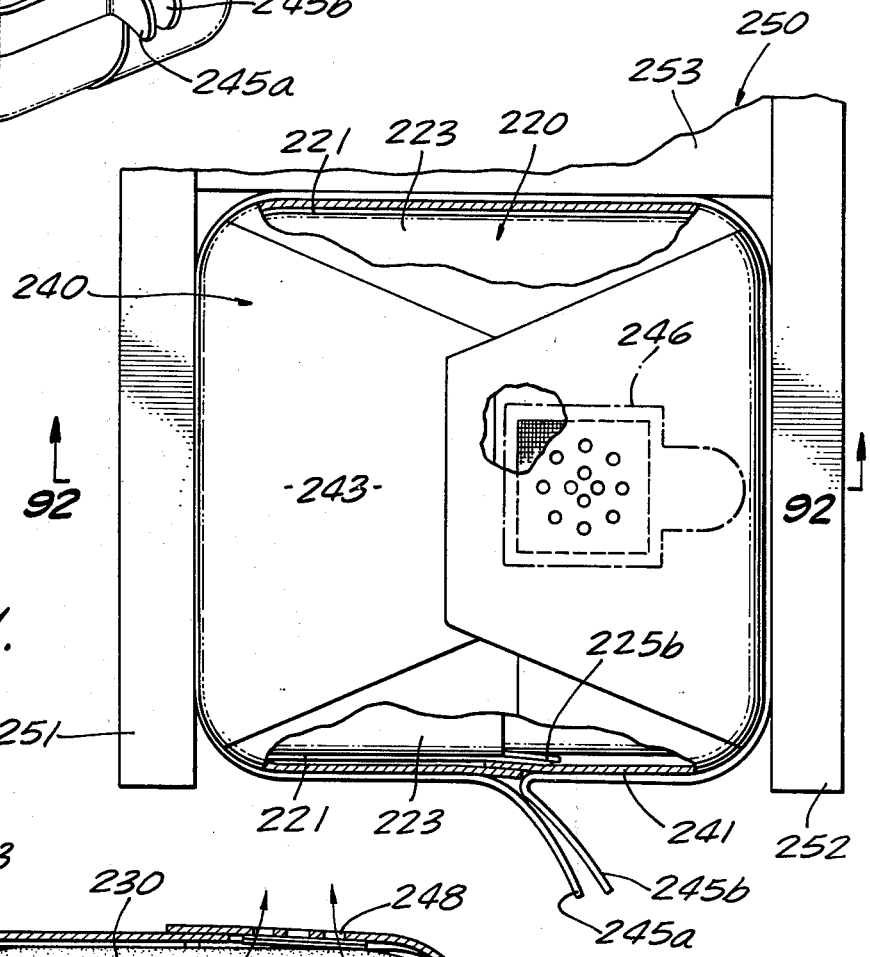
Figure 92:
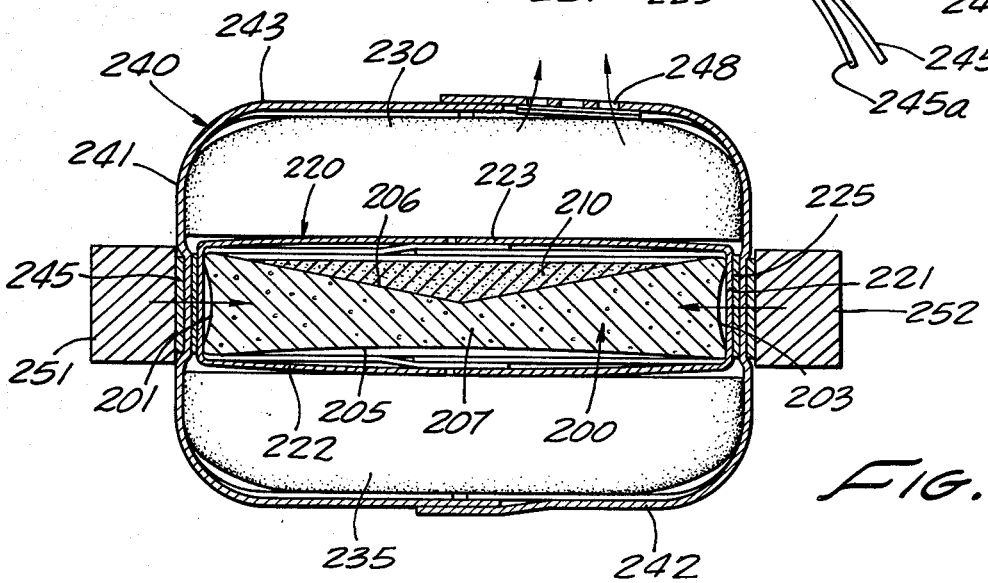

During cooking, illustrated in FIGS. 91, 92, the meat patty is shielded from intimate contact with the bun halves. The inner wrapper is effective to restrict the outward flow of heat energy from the meat patty into the bun halves. The inner wrapper is also effective to restrict the outward flow of moisture from the meat patty into the bun halves. Cooking of the meat patty is made more effective by virtue of the fact that its central portion 207 is only about half the thickness of its peripheral edge portion, to which the heat is directly applied. The congealed or gelatinized cooking sauce melts during the cooking operation, and to some extent diffuses into the meat patty, but is still held in place by means of the recess or depression on the upper surface of the meat patty.

When cooking is completed both the wrappers are removed, as indicated in FIG. 93. The outer wrapper is removed first, and the inner wrapper is then removed by pulling it radially outwardly from the sandwich, at the same time keeping the meat patty positioned between the bun halves. Cooking juices and moisture from the meat patty which were formerly restrained by the inner wrapper are now absorbed into the adjacent surface of the bun halves. The sandwich is then ready to eat.

While FIGS. 86 through 93 illustrate wrappers made of aluminum foil, it is also within the scope of the present invention to make the wrappers of paper of fiber material having no electrical conductivity. It is then advantageous to cook the packaged sandwich by placing it in a microwave oven. The oven then induces most of its heating action directly within the meat patty, causing it to cook rapidly. At the same time the inner wrapper is effective to restrict the outward flow of both heat energy and moisture from the meat patty into the bun halves. When the meat patty is cooked the sandwich is removed from the oven, and both outer and inner wrappers removed from the sandwich. When removing the inner wrapper the preferred procedure, as previously described, is to hold the meat patty between the bun halves, so that as the inner wrapper is pulled out the cooking juices will flow directly from the meat patty into the adjacent surfaces of the bun halves.

Figure 96:
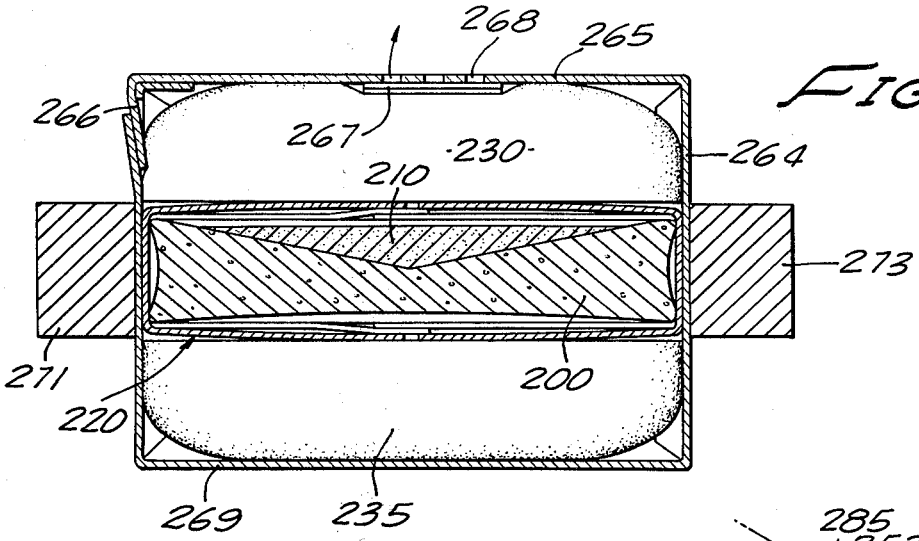

Reference is now made to FIGS. 94 through 96 which illustrate a modified form of the outer wrapper in accordance with the twentieth embodiment of the invention. The outer wrapper 260 is essentially a Bliss box type of container. It is fabricated almost entirely from a single sheet of cardboard or the like, and includes a central or base portion 269 (FIG. 96) which is square. The hamburger is placed on top of the base part 269 (FIG. 94). Side flaps 261, 262 attached to the base part fold upwardly, and top flaps 261*a*, 262 attached to respective side flaps then fold inwardly over the top of the hamburger. One end flap 263 carries a top flap 263*a* as well as wrap-around flaps 263*b*, 263*c*, which become attached to the side flaps 262, 261, respectively. The other end flap 264 also has wrap-around flaps 264*a*, 264*b*. In addition, it has attached to it the top flap 265, which swings over the upper surface of the hamburger. A filter pad 267 is fastened to the under side of top flap 265 (FIG. 94). A fastening tab 266 which extends outward from the remote end of top flap 265 is tucked into a slot or opening 264*d* formed in the upper edge of end flap 263, for closing the container. (FIGS. 95 and 96).

It will be understood that in the modification shown in FIGS. 94 through 96 the meat patty 200, sauce 210, and inner wrapper 220 are the same as originally described in conjunction with FIGS. 86 through 93. Thus the entire sandwich and its method of cooking are the same as previously described. The stove 270 illustrated in FIG. 95 has jaws 271, 272, 273, 274 which engage the hamburger sandwich on all four of its sides; this type of oven, however, may equally well be used with embodiment of FIGS. 86 through 93.

Figure 97:
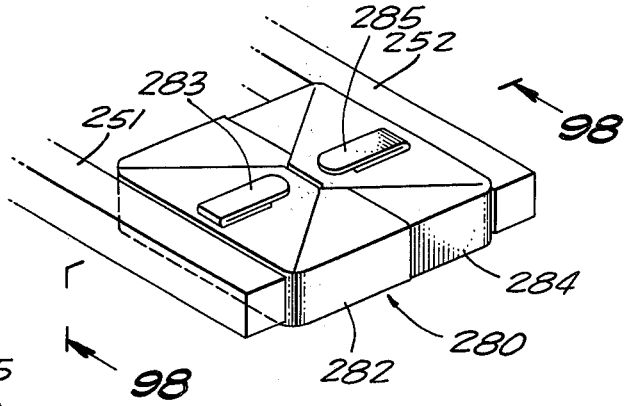
FIGS. 97 through 99 illustrate the cooking of a meat patty contained in an inner wrapper, without the buns.
Figure 98:
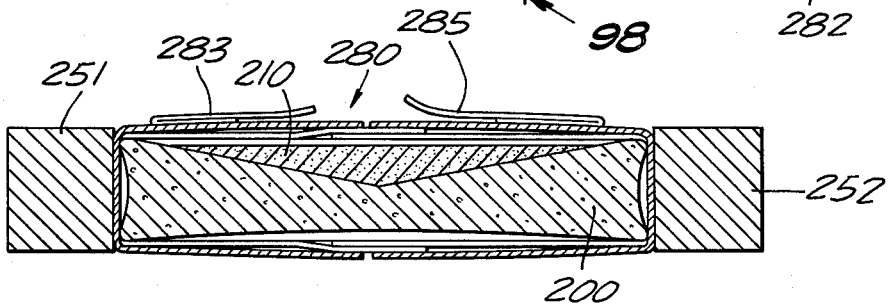
Figure 99:
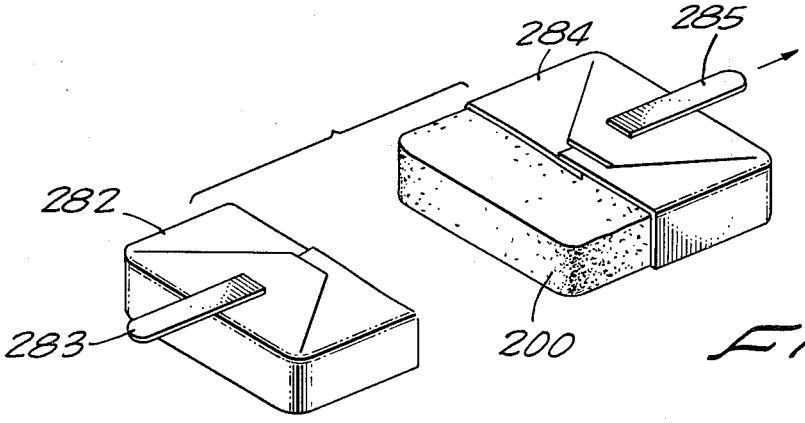

Reference is made to FIGS. 97 through 99 illustrating further variations of the twentieth embodiment of the invention. Meat patty 200 and cooking sauce 210 are the same as before. The inner wrapper 280, however, is constructed of two separate halves, which may be pulled apart from each other.

Thus the inner wrapper 280 includes a half-wrapper 292 having pull-tab 283, and a half-wrapper 284 having pull-tab 285. Each half-wrapper is folded into an essentially rectangular box configuration, and slips horizontally over one peripheral wall of the meat patty. When fully in place the two half-wrappers overlap each other slightly, as shown in FIGS. 97 and 98. To remove either one of the half-wrappers, its pull-tab is grasped and pulled horizontally outwardly, as indicated in FIG. 99.

FIGS. 97 and 98 also illustrate the cooking of the meat patty directly in its inner wrapper, without the presence of any buns. The inner wrapper is simply placed between the hot metal jaws 251, 252 of the special oven, as previously described.

TWENTY-SECOND EMBODIMENT

(FIGS. 100–102)

Figure 100:
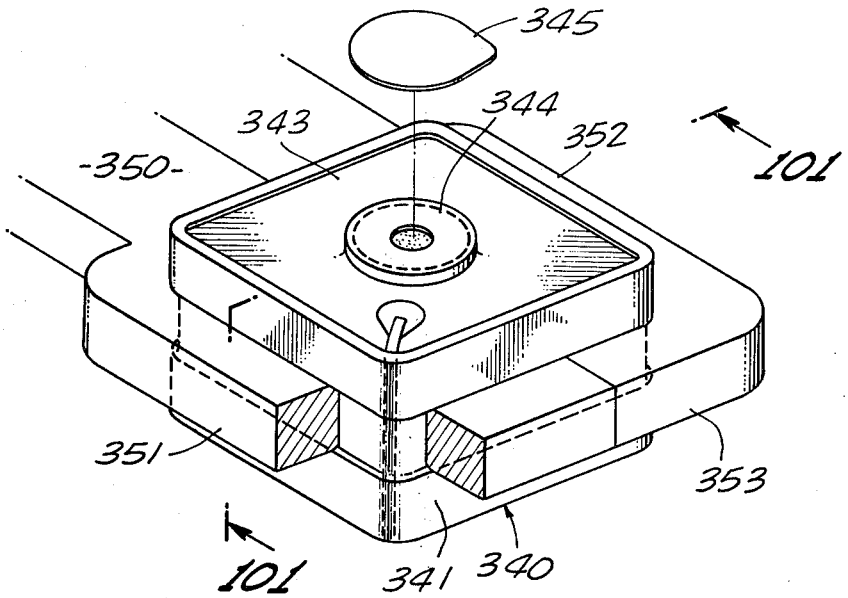
FIGS. 100 through 102 illustrate a twenty-second form of the invention.
Figure 101:
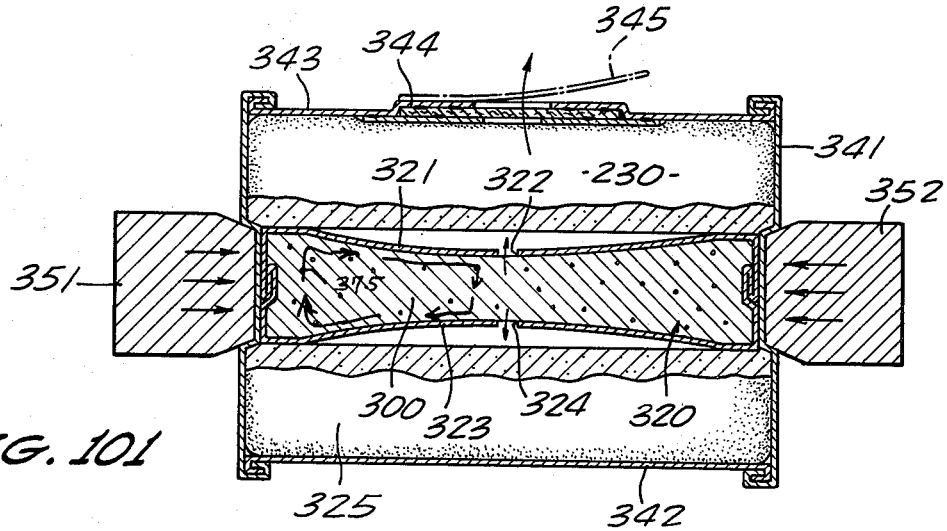
Figure 102:
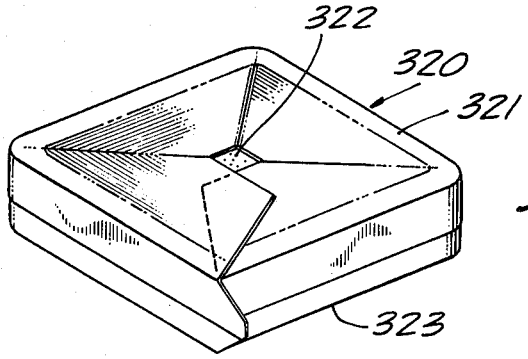

Reference is now made to FIGS. 100 to 102, inclusive, illustrating a twenty-second embodiment of the invention.

According to this embodiment of the invention the meat patty 300 (FIG. 101) is thinned in its central portion, in the same general fashion as described with reference to the twenty-first embodiment. However, the depression on the upper side of meat patty, and the depression on the lower side of the meat patty, are substantially equal to each other. Also, no cooking sauce is used, and the inner wrapper 320 (shown in perspective in FIG. 102) is made to substantially conform to the configuration of the meat patty. An additional feature is that the inner wrapper 320 has a vent opening 322 for the upper surface of the center portion of the meat patty, and a similar vent opening 324 for the lower surface of the central portion of the patty.

Inner wrapper 320 is preferably made of aluminum foil, including an upper member 321 and a lower member 323, both of which are pressed or stamped to the correct configuration. The two members overlap each other in a folded joint around the peripheral wall of the meat patty, as best seen in FIG. 101.

A special oven, similar to those previously described, is utilized for cooking. Thus the hot metal jaws 351, 352, 353 engage the outer wrapper 340 along the sides of the meat patty. The circumferential wall of the inner wrapper also engages the circumferential wall of the meat patty. This is a relatively tight engagement so that heat flows efficiently from the metal jaws through the wall of the outer wrapper, the wall of the inner wrapper, and into the peripheral edge of the meat patty. Heavy arrows in FIG. 101 indicate the direction of heat flow out of the metal jaws. Lighter arrows in FIG. 101 indicate the flow of cooking gases through the vents 323 and 324 in the inner wrapper, and also through a vent 344 in the top of the outer wrapper 340.

The special configuration of the meat patty and the inner wrapper in accordance with this embodiment of the invention provide a unique cooking action as follows. Moisture cooked out of the central portion of the meat patty tends, to some extent, to collect upon the bottom wall 323 of the inner wrapper. Since this bottom wall is convexly upwardly curved (as clearly shown in FIG. 101) the moisture which collects upon it then tends to run down hill, or in a radially outward direction towards the outer peripheral edges of the meat patty. The radially outward portions of the meat patty, however, receive the direct application of heat from the oven jaws, as previously described. Therefore, moisture reaching the radially outward portion of the meat patty tends to vaporize and to rise upwardly through the chopped meat of the patty. Some portion of this moisture rises to the upper wall 321 of the inner wrapper 320, and because of the downwardly convex curvature of that wall (FIG. 101) it then tends to run radially inwardly toward the center portion of the meat patty. Here the cooking temperature is less, because of the remoteness from the oven jaws, and the moisture to some extent therefore migrates downward through the meat patty and falls upon the upper surface of the lower wall 323 of the wrapper. This moisture flow cycle is indicated in FIG. 101 by the loop of arrows 375.

The outer wrapper 340 of FIGS. 100–102 is also somewhat different from the outer wrapper previously illustrated. The side wall 341, bottom wall 342, and top wall 343 are made as separate pieces. Side wall 341 is attached to bottom wall 342 by means of a peripheral roll-over joint, and is attached to the top wall 343 by another roll-over joint. The assembly procedure for the hamburger sandwich is the same as previously described; that is, inner wrapper 320 is placed about the meat patty 300, the wrapped patty is placed between the bun halves 230, 235, and then the outer wrapper 340 is placed about the complete sandwich. Vent 344 in the lid 343 of outer wrapper 340 is provided with a removable cover 345. This cover is removed upon placement of the sandwich into the special oven.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A prepared meat product packaged for shipping and cooking in the same package comprising:

a hamburger patty of generally rectangular configuration;

an inner wrapper having a generally trough-shaped configuration lying on its side so that the bottom of said trough is a vertical wall, the lower side of said trough is a bottom wall, and the upper side of said trough is a top wall, said wrapper being wound around the side edges of said patty and said wrapper walls being folded over upon themselves at each corner of said patty;

two half hamburger buns arranged in sandwich fashion upon the top and bottom surfaces of said wrapped patty, respectively; and an outer wrapper having a generally trough-shaped configuration lying on its side so that the bottom of said trough is a vertical wall, the lower side of said trough is a bottom wall, and the upper side of said trough is a top wall, said wrapper enclosably surrounding said sandwich and said outer wrapper walls being folded over upon themselves at each corner thereof.

2. The package of claim 1 wherein the underside of said hamburger patty is somewhat concave, forming a depression therein, and the upper side of said patty having an even greater concave depression formed therein, said patty having a thickness in its center portion of approximately one-half its thickness near the outer edges thereof.

3. The package of claim 1 wherein said inner wrapper includes a strap which is somewhat longer than said wrapper, attached to the outer surface of said wrapper vertical wall, and projecting therebeyond on each end thereof for the purpose of pulling the inner wrapper open and removing it after said patty has been cooked.

4. The package of claim 1 wherein said outer wrapper includes a strap which is somewhat longer than said wrapper and which is attached to the outer surface of said wrapper vertical wall, projecting therebeyond on each end thereof, said strap providing finger tabs for the opening and removal of said wrapper from said sandwich after the cooking of said meat patty has been completed.

5. A prepared meat product as in claim 1 which additionally includes vent means formed in said outer wrapper, and a cover sheet normally covering said vent means and being adhesively secured in place, said cover sheet being removable prior to cooking said meat product.

6. A prepared meat product packaged for shipping and cooking in the same package, comprising:

a meat patty;

an inner metal foil wrapper removably wrapped about said meat patty;

two pieces of bread arranged in sandwich fashion upon the top and bottom surfaces, respectively, of said wrapped patty; and an outer metal foil wrapper removably wrapped about the entire sandwich;

such that heat may be conductively transmitted through both of said wrappers into the side edges of said meat patty for the purpose of cooking it.

7. A prepared meat product as in claim 6 wherein at least one of said wrappers is equipped with pull tabs for opening the same.

8. A prepared meat product as in claim 6 wherein at least one of said wrappers has a vent opening therein.

* * * * *